US008618453B2

(12) United States Patent
Blankenbeckler et al.

(10) Patent No.: US 8,618,453 B2
(45) **Date of Patent: *Dec. 31, 2013**

(54) MICROWAVE SUSCEPTOR ASSEMBLY HAVING OVERHEATING PROTECTION

(75) Inventors: Nicole L. Blankenbeckler, Richmond, VA (US); William R. Corcoran, Jr., Kennett Square, PA (US); Dariusz Wlodzimierz Kawka, Midlothian, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 1838 days.

This patent is subject to a terminal disclaimer.

(21) Appl. No.: 11/641,929

(22) Filed: Dec. 18, 2006

(65) Prior Publication Data

US 2007/0181569 A1 Aug. 9, 2007

Related U.S. Application Data

(60) Provisional application No. 60/751,544, filed on Dec. 19, 2005, provisional application No. 60/841,107, filed on Aug. 29, 2006.

(51) Int. Cl.
*H05B 6/80* (2006.01)
*H05B 6/64* (2006.01)

(52) U.S. Cl.
USPC ..... 219/730; 219/728; 219/732; 219/745; 219/763

(58) Field of Classification Search
USPC ..... 219/728–730, 725, 745, 773, 751, 752, 219/762, 759, 753, 754; 426/107, 109, 110, 426/113
See application file for complete search history.

(56) References Cited

U.S. PATENT DOCUMENTS

| | | | | |
|---|---|---|---|---|
| 3,946,187 | A * | 3/1976 | MacMaster et al. | 219/728 |
| 4,144,438 | A * | 3/1979 | Gelman et al. | 219/728 |
| 4,424,430 | A | 1/1984 | Almgren et al. | |
| 4,486,640 | A | 12/1984 | Bowen et al. | |
| 4,629,849 | A | 12/1986 | Mizutani et al. | |
| 4,896,009 | A | 1/1990 | Pawlowski | |
| 4,904,836 | A * | 2/1990 | Turpin et al. | 219/759 |
| 4,943,439 | A | 7/1990 | Andreas et al. | |
| 4,972,059 | A | 11/1990 | Wendt et al. | |
| 4,992,638 | A | 2/1991 | Hewitt et al. | |
| 5,006,684 | A | 4/1991 | Wendt et al. | |
| 5,185,506 | A | 2/1993 | Walters | |
| 5,217,765 | A | 6/1993 | Parks | |

(Continued)

FOREIGN PATENT DOCUMENTS

| | | |
|---|---|---|
| EP | 0 049 551 | 4/1982 |
| EP | 0 332 782 A1 | 9/1989 |

(Continued)

OTHER PUBLICATIONS

Papadakis et al. "A versatile and Inexpensive Technique for Measuring Color of Foods", Food Technology, vol. 54, No. 12, Dec. 2000, pp. 48-51.

*Primary Examiner* — Henry Yuen
*Assistant Examiner* — Hung D Nguyen

(57) ABSTRACT

A susceptor assembly includes electrically conductive vanes positioned with respect to each other and to an planar susceptor member having an electrically lossy layer thereon to prevent overheating of the susceptor in an unloaded microwave oven.

20 Claims, 40 Drawing Sheets

(56) References Cited

U.S. PATENT DOCUMENTS

| | | | | |
|---|---|---|---|---|
| 5,220,142 | A * | 6/1993 | LaMaire et al. | 219/745 |
| 5,242,106 | A | 9/1993 | Gulliver | |
| 5,247,149 | A | 9/1993 | Peleg | |
| 5,310,977 | A | 5/1994 | Stenkamp et al. | |
| 5,800,724 | A * | 9/1998 | Habeger et al. | 216/35 |
| 5,877,479 | A | 3/1999 | Yu | |
| 5,900,264 | A | 5/1999 | Gics | |
| 5,986,248 | A | 11/1999 | Matsuno et al. | |
| 6,063,415 | A | 5/2000 | Walters | |
| 6,359,271 | B1 | 3/2002 | Gidner et al. | |
| 6,359,272 | B1 | 3/2002 | Sadek et al. | |
| 6,414,290 | B1 | 7/2002 | Cole et al. | |
| 2004/0000545 | A1 * | 1/2004 | Kim | 219/754 |
| 2005/0230383 | A1 | 10/2005 | Romeo et al. | |
| 2006/0011620 | A1 | 1/2006 | Tsontzidis et al. | |

FOREIGN PATENT DOCUMENTS

| | | | |
|---|---|---|---|
| EP | 0 943 558 | | 9/1999 |
| EP | 1 479 619 | | 11/2004 |
| FR | 2694876 | | 2/1994 |
| GB | 2 329 815 | | 3/1999 |
| JP | 04-371724 | | 12/1992 |
| JP | 6-65278 | U | 9/1994 |
| JP | 08 203668 | | 8/1996 |
| JP | 09-280569 | | 10/1997 |
| JP | 2004-309082 | | 4/2004 |
| WO | WO 2005/032318 | A1 | 4/2005 |
| WO | WO 2005/085091 | A2 | 9/2005 |
| WO | WO 2006/113886 | | 10/2006 |

* cited by examiner

Results of Example 6

Results of Example 7

1.0" wide cellulose paperboard vane

MICROWAVE SUSCEPTOR ASSEMBLY HAVING OVERHEATING PROTECTION

This application claims the benefit of U.S. Provisional Applications 60/841,107 which was filed 29 Aug. 2006, and 60/751,544, which was filed 19 Dec. 2005 and are incorporated as a part hereof for all purposes.

FIELD OF THE INVENTION

The present invention is directed to a susceptor assembly which prevents overheating when used in an unloaded microwave oven.

CROSS-REFERENCE TO RELATED APPLICATIONS

Subject matter disclosed herein is disclosed in the following copending applications filed contemporaneously herewith and assigned to the assignee of the present invention:

Arc-Resistant Microwave Susceptor Assembly, U.S. application Ser. No. 11/641,276, filed Dec. 18, 2006;

Field Director Assembly Having Arc-Resistant Conductive Vanes, U.S. application Ser. No. 11/641,369, filed Dec. 18, 2006; and Field Director Assembly Having Overheating Protection, U.S. application Ser. No. 11/641,370, filed Dec. 18, 2006.

BACKGROUND OF THE INVENTION

Microwave ovens use electromagnetic energy at frequencies that vibrate molecules within a food product to produce heat. The heat so generated warms or cooks the food. However, the food is not raised to a sufficiently high temperature to brown its surface to a crisp texture (and still keep the food edible).

To achieve these visual and tactile aesthetics a susceptor formed of a substrate having a lossy susceptor material thereon may be placed adjacent to the surface of the food. When exposed to microwave energy the material of the susceptor is heated to a temperature sufficient to cause the food's surface to brown and crisp.

The walls of a microwave oven impose boundary conditions that cause the distribution of electromagnetic field energy within the volume of the oven to vary. These variations in intensity and directionality of the electromagnetic field, particularly the electric field constituent of that field, create relatively hot and cold regions in the oven. These hot and cold regions cause the food to warm or to cook unevenly. If a microwave susceptor material is present the browning and crisping effect is similarly uneven.

To counter this uneven heating effect a turntable may be used to rotate a food product along a circular path within the oven. Each portion of the food is exposed to a more uniform level of electromagnetic energy. However, the averaging effect occurs along circumferential paths and not along radial paths. Thus, the use of the turntable still creates bands of uneven heating within the food.

This effect may be more fully understood from the diagrammatic illustrations of FIGS. 1A and 1B.

FIG. 1A is a plan view of the interior of a microwave oven showing five regions ($H_1$ through $H_5$) of relatively high electric field intensity ("hot regions") and two regions $C_1$ and $C_2$ of relatively low electric field intensity ("cold regions"). A food product F having any arbitrary shape is disposed on a susceptor which, in turn, is placed on a turntable T. The susceptor is suggested by the dotted circle while the turntable is represented by the bold solid-line circle. Three representative locations on the surface of the food product F are illustrated by points J, K, and L. The points J, K, and L are respectively located at radial positions $P_1$, $P_2$ and $P_3$ of the turntable T. As the turntable T rotates each point follows a circular path through the oven, as indicated by the circular dashed lines.

As may be appreciated from FIG. 1A, during one full revolution point J passes through a single region $H_1$ of relatively high electric field intensity. During the same revolution the point K passes through a single smaller region $H_5$ of relatively high electric field intensity, while the point L experiences three regions $H_2$, $H_3$ and $H_4$ of relatively high electric field intensity. Rotation of the turntable through one complete revolution thus exposes each of the points J, K, and L to a different total amount of electromagnetic energy. The differences in energy exposure at each of the three points during one full rotation is illustrated by the plot of FIG. 1B.

Owing to the number of hot regions encountered and cold regions avoided, points J and L experience considerably more energy exposure than Point K. If the region of the food product in the vicinity of the path of point J is deemed fully cooked, then the region of the food product in the vicinity of the path of point L is likely to be overcooked or excessively browned (if a susceptor is present). On the other hand, the region of the food product in the vicinity of the path of point K is likely to be undercooked.

Since non-uniform cooking due to the presence of hot and cold regions is undesirable it has been found advantageous to employ a susceptor assembly formed by the combination of a field director structure with a susceptor. The field director structure includes one or more vanes, each having a conductive portion on a paperboard support. The field director structure mitigates the effects of regions of relatively high and low electric field intensity within a microwave oven by redirecting and relocating these regions so that food warms, cooks and browns more uniformly. Use of the field director structure alone (i.e., without a susceptor) has also been found advantageous.

When a susceptor assembly is placed in an "unloaded" microwave oven (i.e., an oven without a food product or other article being present) and the oven is energized deleterious problems of overheating of the susceptor, and/or overheating of the field director structure, and/or arcing have been observed.

By "overheating of the susceptor" (or similar terms) it is meant heating of the lossy susceptor material to the extent that the susceptor substrate burns.

"Overheating of the field director structure" (or similar terms) means heating of the paperboard support of the vanes to the extent that it burns. Such overheating may be caused by either the heat generated by a lossy susceptor material or by arcing.

"Arcing" (or similar terms) is an electrical discharge occurring when a high intensity electric field exceeds the breakdown threshold of air. Arcing typically occurs in the vicinity of the electrically conductive portions of the vanes, particularly along the edges, and especially at any sharp corners. Arcing may cause the paperboard support of the vanes to discolor, to char, or, in the extreme, to ignite and to burn.

Most common expedients to prevent arcing are impractical in microwave oven applications. These expedients are also not suitable for disposable packaging for convenience foods.

In view of the foregoing it is believed advantageous to provide a field director structure and a susceptor assembly incorporating the same that prevents the occurrence of arcing, the occurrence of overheating of the field director, and the occurrence of overheating of the susceptor.

SUMMARY OF THE INVENTION

The present invention is directed to a susceptor assembly that does not overheat when placed in an "unloaded" microwave oven, i.e., an oven without a food product or other article being present. The microwave oven is operative to generate a standing electromagnetic wave having a predetermined wavelength.

The susceptor assembly includes a generally planar susceptor having a substrate with an electrically lossy layer. A field director structure having one or more vanes are mechanically connected to the susceptor. Each vane has an electrically conductive portion that is generally rectangular in shape with a predetermined length and width dimension and has a first end and a second end thereon. The electrically conductive portion of the vane may be formed from a metallic foil less than 0.1 millimeter in thickness.

The electrically conductive portion of each vane is disposed at least a predetermined close distance from the electrically lossy layer of the planar susceptor. The predetermined close lies in the range from 0.025 times the wavelength to 0.1 times the wavelength. In the preferred instance the predetermined close distance is defined by a border of a lower conductivity material disposed between the conductive portion of the vane and the lossy layer.

The first end of the conductive portion on each of the vanes is disposed at a distance at least a predetermined separation distance from the geometric center of the planar susceptor. The predetermined separation distance is at least 0.16 times the wavelength.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1A:
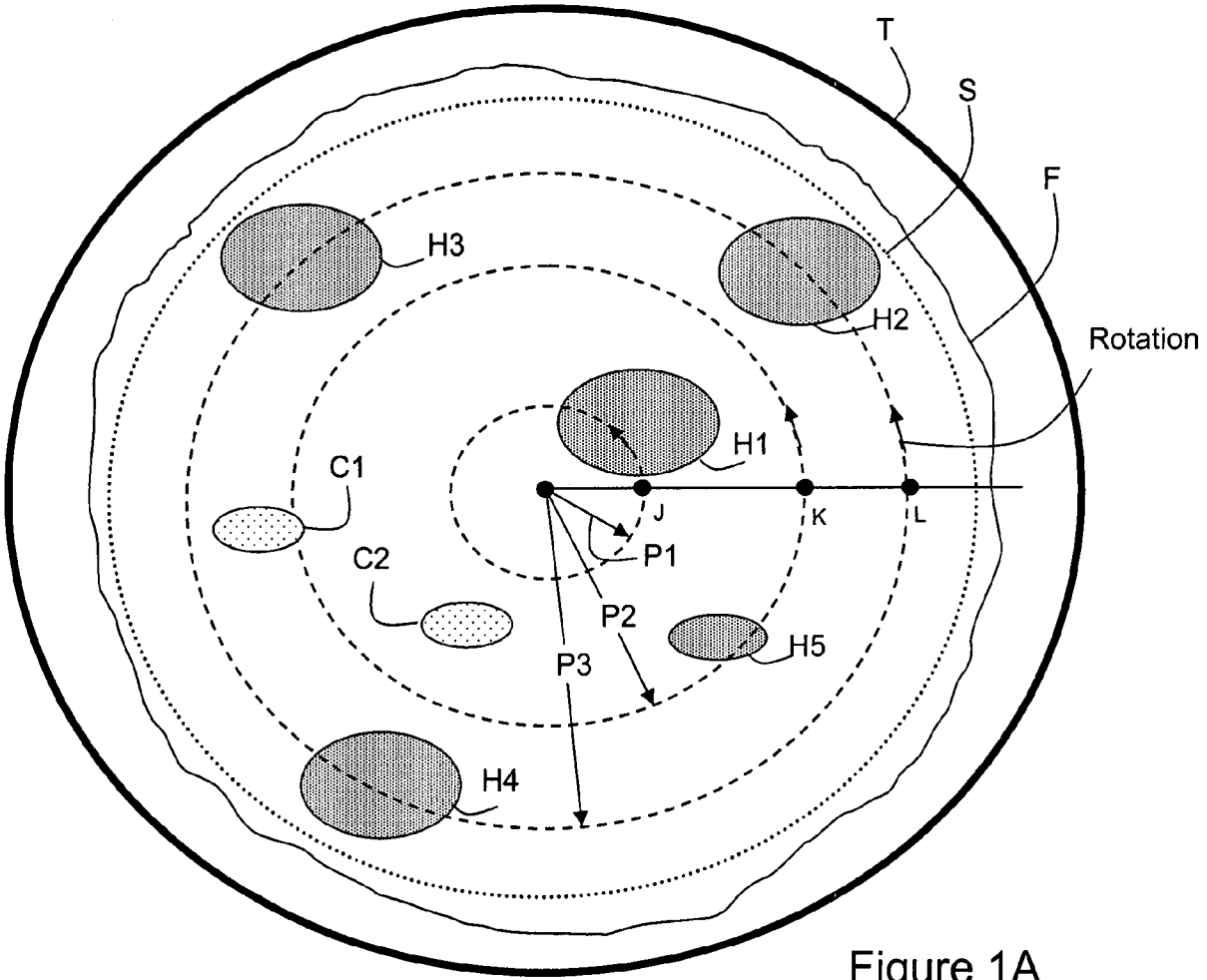
FIG. 1A is a plan view showing regions of differing electric field intensity within a microwave oven and showing the paths followed by three discrete points J, K, and L located at respective radial positions $P_1$, $P_2$ and $P_3$ on a turntable.

Throughout the following detailed description similar reference characters refers to similar elements in all figures of the drawings.

Figure 2:
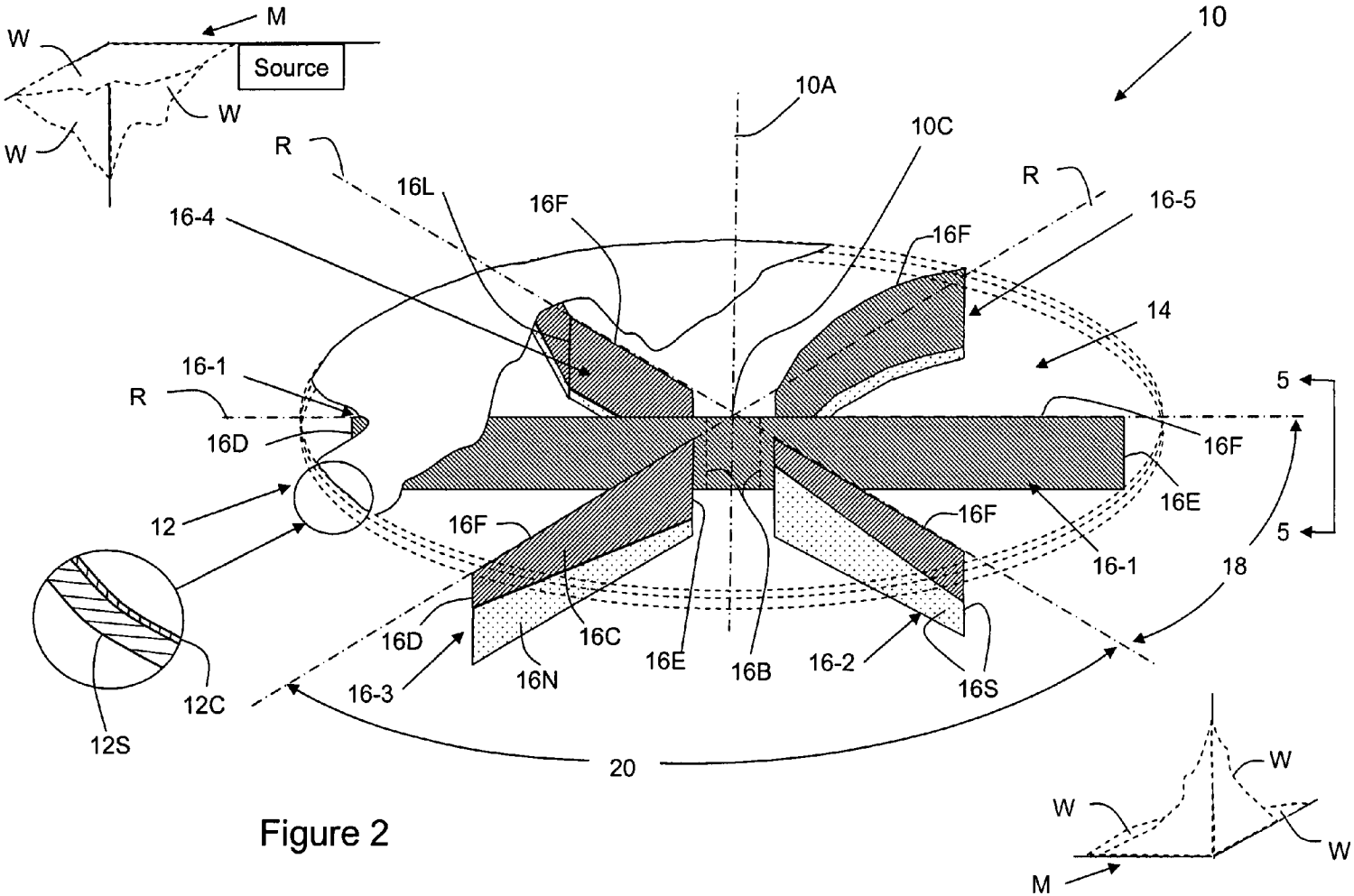
FIG. 2 is a pictorial view of a susceptor assembly with portions of the planar susceptor broken away for clarity and showing various edge shapes of the vanes of the field director structure with the conductive portions of the vanes directly abutting the planar susceptor.
Figure 3:
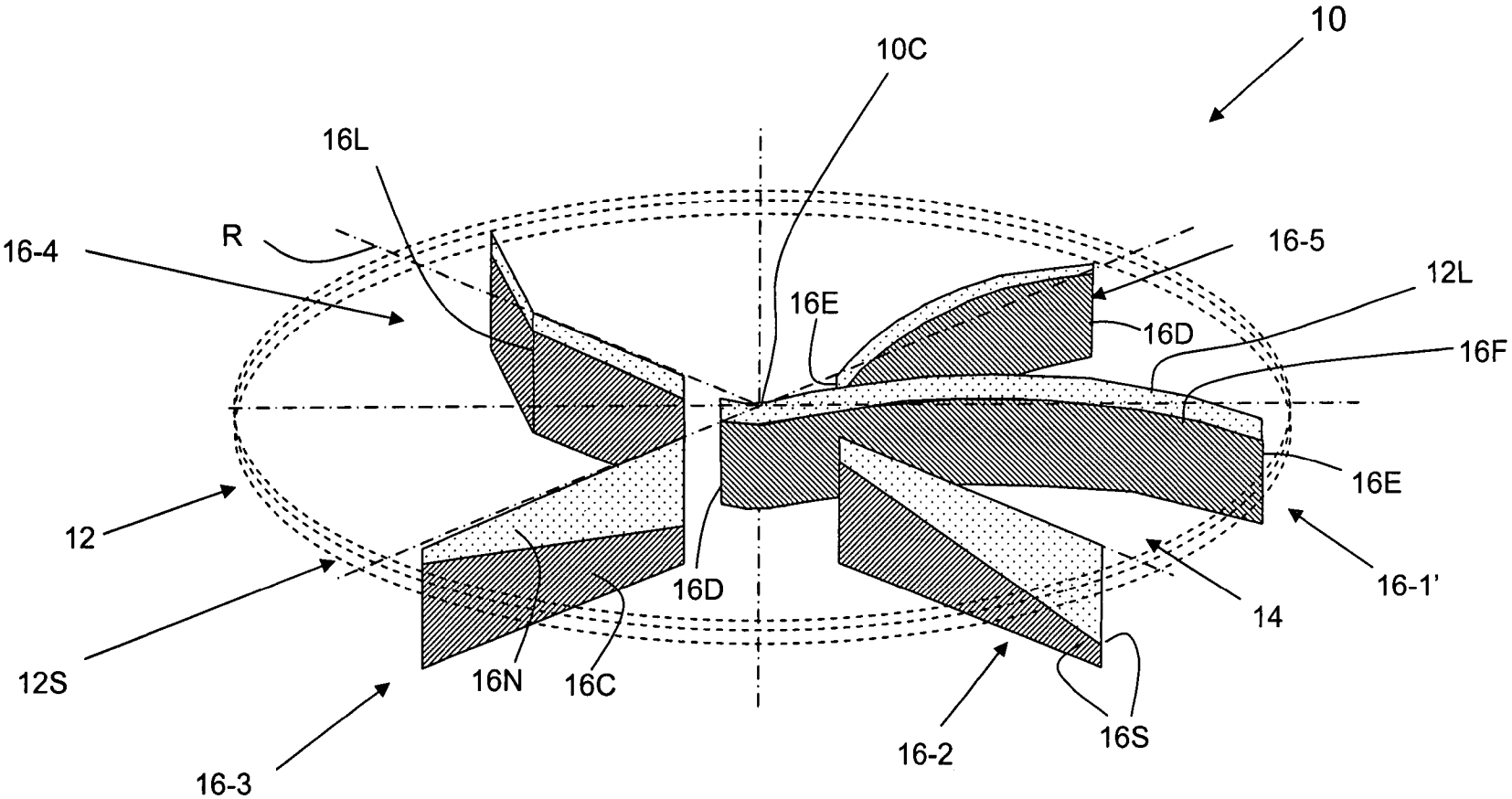
FIG. 3 is a pictorial view similar to FIG. 2 showing the vanes of the field director structure with the conductive portions of the vanes spaced from the planar susceptor.

With reference to FIGS. 2 and 3 shown is a stylized pictorial view of a susceptor assembly generally indicated by the reference numeral 10 in accordance with the present invention. The susceptor assembly 10 has a reference axis 10A extending through its geometric center 10C. The susceptor assembly 10 is, in use, disposed within the resonant cavity on the interior of a microwave oven M. The oven M is suggested only in outline form in the Figures. In operation, a source in the oven produces an electromagnetic wave having a predetermined wavelength. A typical microwave oven operates at a frequency of 2450 MHz, producing a wave having a wavelength on the order twelve centimeters (12 cm)(about 4.7 inches). The walls W of the microwave M impose boundary conditions that cause the distribution of electromagnetic field energy within the volume of the oven to vary. This generates a standing wave energy pattern within the volume of the oven.

The susceptor assembly 10 comprises a conventional, generally planar susceptor 12 having a field director structure generally indicated at reference numeral 14 connected thereto. As will be developed herein the field director structure 14 is useful for redirecting and relocating the regions of high and low electric field intensity of the standing wave pattern within the volume of the oven. When used in conjunction with a turntable the positions of the redirected and relocated regions change continuously, further improving the uniformity of warming, cooking or browning of a food product placed on a susceptor assembly 10 that includes the field director structure 16.

In the embodiment shown in FIGS. 2 and 3 the field director structure 14 is disposed under the planar susceptor 12, although it should be appreciated that these relative positions may be reversed. Whatever the respective relative positions of the field director structure 14 and the planar susceptor 12, a food product (not shown) being warmed, cooked or browned or other article is typically placed is contact with the planar susceptor 12.

The planar susceptor 12 shown in the figures is generally circular in outline although it may exhibit any predetermined desired form consistent with the food product to be warmed, cooked or browned within the oven M. As shown in the circled detail portion of FIG. 2 the planar susceptor 12 comprises a substrate 12S having an electrically lossy layer 12C thereon. The layer 12C is typically a thin coating of vacuum deposited aluminum.

The substrate 12S may be made from any of a variety of materials conventionally used for this purpose, such as cardboard, paperboard, fiber glass or a polymeric material such as polyethylene terephlate, heat stabilized polyethylene terephlate, polyethylene ester ketone, polyethylene naphthalate, cellophane, polyimides, polyetherimides, polyesterimides, polyarylates, polyamides, polyolefins, polyaramids or polycyclohexylenedimethylene terephthalate. The substrate 12S may be omitted if the electrically lossy layer 12C is self-supporting.

Figure 4A:
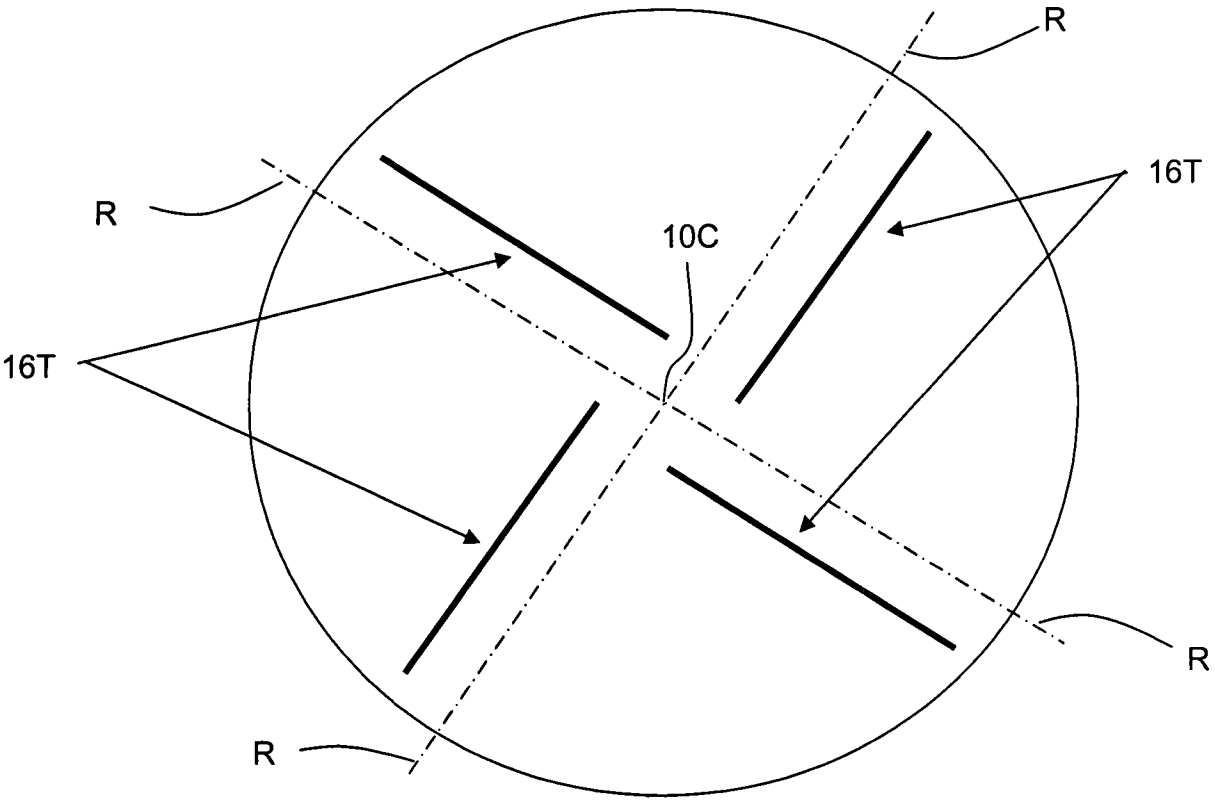
FIGS. 4A through 4C are plan views respectively illustrating generally straight-edged, bent-edged and curved-edged of vanes extending generally transversely across the planar susceptor in directions offset from a generally radial line of the susceptor assembly.

The field director structure 14 includes one or more vanes 16. In the embodiment illustrated in FIGS. 2 and 3, five vanes 16-1 through 16-5 are shown. FIGS. 4A though 4F illustrate susceptor assemblies 10 wherein the field director structure 14 has a number N of vanes 16 ranging from two to six. In general, any convenient number of vanes 1, 2, 3 . . . N may be used, depending upon the size of the planar susceptor, and the edge length, configuration, orientation and disposition of the vanes.

For purposes of illustration the vanes shown in FIGS. 2 and 3 exhibit a variety of edge contours, as will be discussed.

The front and back of each vane define a surface area 16S. In FIGS. 2 and 3 the surface area 16S of each vane 16 is illustrated as generally rectangular, although it should be appreciated that a vane's surface area may be conveniently configured as any plane figure, such as a triangle, a parallelogram or a trapezoid. If desired, the surface area 16S of a vane may be curved in one or more directions.

At least a portion of the surface of the front and/or the back of each of the vane(s) 16 is electrically conductive. Any region of drawing FIGS. 2 and 3 having hatched shading indicates an electrically conductive portion 16C of a vane 16. An electrically non-conductive portion 16N of a vane 16 is indicated by the stipled shading.

Each vane has an edge 16F extending between a first end 16D and a second end 16E. The edge 16F of a vane may exhibit any of a variety of contours. For example, the edge 16F of a vane may be straight, as illustrated by the vanes 16-1 to 16-3. Alternatively, the edge 16F of a vane may be bent or folded along one or more bend or fold line(s) 16L as suggested by the vane 16-4. Moreover, the contour of the edge 16F of a vane may be curved, as suggested by the vanes 16-5 (FIGS. 2 and 3) and the vane 16-1' (FIG. 3).

A vane may have its first end 16D and its second end 16E disposed at any predetermined respective points of origin and termination on the planar susceptor 12. The distance along the edge 16F of a vane between its first end 16D and its second end 16E defines the edge length of the vane. The vanes in the field director structure 14 may have any desired edge length, subject to the proviso regarding the length of the conductive portion 16C mentioned below.

The vanes 16 may be integrally constructed from an electrically conductive foil or other material. In such a case the entire surface 16S of the vane is electrically conductive (e.g., as shown in FIG. 2 for the vane 16-1). The length and width of the conductive portion 16C thus correspond to the edge length and width of the vane.

Alternatively, a vane may be constructed as a layered structure formed from a dielectric substrate with an electrically conductive material laminated or coated over some or all of the front and/or back of its surface area. One form of construction could utilize a paperboard substrate to which an adhesive-backed electrically conductive foil tape is applied.

If provided over less than the full surface area of a vane the electrically conductive portion 16C may itself exhibit any convenient shape, e.g., trapezoidal (as shown for vanes 16-2 and 16-3) or rectangular (as shown for vanes 16-4 and 16-5 and vane 16-1' in FIG. 3). The width dimension of the electrically conductive portion 16C of the vane should be about 0.1 to about 0.5 times the wavelength generated in the oven. The conductive portion 16C of vane has a length that should be at least about a distance approximating about 0.25 times the wavelength of the electromagnetic energy generated in the oven. An edge length about twice the wavelength of the electromagnetic energy generated in the oven defines a practical upper limit.

Figure 19:
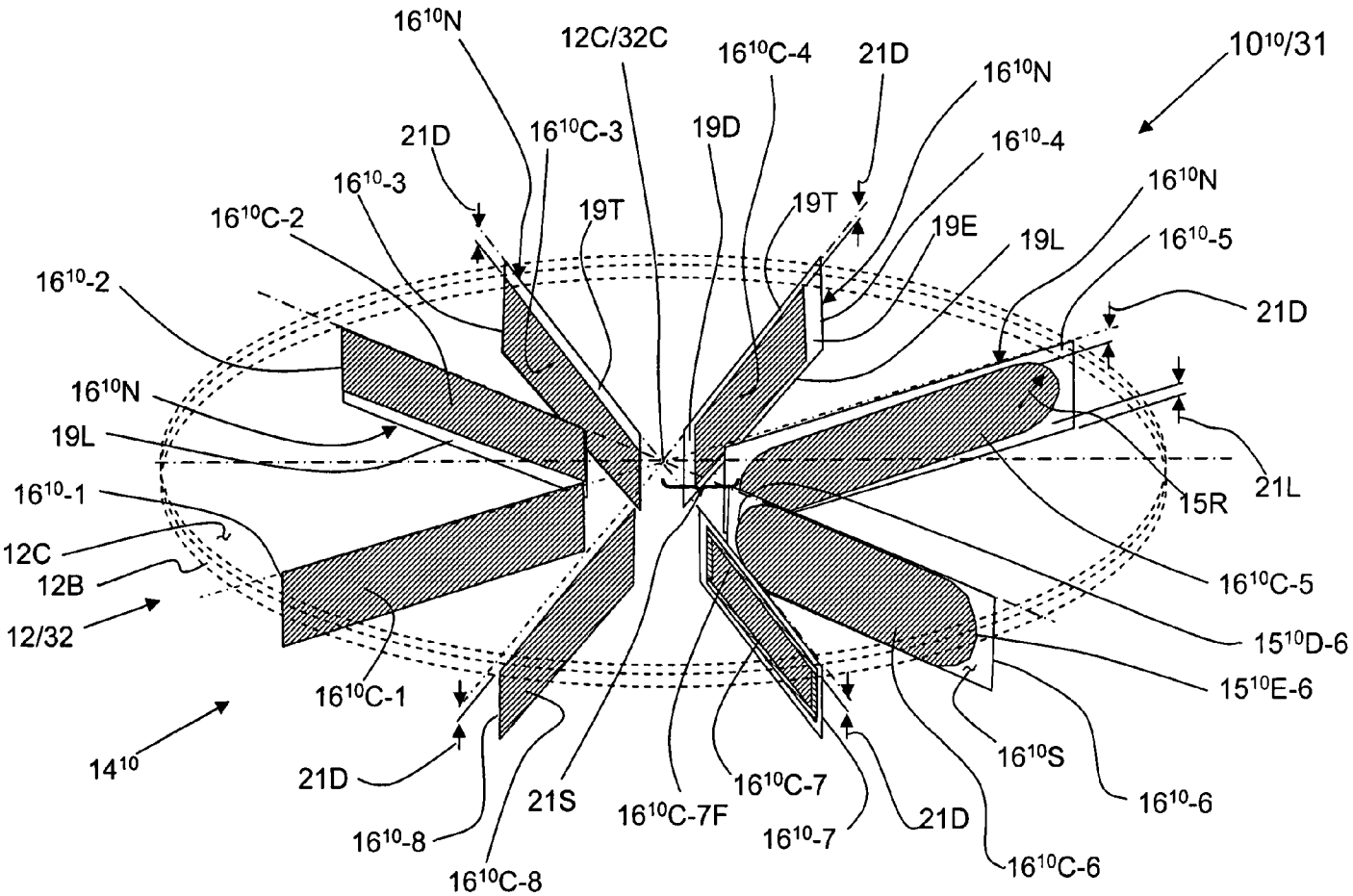
FIG. 19 is a pictorial view showing various vane configurations of the field director structure with conductive portions having different shapes and positions.

Whatever the shape of the conductive portion it may be desirable to radius or "round-off" corners to avoid arcing, as will be developed in connection with FIG. 19.

Selection of the shape and the length of the electrically conductive portion of the vane and the spacing of the conductor portion from the susceptor plane and other vanes permits the field attenuating effect of the vane to be more precisely tailored.

Wherever its points of origin and termination a vane may also be arranged to pass through the geometric center 10C. FIG. 2 shows the path of a straight-edged vane 16-1 extending through the geometric center 10C from a first end 16*d* originating adjacent the periphery of the susceptor. FIG. 3 shows the path of a curved-edged vane 16-1' extending through the geometric center 10C from a first end 16D originating in the vicinity of the geometric center 10C. All of the other vanes in FIGS. 2 and 3 have paths that originate at a point of origin in the vicinity of the geometric center 10C and extend outwardly therefrom.

The vanes 16 extend in a generally radial direction with respect to the geometric center 10C of the susceptor assembly 10. The vanes 16 may be angularly spaced about the center 10C at equal or unequal angles of separation. For example, the angle 18 between the vanes 16-1 and 16-2 may be smaller than the angle 20 between the vanes 16-2 and 16-3.

Figure 4B:
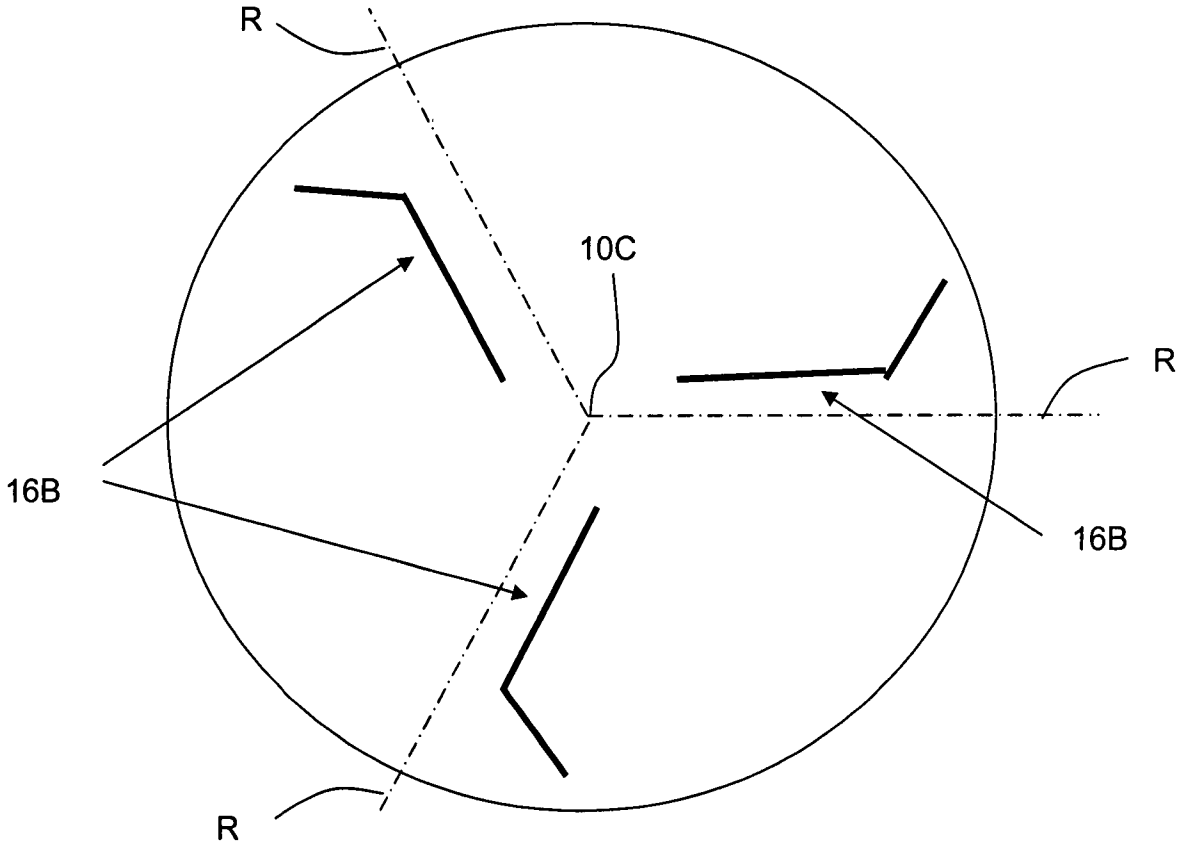
Figure 4C:
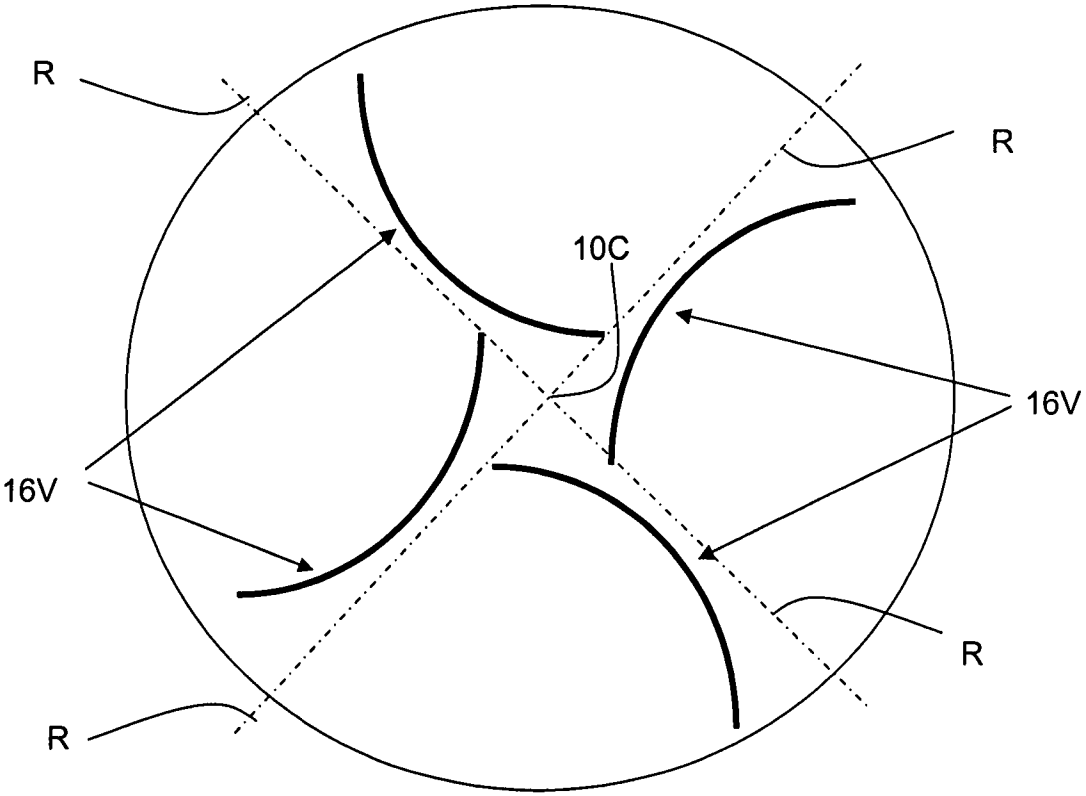
Figure 4D:
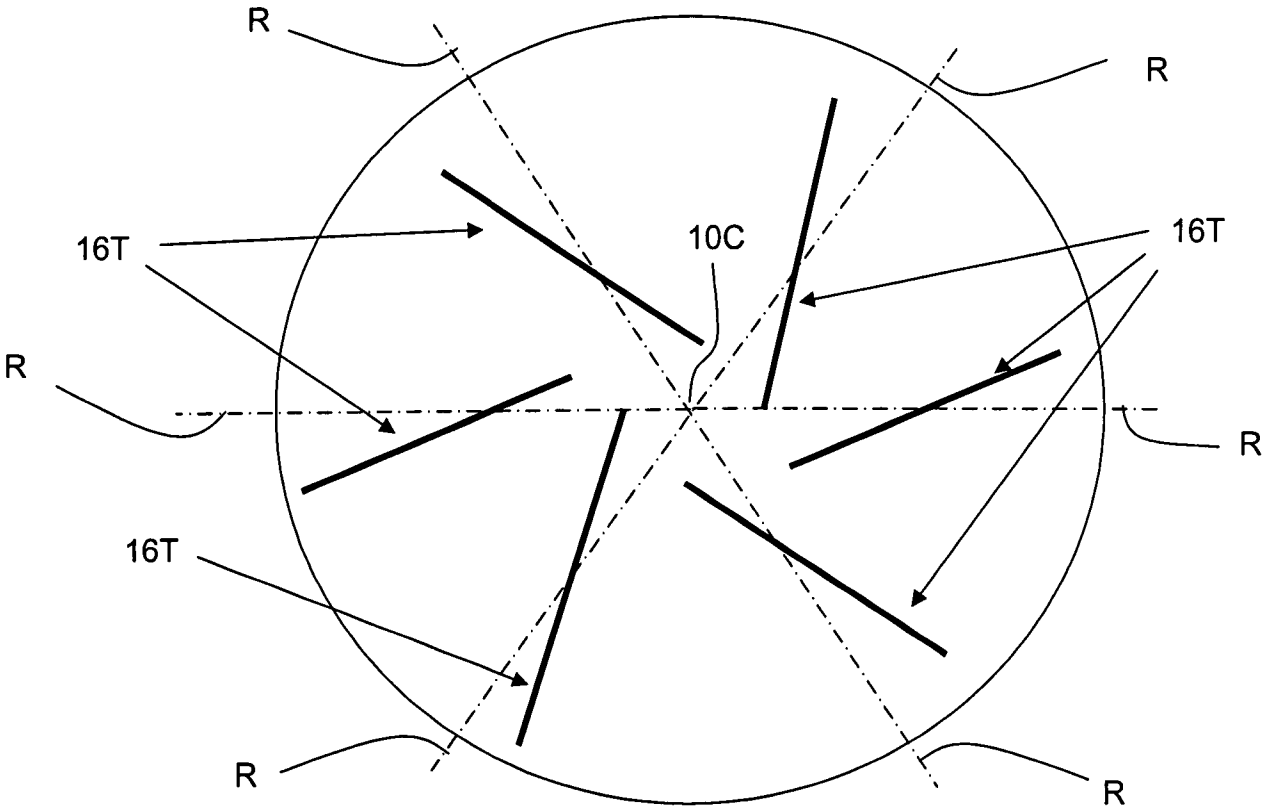
FIGS. 4D through 4F are plan views respectively illustrating generally straight-edged, bent-edged and curved-edged of vanes extending generally transversely across the planar susceptor in a direction that intersects a generally radial line of the susceptor assembly.
Figure 4E:
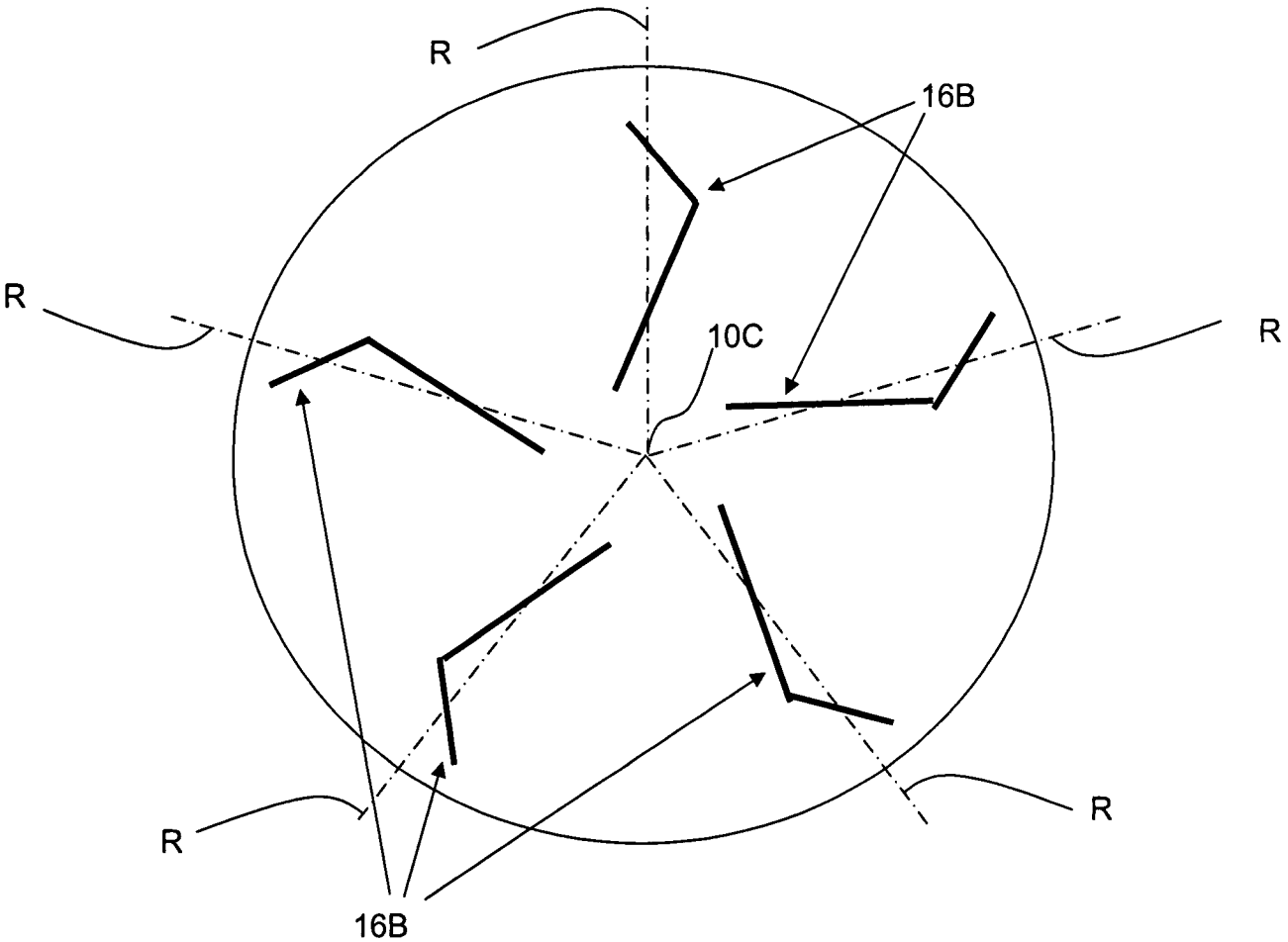
Figure 4F:
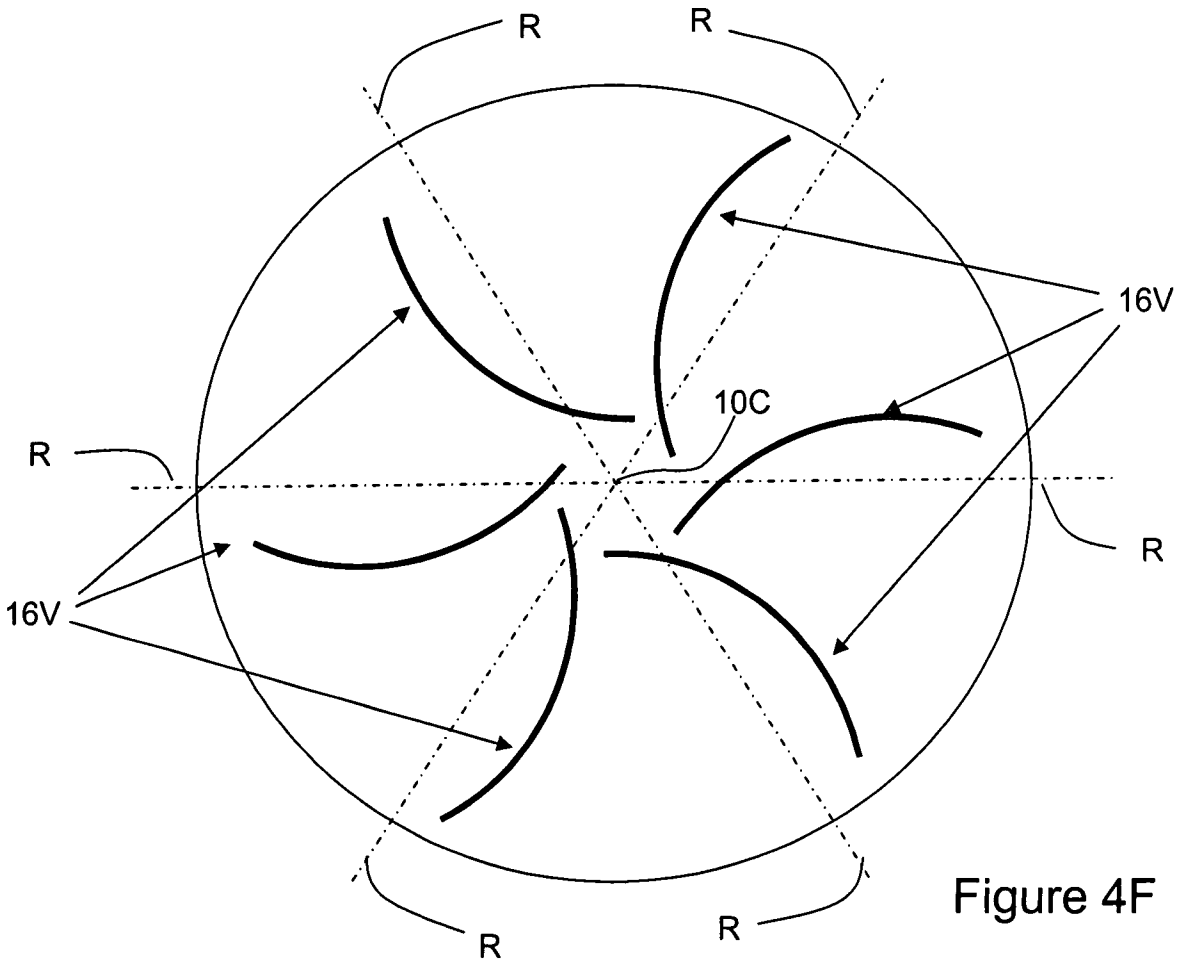

It should be appreciated that the term "generally radial" (or similar terms) does not require that each vane must lie exactly on a radius emanating from the center 10C. For example, vanes may be either offset or inclined with respect to the radius. FIGS. 4A through 4C respectively illustrate straight-edged vanes 16T, bent-edged vanes 16B and curved-edged vanes 16V that are offset with respect to radial lines R emanating from the geometric center 10C. Similarly, FIGS. 4D through 4F respectively illustrate straight-edged vanes 16T, bent-edged vanes 16B and curved-edged vanes 16R that are inclined with respect to radial lines R emanating from the geometric center 10C. Other dispositions of the vanes may be used to achieve the transverse orientation of the vanes 16 with respect to planar susceptor 12.

Each vane 16 is physically (i.e., mechanically) connected to the planar susceptor 12 at one or more connection points. A connection between a vane 16 and the planar susceptor 12 may be a fixed connection or a flexible articulating connection.

Figure 5A:
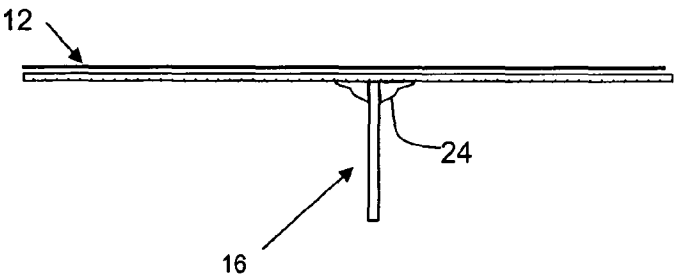
FIGS. 5A and 5B are elevation views taken along view lines 5-5 in FIG. 2 respectively illustrating a vane of the field director having a fixed connection to a planar susceptor and a flexible articulating connection, with the vane in the latter case shown in stored and deployed positions.

A fixed connection is shown in FIG. 5A. In a fixed connection a vane 16 is attached by a suitable adhesive 24 in a predetermined fixed orientation with respect to the planar susceptor 12. The orientation of the vane 16 is preferably at an angle of inclination in the range between about forty-five degrees (45°) and about ninety degrees (90°) degrees with respect to the planar susceptor, although smaller angular orientations may provide a useful effect. In the most preferred instance the vane 16 is substantially orthogonal to the planar susceptor 12.

Figure 5B:
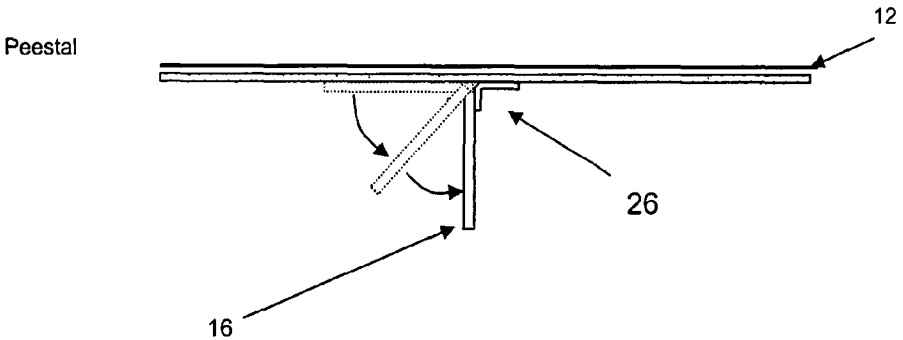

A flexible articulating connection is shown in FIG. 5B. In this arrangement a vane 16 is attached to the planar susceptor 12 by a hinge 26. The hinge may be made from a flexible tape. In an articulating connection the vane 16 is movable from a stored position (shown in dashed lines in FIG. 5B) in which the plane of the vane is substantially parallel to the planar susceptor to a deployed position (shown in solid outline lines in FIG. 5B). The hinge may be provided with a suitable stop so that, in the deployed position, the vane is held at a desired angle of inclination, preferably in the range between about forty-five degrees (45°) and about ninety degrees (90°) degrees with respect to the planar susceptor, and most preferably substantially orthogonal to the planar susceptor 12.

Whatever the form of construction, configuration of the vane's surface area, shape of the conductive portion, edge contour of the vane, edge length of the vane, length of the conductive portion on the vane, path of the vane with respect to the center of the susceptor, and the orientation of the vane with respect to plane of the susceptor, the electrically conductive portion 16C of the vane 16 must be disposed no farther than a predetermined close distance from the electrically lossy layer 12C of the planar susceptor 12. In general the predetermined close distance should be no greater than a distance approximating 0.25 times the wavelength of the electromagnetic energy generated in the oven. It should be understood that so long as a food product or other article is present the predetermined close distance can be zero, meaning that the conductive portion 16C of the vane abuts electrically against the lossy layer 12C of the planar susceptor.

In a typical implementation, shown in FIG. 2, the lossy layer 12C is supported on a dielectric substrate 12S, so that the edge of the conductive portion 16C of the vane is spaced from the lossy layer 12C by only the thickness of the substrate 12S. The vertical dimension of the non-conductive portions 16N may be used to control the height at which the planar susceptor 12 is supported within the oven M.

Alternatively, as seen from FIG. 3 the non-conductive portions 12N of the vanes may be disposed adjacent to the planar susceptor 12. This disposition has the effect of spacing the conductive portions 16C of the vanes away from the lossy layer 12C at distances greater than the thickness of the substrate 12S. If desired, additional non-conductive portions 16N may be disposed along the opposite edge of the vanes to obtain the height control benefits discussed above.

The planar susceptor 12 and a surface area 16S of a vane 16 intersect along a line of intersection 12L extending in a generally transverse direction with respect to the planar susceptor 12. When intersected with the planar susceptor 12, a straight-edged vane 16 will produce a straight line of intersection 12L. A vane 16 having a bent edge or curved edge, when intersected with the planar susceptor 12, will produce a bent or curved line of intersection 12L, respectively. The magnitude of the bend angle or the shape of curvature of the line of intersection, as the case may be, will depend upon the angle of inclination of the vane to the planar susceptor. Whether the line of intersection is a straight line, a bent line or a curved line, the extension of the conductive surface of the vane will lie along the line of intersection.

Having described the various structural details of a susceptor assembly 10 in accordance with the present invention, its effect on a standing electromagnetic wave may now be discussed.

Figure 6:
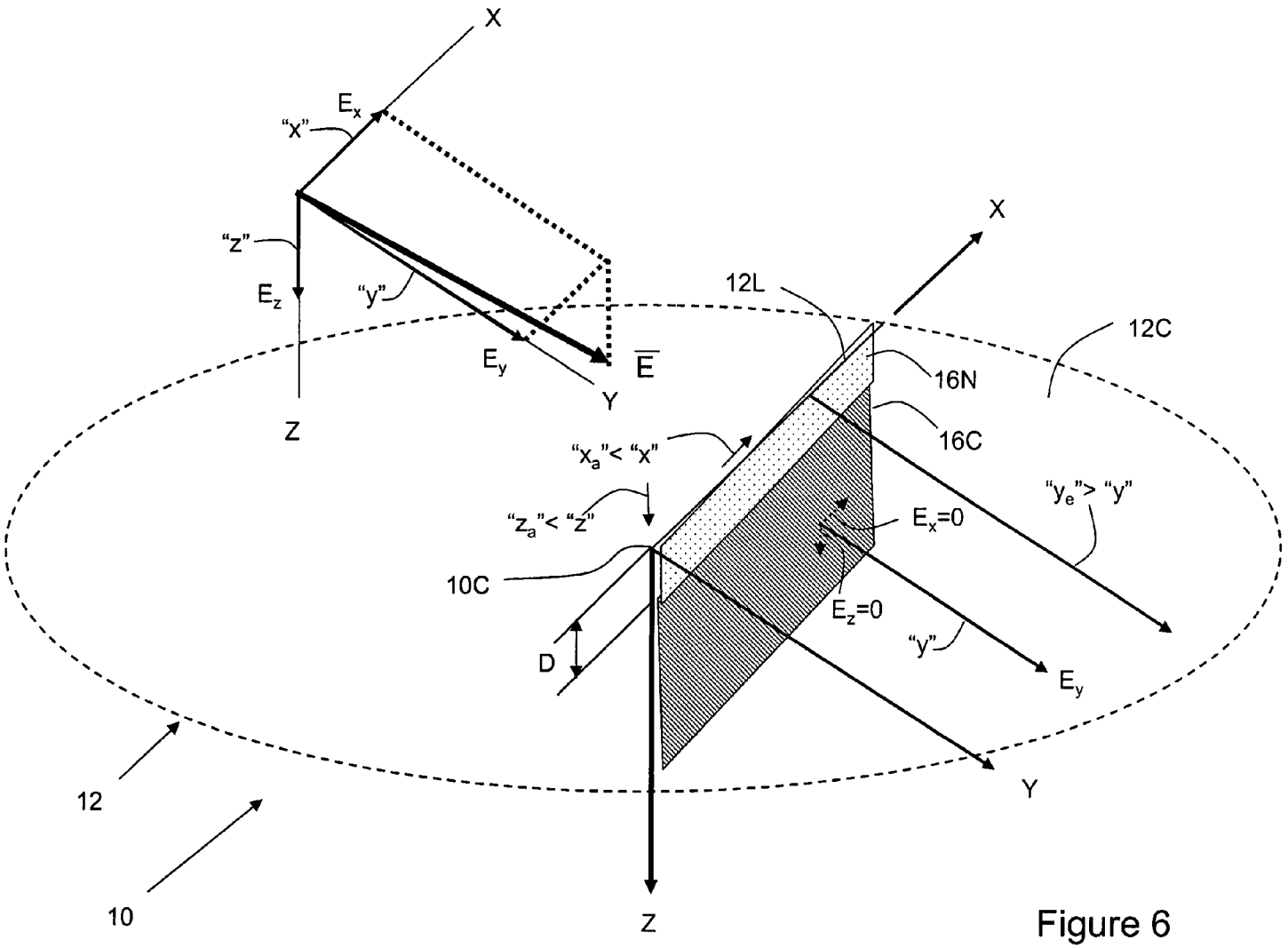
FIG. 6 is a pictorial view illustrating the attenuating effect of a single transverse electrically conductive vane on the constituent field vectors of the electric field component in the plane of the planar susceptor.

FIG. 6 is a schematic diagram representation in which an embodiment of a susceptor assembly 10 having a single straight-edged vane 16 is connected in a substantially orthogonal orientation with respect to the undersurface of a planar susceptor 12. A set of Cartesian axes is positioned to originate at the geometric center 10C of the assembly 10. The assembly 10 is arranged so that the planar susceptor 12 lies in the X-Y Cartesian plane and that the conductive portion 16C of the surface 16S of the vane 16 lies in the X-Z Cartesian plane. The line of intersection 12L defined along the connection between the vane 16 and the planar susceptor 12 extends transversely across the lossy layer 12C of the planar susceptor 12 and is oriented along the X axis, as illustrated. The conductive portion 16C of the surface 16S of the vane 16 lies a predetermined distance D in the Z direction from the lossy layer on the planar susceptor 12. The conductive portion 16C of the surface 16S has a thickness (i.e., it's Y dimension) greater than the depth of the skin effect of a conductor at the frequency of microwave operation.

An electromagnetic wave is composed of mutually orthogonal oscillating magnetic and electric fields. At any given instant a standing electromagnetic wave includes an electric field constituent $\overline{E}$. At any instant the electric field constituent $\overline{E}$ is oriented in a given direction in the Cartesian space and may have any given value.

The electric field $\overline{E}$ is itself resolvable into three component vectors, viz., $\overline{E}_x$, $\overline{E}_y$, $\overline{E}_z$. Each component vector is oriented along its respective corresponding coordinate axis. Depending upon the value of the electric field E each component vector has a predetermined value of "x", "y" or "z" units, as the case may be.

One corollary of Faraday's Law of Electromagnetism is the boundary condition that the tangential electric field at the interface surface between two media must be continuous across that surface. A particular example of such a media interface is that between a perfect conductor and air. By definition, a perfect conductor must have a zero electric field within it. Therefore, in particular, the tangential component of the electric field just inside the conductor surface must be zero. Hence, from the above asserted boundary continuity condition, the tangential electric field in the air just outside the conductor must also be zero. So we have the general rule that the tangential component of the electric field at the surface of a perfect conductor is always zero. If the conductor is good, but not perfect, then the tangential component of the electric field at the surface may be nonzero, but it remains very small. Thus, any electric field existing just outside the surface of a good conductor must be substantially normal to that surface.

The application of this physical law mandates that within that surface area of the vane 16 having the conductive portion 16C only the component vector of the electric field that is oriented perpendicular to that surface, viz., the vector $\overline{E}_y$, is permitted to exist. The component vectors of the electric field lying in any plane tangent to the surface of the vane, (viz., the vector $\overline{E}_x$ and the vector $\overline{E}_z$) are not permitted. In FIG. 6, the tangent plane is the plane of the conductive portion of the surface of the vane.

If the conductive portion 16C of the vane 16 were in electrical is contact with the lossy layer 12C the value of the component vector $\overline{E}_x$ lying along the line of intersection 12L and the value of the component vector $\overline{E}_z$ would be zero, for the reasons just discussed. However, the conductive portion 16C is not in electrical contact with the lossy layer 12C, but is instead spaced therefrom by the distance D. The conductive portion of the surface of the vane nevertheless exerts an attenuating effect having its most pronounced action in the extension of the conductive portion of the surface of the vane.

Thus, the component vectors $\overline{E}_x$ and $\overline{E}_z$ of the electric field of the wave have only attenuated intensities "$x_a$" and "$z_a$". The intensity values "$x_a$" and "$z_a$" are each some intensity value less than "x" and "z", respectively. Attenuation of the electric field component of the electromagnetic wave in the plane tangent to the surface of the vane results in enhancement of the component of the electric field oriented perpendicular to the conductive portion of the surface of the vane. Thus, the component vector $\overline{E}_y$ has an enhanced intensity value "$y_e$" greater than the intensity value than "y".

The degree of attenuation of the vector component $\overline{E}_x$ is dependent upon the magnitude of the distance D and the orientation of the conductive portion 16C relative to the lossy layer 12C. The attenuation effect is most pronounced when the distance D is less than one-quarter (0.25) wavelength, for a typical microwave oven a distance of about three centimeters (3 cm). At an angle of inclination less than ninety degrees the permitted field (i.e., the field normal to the conductive surface of the vane) will itself have components acting in the susceptor plane.

This effect is utilized by the susceptor assembly 10 of the present invention to redirect and relocate the regions of relatively high electric field intensity within a microwave oven.

Figure 7A:
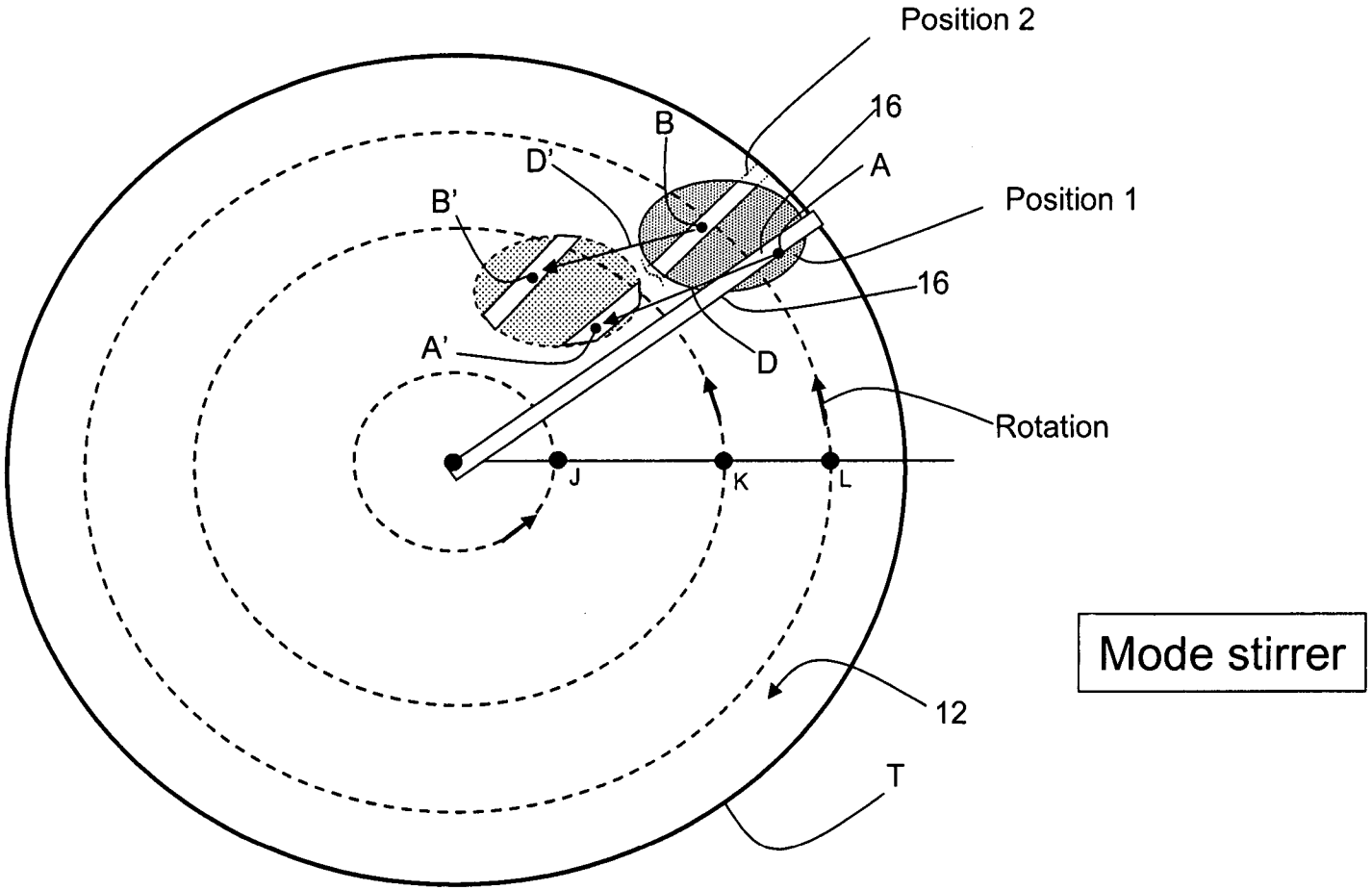
FIG. 7A is a plan view, generally similar to FIG. 1A, showing the effect of the field director structure of a susceptor assembly of the present invention upon regions of high electric field intensity and again showing the paths followed by three discrete points J, K, and L located at respective radial positions $P_1$, $P_2$ and $P_3$ on a turntable.

FIG. 7A is a stylized plan view, generally similar to FIG. 1A, illustrating the effect of a vane 16 as it is carried by a turntable T in the direction of rotation shown by the arrow. The vane is shown in outline is form and its thickness is exaggerated for clarity of explanation.

Consider the situation at Position 1, near where the vane first encounters the hot region $H_2$. For the reasons explained earlier only an electric field vector having an attenuated intensity is permitted to exist in the segment of the hot region $H_2$ overlaid by the vane 16. However, even though only an attenuated field is permitted to exist the energy content of the electric field cannot merely disappear. Instead, the attenuating action in the region extending from the conductive portion of the vane manifests itself by causing the electric field energy to relocate from its original location A on the planar susceptor 12 to a displaced location A'. This energy relocation is illustrated by the displacement arrow D.

As the rotational sweep carries the vane 16 to Position 2 a similar result obtains. The attenuating action of the vane again permits only an attenuated field to exist in the region extending from the conductive portion of the vane. The energy in the electric field energy originally located at location B on the planar susceptor 12 displaces to location B', as suggested by the displacement arrow D'.

Similar energy relocations and redirections occur as the vane 16 sweeps through all of the regions $H_1$ through $H_5$ (FIG. 1A) of relatively high electric field intensity.

The use of the present invention in a microwave oven having a mode stirrer apparatus will result in the same effect.

Figure 1B:
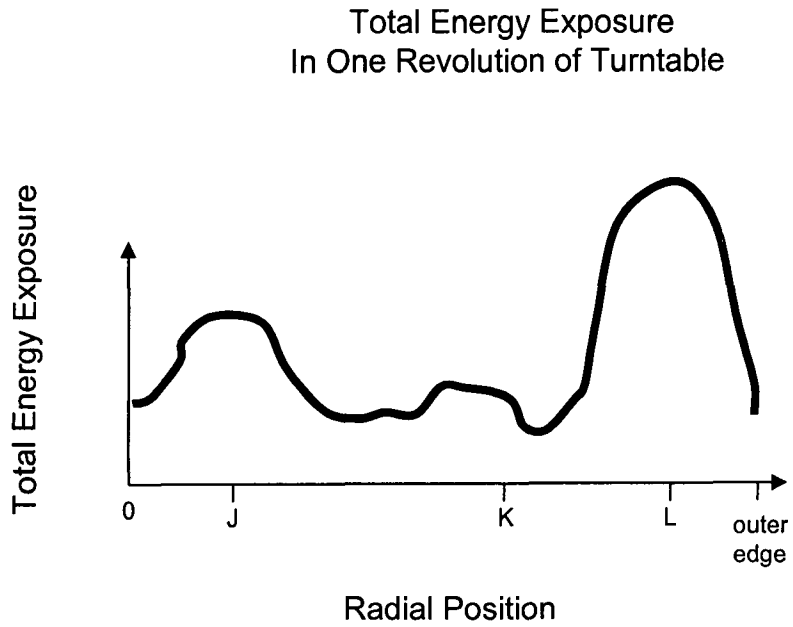
FIG. 1B is a plot showing total energy exposure for one full rotation of the turntable at each of the discrete points identified in FIG. 1A.
Figure 7B:
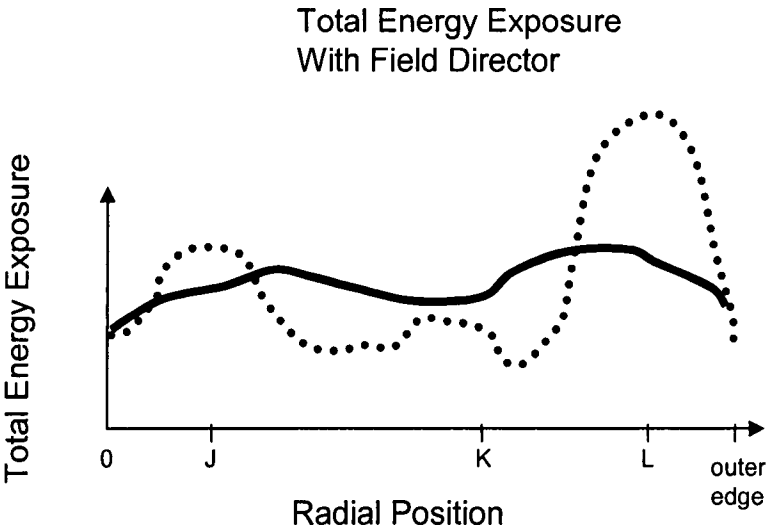
FIG. 7B is a plot, similar to FIG. 1B, showing total energy exposure for one full rotation of the turntable at each discrete point, with the waveform of FIG. 1B superimposed for ease of comparison.

FIG. 7B is a plot showing total energy exposure for one full rotation of the turntable at each discrete point J, K and L. The corresponding waveform of the plot of FIG. 1B is superimposed thereover.

It is clear from FIG. 7B that the presence of a susceptor assembly 10 having the field director 14 in accordance with the present invention results in a total energy exposure that is substantially uniform. As a result, warming, cooking and browning of a food product placed on the susceptor assembly 10 will be improved over the situation extant in the prior art.

FIGS. 8A and 8B, 9A and 9B and 10A and 10B illustrate preferred constructions of a susceptor assembly in accordance with the present invention.

Figure 8A:
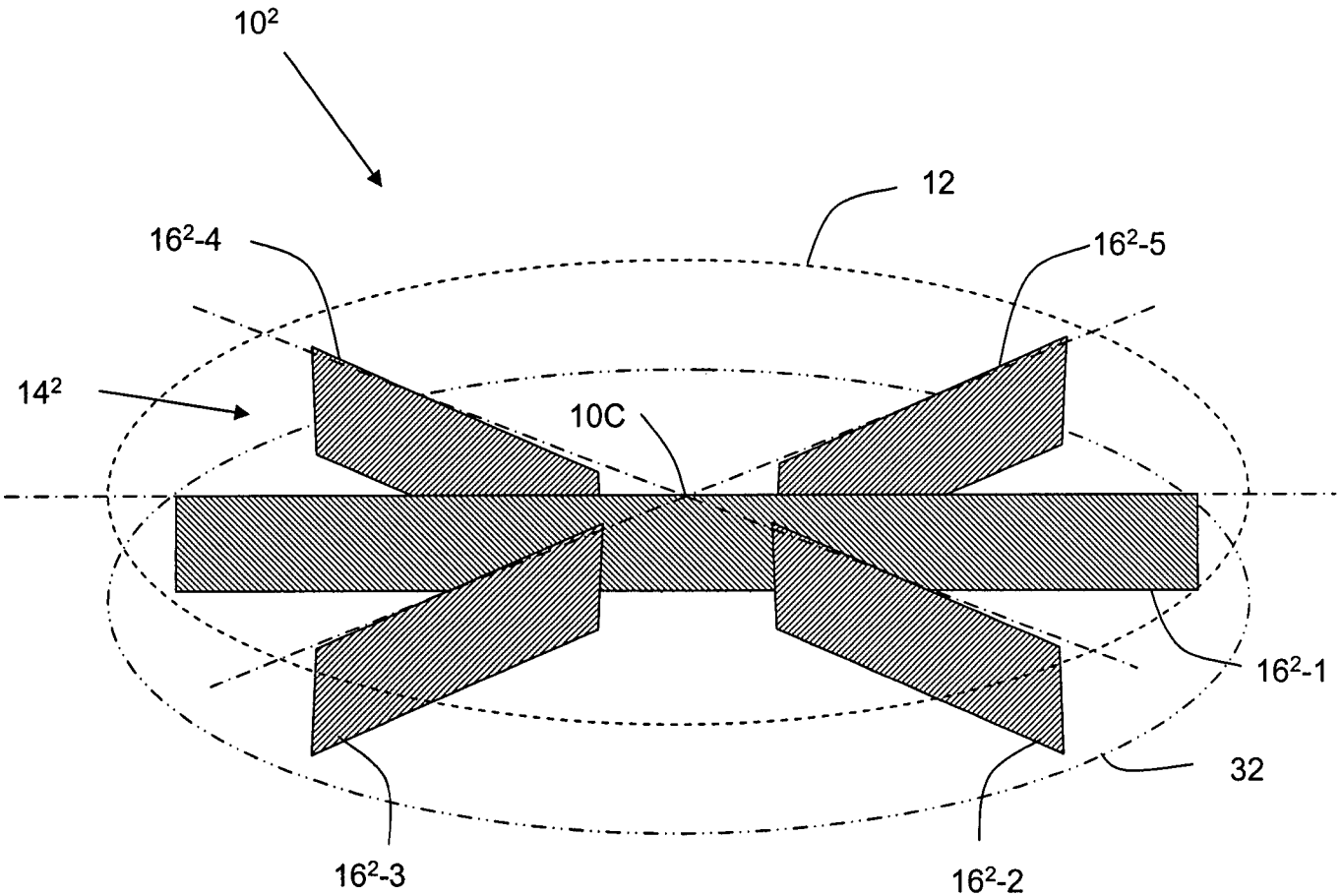
FIGS. 8A, 9A and 10A are pictorial views of various preferred implementations of a susceptor assembly in accordance with the invention, with portions of the planar susceptor broken away for clarity.
Figure 8B:
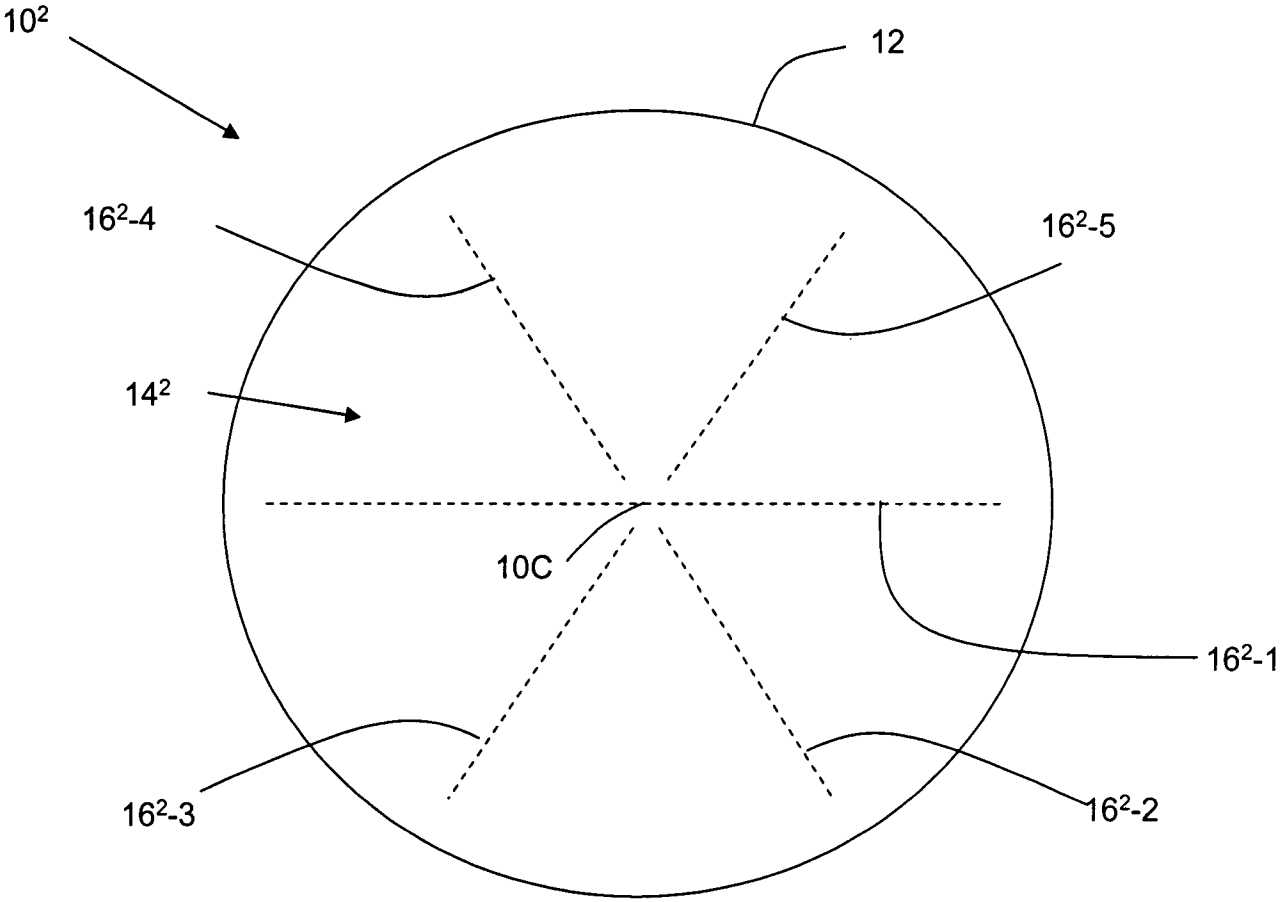
FIGS. 8B, 9B and 10B are plan views of the susceptor assembly shown in FIGS. 8A, 9A and 10A, respectively.

FIGS. 8A and 8B show a susceptor assembly 102 that includes a field director structure $\mathbf{14}^2$ having five straight-edged vanes $\mathbf{16}^2$-1 through $\mathbf{16}^2$-5. The five vanes $\mathbf{16}^2$-1 through $\mathbf{16}^2$-5 are attached to the underside of a planar susceptor 12. The vanes lie substantially orthogonal to the planar susceptor 12 and are equiangularly arranged about the center 10C. The vane $\mathbf{16}^2$-1 extends through the center 10C while the vanes $\mathbf{16}^2$-2 through 162-5 originate in the vicinity of the center 10C. The conductive portion $\mathbf{16}^2$C covers the entire surface of each vane. If desired the bottom edges of vanes of the field director $\mathbf{14}^2$ may be further supported on a non-conductive planar support member 32.

The support member may be connected to all or some of the vanes.

Figure 9A:
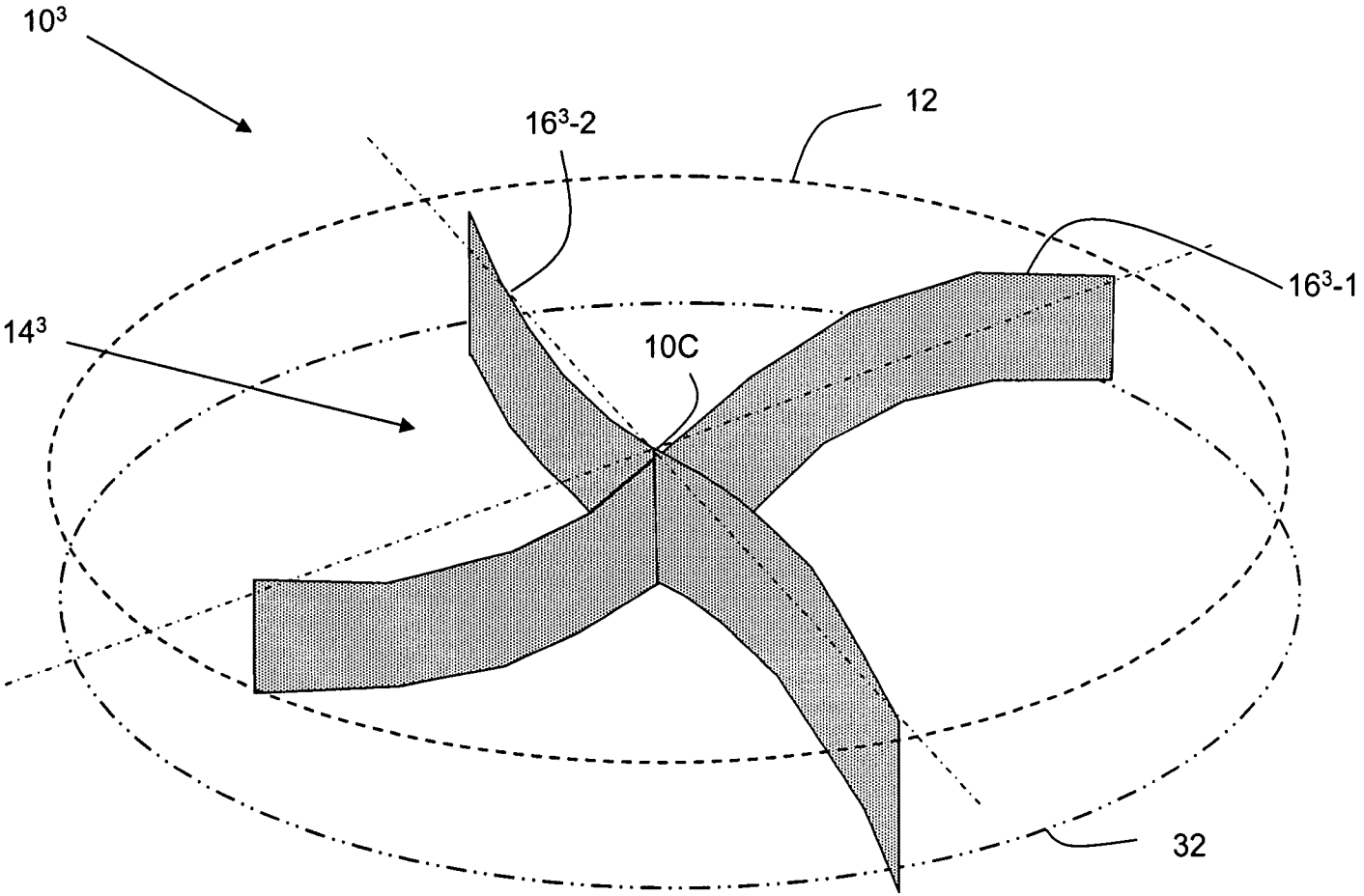
Figure 9B:
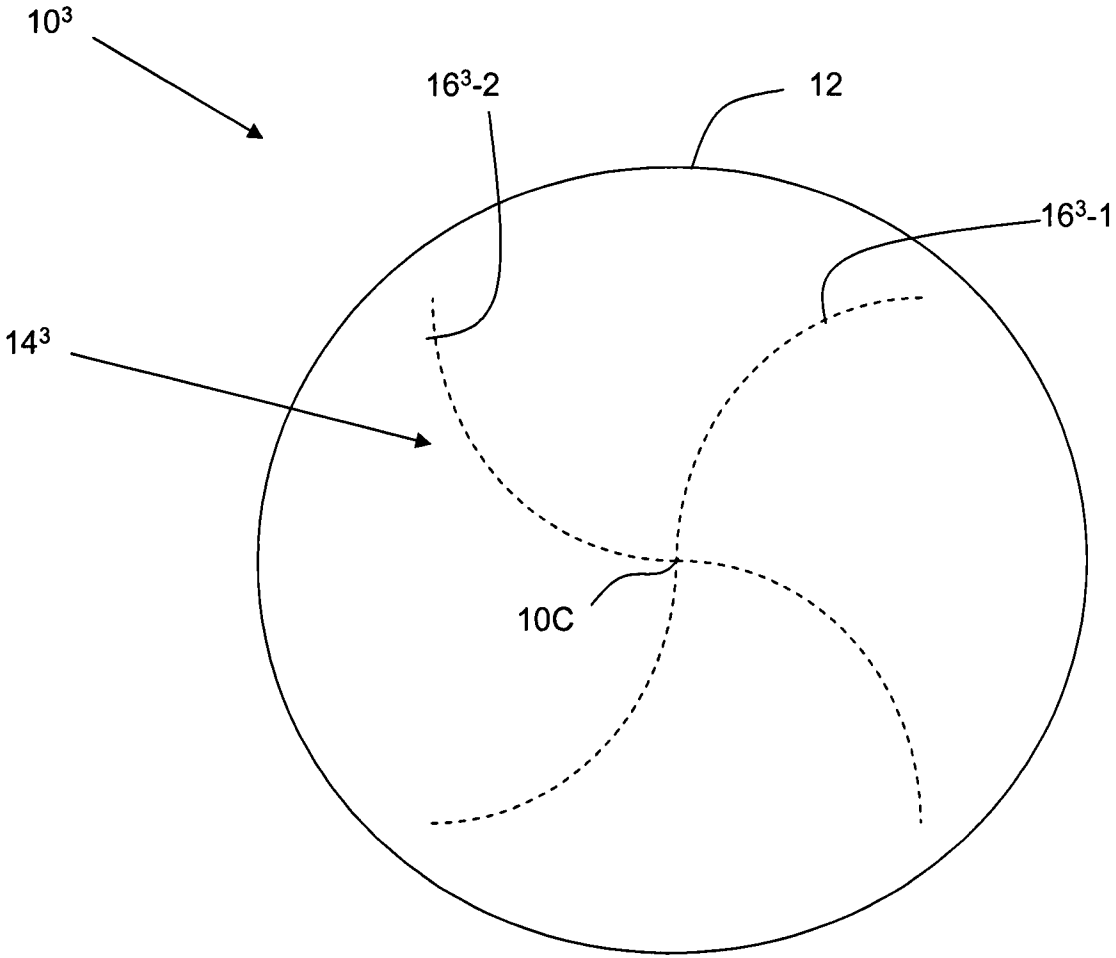

FIGS. 9A and 9B show a susceptor assembly 103 that includes a field director structure $\mathbf{14}^3$ having two curved-edged vanes $\mathbf{16}^3$-1 and $\mathbf{16}^3$-2. The two vanes $\mathbf{16}^3$-1 and $\mathbf{16}^3$-2 are attached to the underside of a planar susceptor 12. The vanes lie substantially orthogonal to the planar susceptor 12 and are equiangularly arranged about the center 10C. The vanes intersect each other in the vicinity of the center 10C. The conductive portion $\mathbf{16}^3$C covers the entire surface of each vane. Again, a non-conductive planar support member 32 may be further support the bottom edges of vanes of the field director $\mathbf{14}^3$, if desired.

Figure 10A:
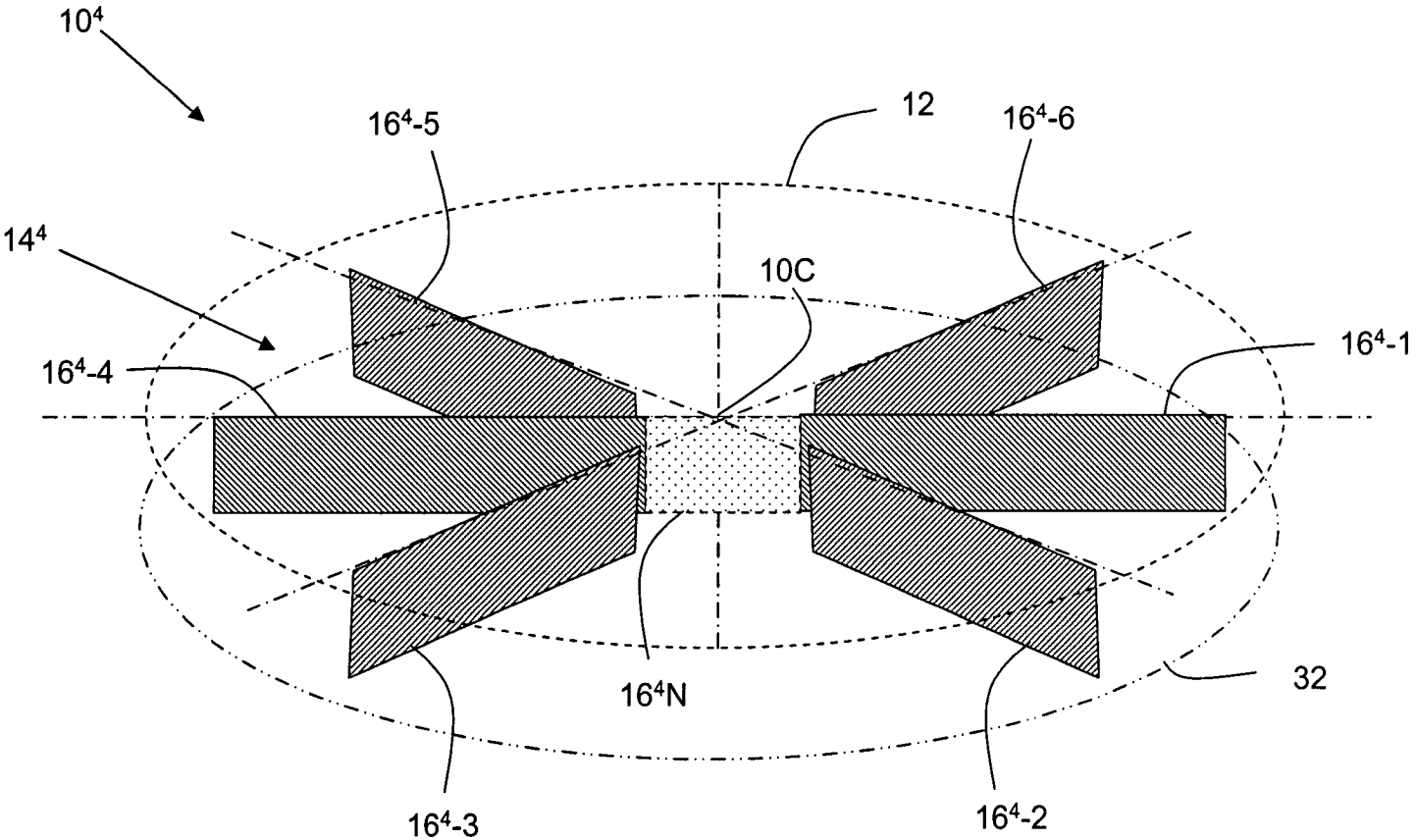
Figure 10B:
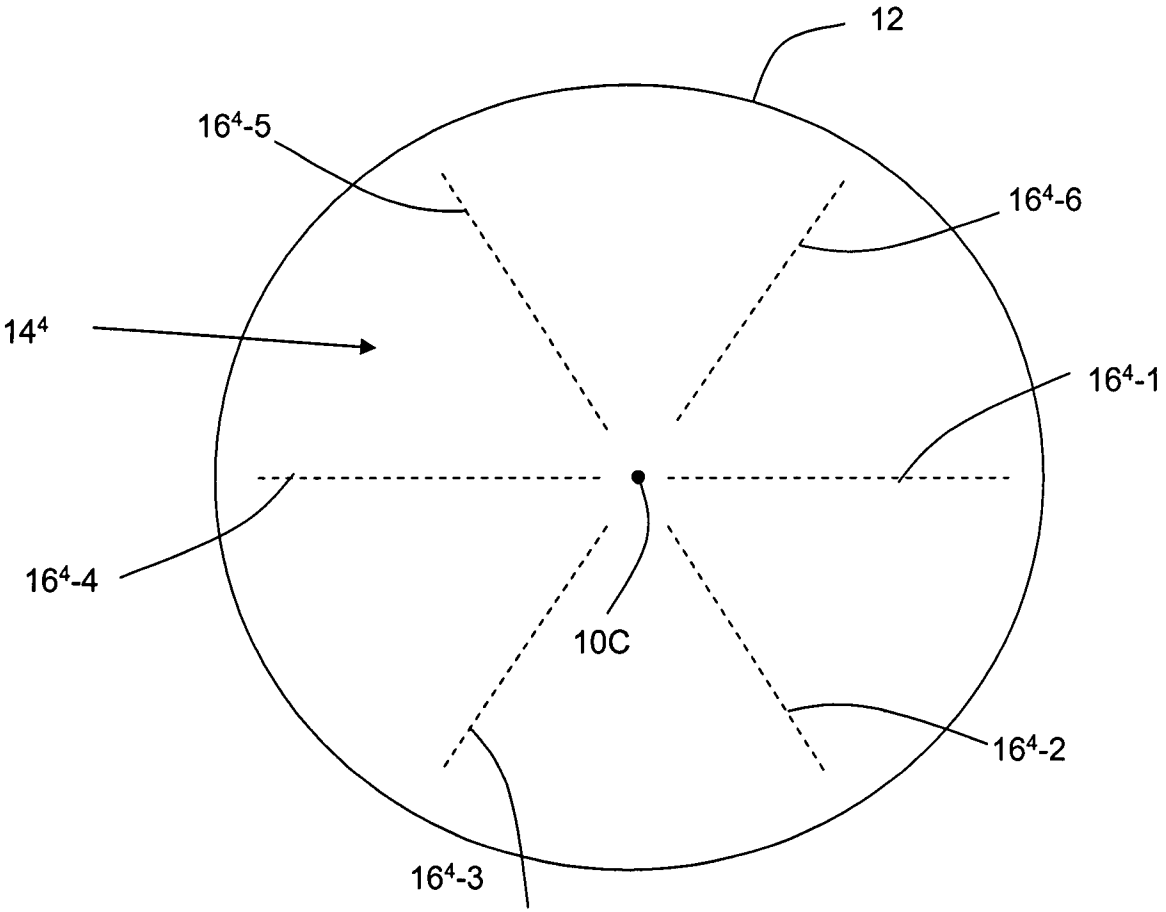

FIGS. 10A and 10B show a susceptor assembly $\mathbf{10}^4$ that includes a field director structure $\mathbf{14}^4$ having six straight-edged vanes $\mathbf{16}^4$-1 through $\mathbf{16}^4$-6. The six vanes $\mathbf{16}^4$-1 through $\mathbf{16}^4$-6 are attached to the underside of a planar susceptor 12. The vanes lie substantially orthogonal to the planar susceptor 12 and are equiangularly arranged about the center 10C. All of the vanes originate in the vicinity of the center 10C. The conductive portion $\mathbf{16}^4$C covers the entire surface of each vane. A non-conductive planar support member 32 may be used.

If desired, the vanes $\mathbf{16}^4$-1 and $\mathbf{16}^4$-4 may themselves be connected by a length of a non-conductive member $\mathbf{16}^4$N. The member $\mathbf{16}^4$N is shown in FIG. 10A in dashed outline with stipled shading.

In a second aspect, the invention is directed to various implementations of a collapsible self-supporting field director structure embodying the teachings of the present invention.

FIGS. 11, 12, 13A and 13B illustrate a field director structure formed from a single vane. In each implementation the vane has a zone of inflection whereby a planar vane may be formed into a self-supporting structure oriented in a predetermined orientation with respect to a predetermined reference plane RP disposed within the oven M. The plane RP may be conveniently defined as a plane in which the surface of a turntable or the surface of a food product or other article disposed within the oven.

Figure 11:
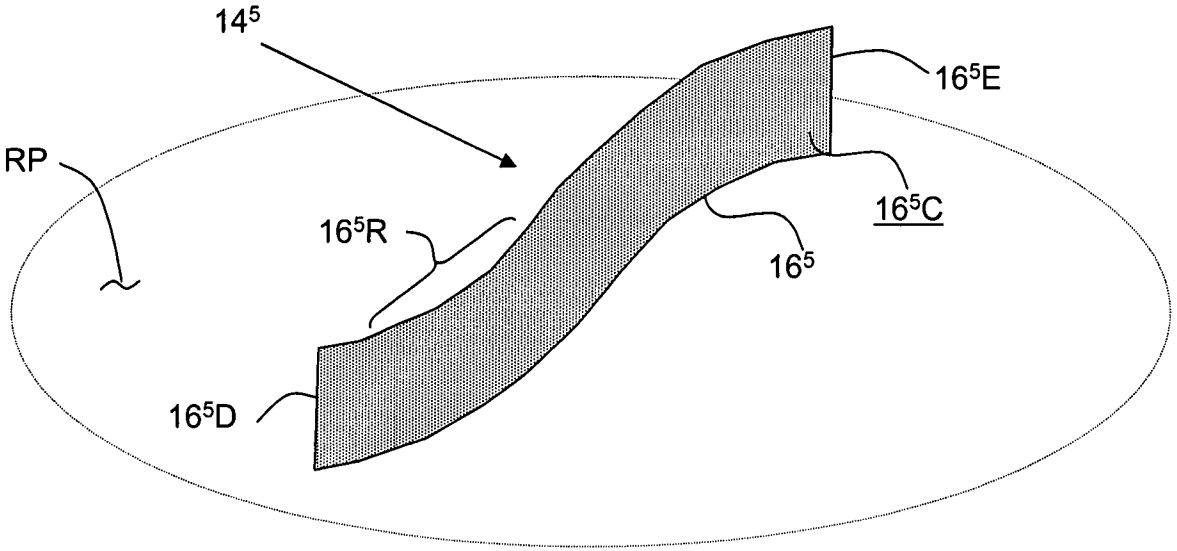
FIG. 11 is a pictorial view of a field director structure in accordance with the invention implemented using a single curved vane.

In FIG. 11 the field director structure $\mathbf{14}^5$ is implemented using a single curved vane $\mathbf{16}^5$. The vane $\mathbf{16}^5$ may be curved or may have least one region of flexure or curvature $\mathbf{16}^5$R defined between the first and second ends $\mathbf{16}^5$D and $\mathbf{16}^5$E. The conductive portion $\mathbf{16}^5$C covers the entire surface of the vane. In use, the vane $\mathbf{16}^5$ may be formed into a self-supporting structure arranged in a predetermined orientation with respect to a predetermined reference plane RP.

Figure 12:
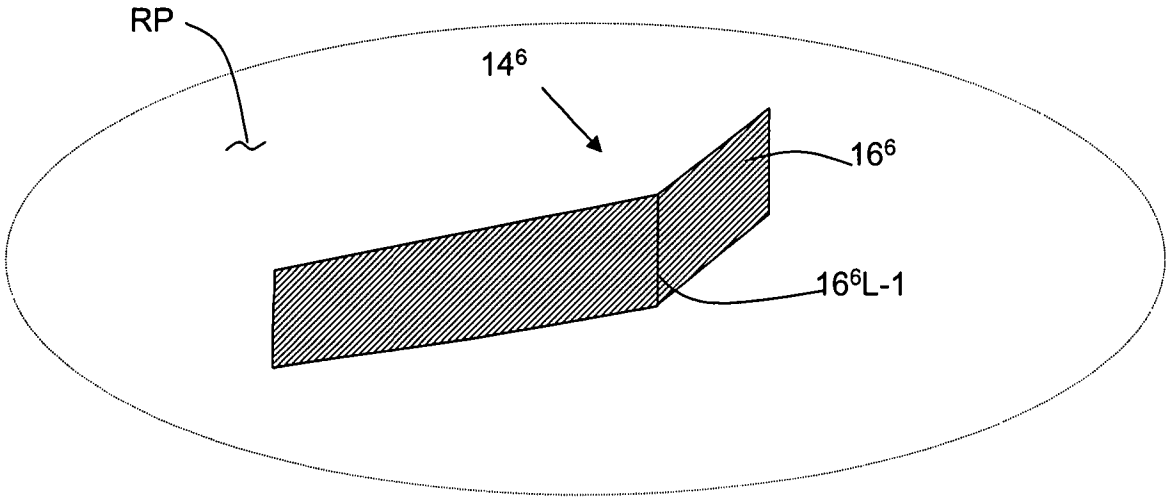
FIG. 12 is a pictorial view of a field director structure in accordance with the invention implemented using a planar vane with a single bend line therein.

In the field director structure $\mathbf{14}^6$ shown in FIG. 12 the vane $\mathbf{16}^6$ has a single fold or bend line $\mathbf{16}^6$L-1 herein. In use, the vane $\mathbf{16}^6$ may be folded or bent along the bend line $\mathbf{16}^6$L-1 to define a self-supporting structure lying in a predetermined orientation with respect to a predetermined reference plane RP within the oven M. The same effect may be achieved by flexibly attaching two straight-edged vanes along a flexible line of connection in place of the fold or bend line.

Figure 13B:
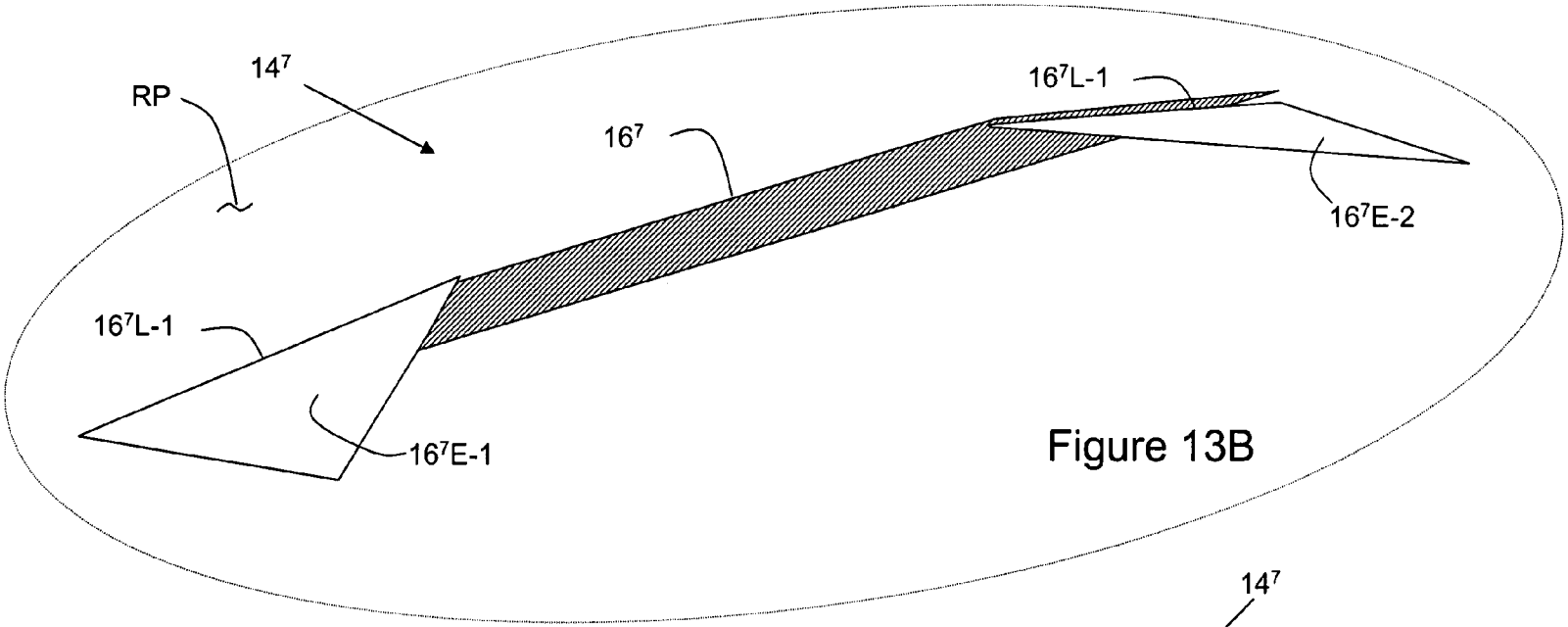
FIGS. 13A and 13B are respective elevational and pictorial views of a field director structure in accordance with the invention implemented using a planar vane with two bend line therein.
Figure 13A:
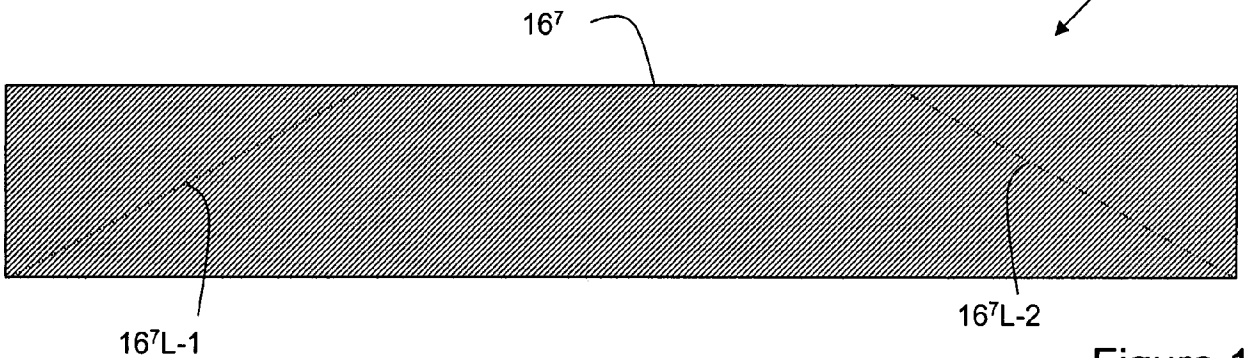

FIGS. 13A and 13B are respective elevational and pictorial views of a field director structure $\mathbf{14}^7$ implemented using a conductive planar vane $\mathbf{16}^7$ with two bend lines $\mathbf{16}^7$L-1 and $\mathbf{16}^7$L-2. Bending the vane $\mathbf{16}^7$ along the bend lines $\mathbf{16}^7$L-1 and $\mathbf{16}^7$L-2 forms ears $\mathbf{16}^7$E-1 and $\mathbf{16}^7$E-2 that serve to support the planar vane in a predetermined desired orientation with respect to the predetermined reference plane RP within the oven M.

Figure 14:
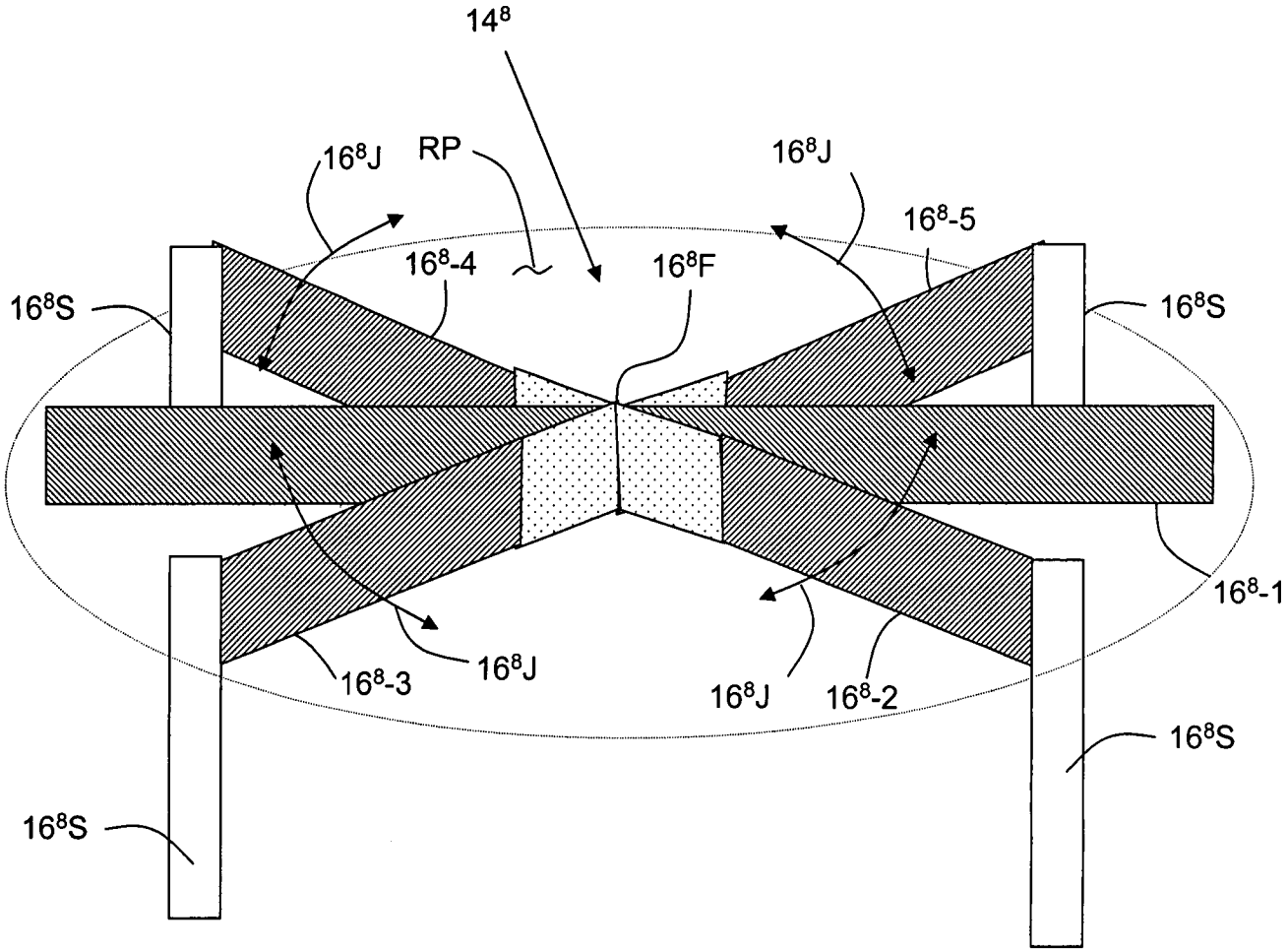
FIGS. 14 and 15 are pictorial views of two additional implementations of a field director structure in accordance with the invention each having a plurality of vanes flexibly connected to form a collapsible structure.
Figure 15:
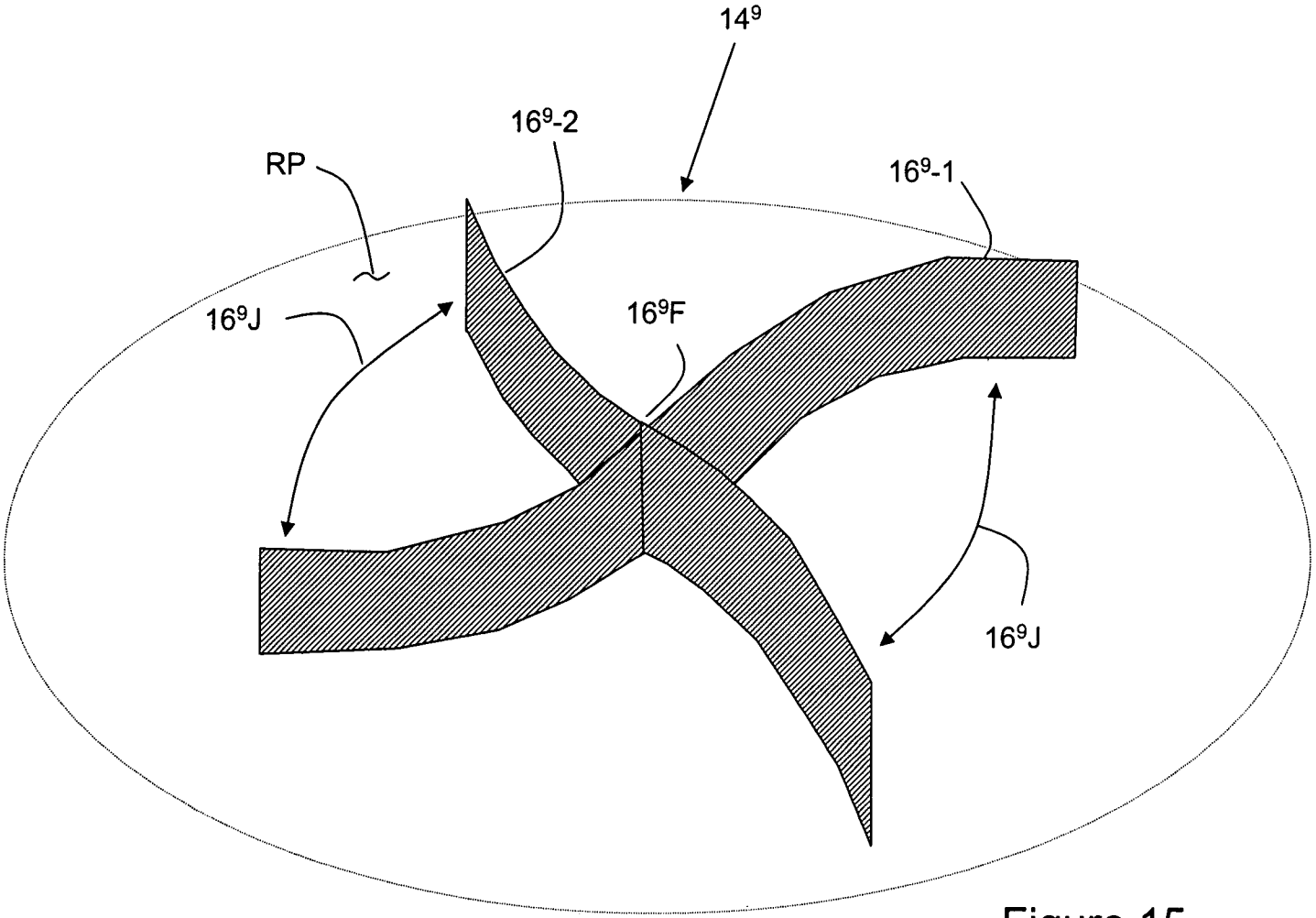

FIGS. 14 and 15 are pictorial views of two additional implementations of a collapsible self-supporting field director structure in accordance with the invention. Each field director structure has a vane array that includes a plurality of vanes flexibly connected to form a structure that may be made self-supporting.

In the field director structure $\mathbf{14}^8$ shown in FIGS. 14 and 15 the vane array comprising vanes $\mathbf{16}^8$-1 through $\mathbf{16}^8$-5, each vane having an electrically conductive surface thereon. Each vane is flexibly connected at a point of connection $\mathbf{16}^8$F to at least one other vane. The flexibly connected vanes are able to be fanned toward and away from each other, as suggested by the arrows $\mathbf{16}^8$J. In use, with the vanes in the array spread from each other the field director is able to be self-supporting with each vane in the array being disposed in a predetermined orientation with respect to a predetermined reference plane RP within the oven. In a modified embodiment a strut $\mathbf{16}^8$S may be connected to the free end of each of at least three vanes. The struts are fabricated of any material transparent to microwave energy.

The field director structure $\mathbf{14}^9$ shown in FIG. 15 comprises a pair of vanes $\mathbf{16}^9$-1 and $\mathbf{16}^9$-2, each vane having an electrically conductive surface thereon. Each vane is flexibly connected at a point of connection $\mathbf{16}^9$F to the one other vane. The flexibly connected vanes are able to be fanned toward and away from each other, as suggested by the arrows $\mathbf{16}^9$J. In use, with the vanes in the array spread from each other the field director is able to be self-supporting with each vane in the array being disposed in a predetermined orientation with respect to a predetermined reference plane within the oven.

Although the vanes in each of the embodiments illustrated in FIG. 11 through 15 are shown with the conductive portions extending over the over the entire surface of vane, it should be understood that the conductive portion of any of the vanes may exhibit any alternative shape.

Figure 16:
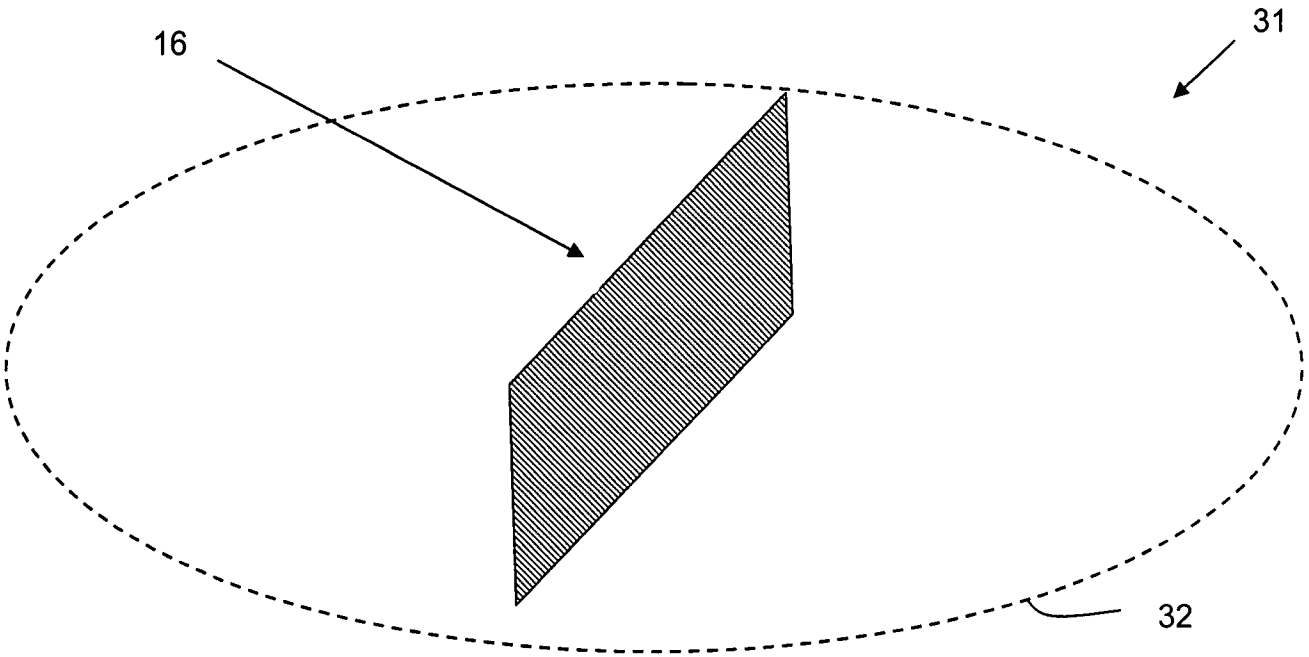
FIG. 16 is a pictorial view of a field director assembly in accordance with the present invention wherein at least one vane is supported on a non-conducting substrate.

It should also be appreciated that a field director structure of the present invention need not be made collapsible, but instead may be made self-supporting through the use of a suitable non-conductive support member. FIG. 16 is a pictorial view of a field director assembly generally indicated by the reference character 31. The field director assembly 31 shown in FIG. 16 comprises at least one vane 16 connected to a planar non-conductive support member 32 whereby the conductive surface of the vane is oriented in a predetermined orientation (shown as generally orthogonal to the support member). If additional vanes are provided, these additional vanes are supported on the same support member. The vanes may or may not be connected to each other, as desired. The support member may be connected below or above the vane(s).

It should also further be appreciated that any embodiment of a field director structure falling within the scope of the present invention may be used with a separate planar susceptor (earlier described). It should also be appreciated that for some food products it may be desirable to place a second planar susceptor above the food product or to wrap the food product with a flexible susceptor.

EXAMPLES 1-8

The operation of the field director structure and a susceptor assembly in accordance with the present invention may be understood more clearly from the following examples.

Introduction

For all of the following examples commercially available microwavable pizzas (DiGiorno® Microwave Four Cheese Pizza, 280 grams) were used in the cooking experiments.

A planar susceptor comprised of a thin layer of vapor-deposited aluminum sandwiched between a polyester film and paperboard was provided with the pizza in the package. This planar susceptor was used with various implementations of the field director structure of the present invention, as will be discussed. The edge of the paperboard provided was shaped to form an inverted U-shape cooking tray to space the planar susceptor approximately 2.5 cm above a turntable in the microwave oven. A crisping ring (intended for browning the edges of the pizza) provided with the pizza in the package was not used.

In all examples the planar susceptor was placed directly upon a turntable of a microwave oven. In all examples frozen pizzas were placed directly on the planar susceptor and cooked at full power for 5 minutes, except for Example 5, which was cooked in a lower power over for 7.5 minutes.

For comparison purposes one group of three pizzas was cooked using only the planar susceptor without a field director structure, and another group of three pizzas was cooked using the planar susceptor with a field director structure of the present invention.

The vanes of each field director were constructed using aluminum foil of 0.002 inch (0.05 millimeter) thickness, paperboard, and tape.

For Examples 1 through 7 the field director structure was placed in the space under the planar susceptor. For Example 8 the field director structure was positioned above the pizza.

Browning and Browning Profile Measurements

The percent browned and the browning profile of the pizza bottom crust were measured following a procedure described in Papadakis, S. E., et al. "A Versatile and Inexpensive Technique for Measuring Color of Foods," *Food Technology,* 54 (12) pp. 48-51 (2000). A lighting system was set up and a digital camera (Nikon, model D1) was used to acquire images of the bottom crust after cooking. A commercially available image and graphics software program was used to convert color parameters to the L-a-b color model, the preferred color model for food research. Following the suggestion from the referenced procedure the percent browned area was defined as percent of pixels with a lightness L value of less than 153 (on a lightness scale of 0 to 255, 255 being the lightest). Following the methodology described in the referenced procedure the browning profile (i.e., the percent browned area as a function of radial position) was calculated.

The image of the bottom crust was divided into multiple concentric annular rings and the mean L value was calculated for each annular ring.

The following examples are believed to illustrate the improvements in browning and browning uniformity that resulted from the use of different field director structures of the present invention.

EXAMPLE 1

A DiGiorno® Microwave Four Cheese Pizza was cooked in an 1100-watt General Electric (GE) brand microwave oven, Model Number JES1036WF001, in the manner described in the introduction. When a field director was employed, the field director structure in accordance with FIG. 14 (without the struts 16$^8$S) was used. The vane 16$^8$-1 had a length dimension of 17.5 centimeters, and a width dimension of 2 centimeters. The vanes vane 16$^8$-2 through 16$^8$-5 each had a length dimension of 8 centimeters and a width dimension of 2 centimeters.

After cooking an image of the bottom crust was acquired with the digital camera, as described. From the image data the percent browned area was calculated using the procedures described. The average percent browned area for the pizzas cooked without a field director was determined to be 40.3%. The average percent browned area for the pizzas cooked with a field director was determined to be 60.5%.

EXAMPLES 2 to 5

The experiment described in Example 1 was repeated in four microwave ovens of different manufacturers. The oven manufacturer, model number, full power wattage, and cooking time for each example are summarized in Table 1. The table reports the percent browned area achieved with and without a field director. It should be noted that the percent browned area was improved in all cases.

TABLE 1

Comparison of percent browned area with and without field director

| | Example | | | | |
|---|---|---|---|---|---|
| | 1 | 2 | 3 | 4 | 5 |
| Oven brand | GE | Sharp | Panasonic | Whirlpool | Goldstar |
| Wattage | 1100 | 1100 | 1250 | 1100 | 700 |
| Model # | JES1036WF001 | R-630DW | NN5760WA | MT4110SKQ | MAL783W |
| Cooking time | 5 min | 5 min | 5 min | 6 min | 7.5 min |
| | | Percent Browned Area | | | |
| W/field director | 60.5% | 70.7% | 61.7% | 60.7% | 51.4% |
| w/out field director | 40.3% | 55.2% | 50.3% | 15.3% | 31.5% |

EXAMPLE 6

A DiGiorno® Microwave Four Cheese Pizza, 280 gram, was cooked in an 1100-watt Sharp brand oven, Model R-630DW. When a field director structure was employed, the field director structure in accordance with FIG. 15 was used. The vanes 16$^9$-1 and 16$^9$-2 had a length dimension of 22.9 centimeters and a width dimension of 2 centimeters. The radius of curvature for each portion of a curved vane extending from the point of connection 16$^9$F was approximately 5.3 cm and had an angle of arc of approximately 124 degrees.

After cooking an image of the bottom crust was acquired with the digital camera and the percent browned area was calculated, all as described.

Figure 17:
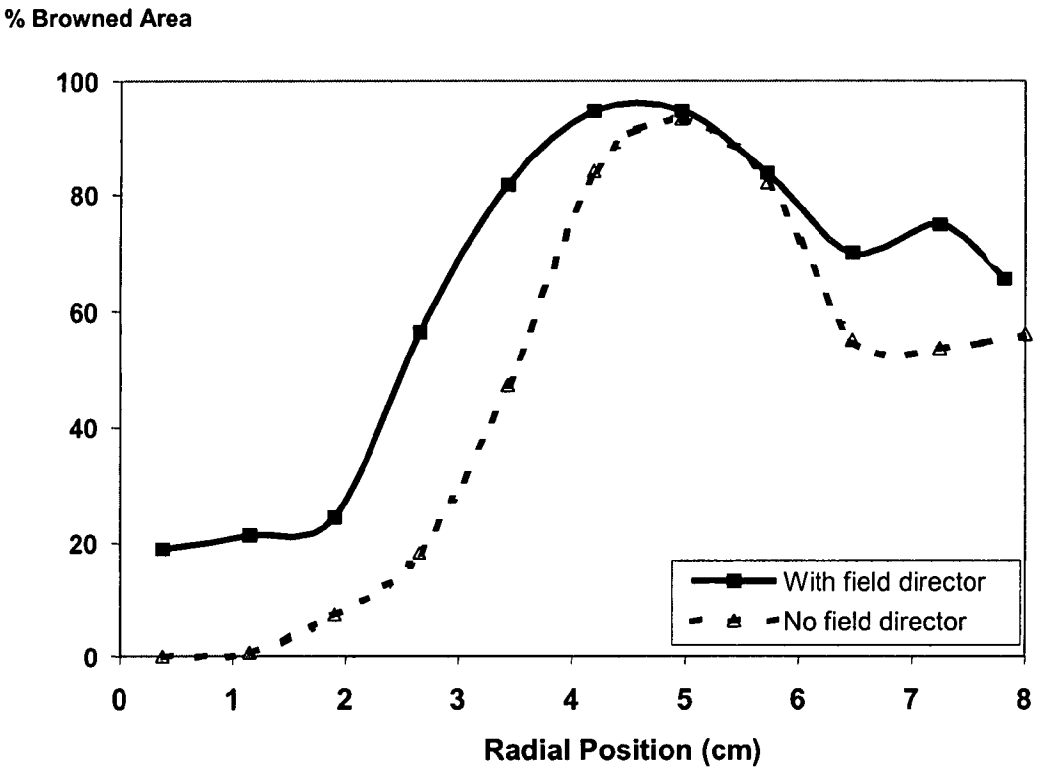
FIGS. 17 and 18 are plots of the results of Examples 6 and 7, respectively.

The average percent browned area for the pizzas cooked without a field director was 55.2%. The average percent browned area for the pizzas cooked with the field director was determined to be 73.8%. The browning profile, was plotted and is shown in FIG. 17.

EXAMPLE 7

Figure 18:
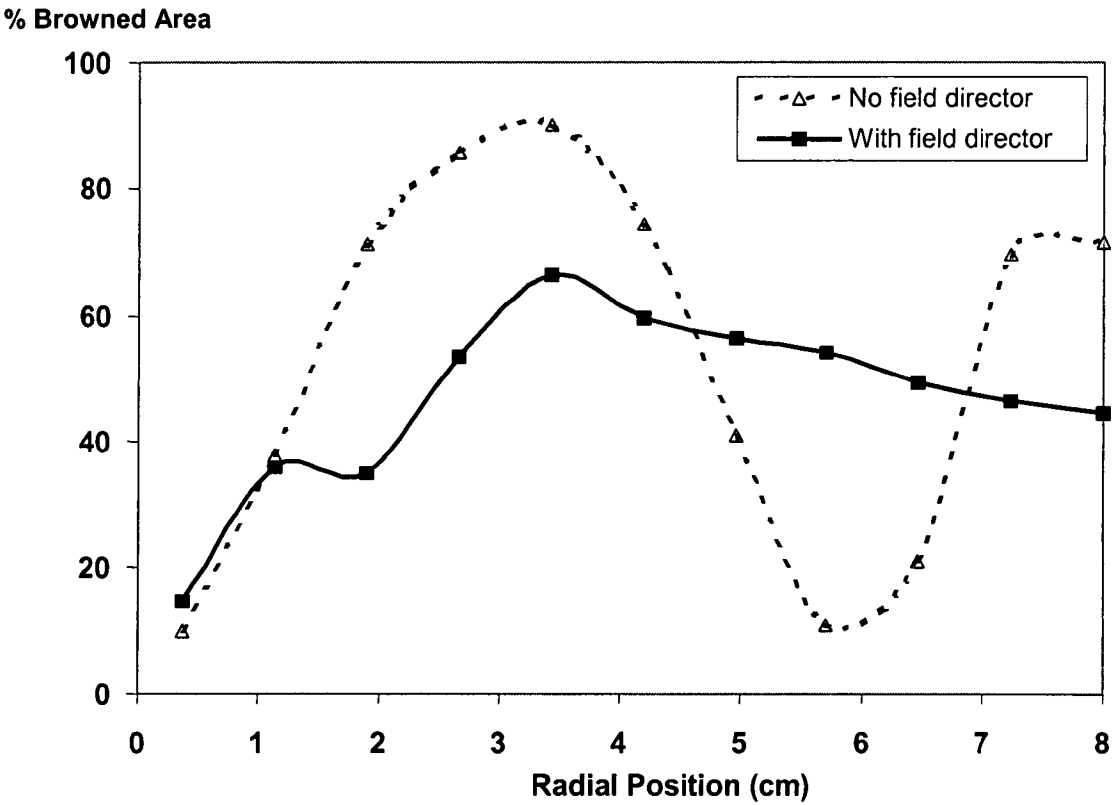

The experiment described in Example 6 was repeated using a 1300-watt Panasonic brand oven, Model NN5760WA. The average percent browned area for the pizza cooked without a field director was 50.3%. The average percent browned area for the pizzas cooked with a field director structure was determined to be 51.7%. The substantially uniform browning profile that follows from the use of the present invention may be observed from the plot shown in FIG. 18. From observation of FIG. 18 it can be appreciated that the browning profile along the radius was greatly improved with the use of a field director structure.

EXAMPLE 8

The experiment described in Example 1 was repeated in a 700-watt Goldstar brand microwave oven, Model MAL783W. When a field director structure was employed, the field director structure in accordance with FIG. 14 with the struts $\mathbf{16}^{8}$S was used. The struts were 5 centimeters in height and were placed on the turntable to support the field director just above the pizza. The field director structure barely touched the top of the pizza after the pizza crust had risen.

After cooking (for 7.5 minutes at full power of the oven used) an image of the bottom crust was acquired with the digital camera and the percent browned area was calculated, all as described.

The percent browned area for the pizza cooked without a field director was 31.5%. The percent browned area for the pizza cooked with a field director was 65.1%.

When a microwave susceptor assembly such as described above is placed in an "unloaded" microwave oven (i.e., an oven without a food product or other article being present) several deleterious problems have been observed. The problems are particularly acute in high wattage ovens (i.e., ovens having power ratings typically greater than nine hundred watts). In some instances the microwave susceptor assembly may overheat even when an article is present.

As the lossy layer 12C of the planar susceptor 12 overheats, melting or charring of the substrate 12S may occur. The susceptor may overheat to the extent that the susceptor substrate burns. The conductive portions of the vanes of the field director structure may arc, particularly along the edges and especially at the corners. The arcing causes the non-conductive (typically paperboard) support of the vanes to discolor, to char or to overheat to the extent that it ignites into flames. Overheating of the field director structure may also be caused by overheating of the susceptor material.

Accordingly, it is believed advantageous to provide a field director structure and a susceptor assembly incorporating the same that is "abuse-tolerant", that is, a structure that prevents the occurrence of arcing, and/or the occurrence of overheating of the field director, and/or the occurrence of overheating of the susceptor.

FIG. 19 is a composite view of a susceptor assembly $\mathbf{10}^{10}$ having a field director structure $\mathbf{14}^{10}$ having. The vanes depicted in FIG. 19 illustrate vanes that are used in the Examples 9-64 following herein.

The susceptor assembly $\mathbf{10}^{10}$ includes a generally planar susceptor 12 having a substrate 12B with an electrically lossy layer 12C, as described earlier in connection with FIG. 2.

The field director structure $\mathbf{14}^{10}$ has at least one but preferably a plurality of vanes $\mathbf{16}^{10}$ each mechanically connected to the planar susceptor 12. Each vane $\mathbf{16}^{10}$-1 through $\mathbf{16}^{10}$-8 shown in FIG. 19 is formed of a substrate $\mathbf{16}^{10}$N of a non-conductive material. Each vane is generally rectangular in shape. The substrate $\mathbf{16}^{10}$N is visible on some of the vanes. The substrate $\mathbf{16}^{10}$N may have a fire retardant composition applied thereto.

It should be understood that the field director structure $\mathbf{14}^{10}$ may alternatively be used in combination with a planar non-conductive support member 32 to define a field director assembly generally indicated by the reference character 31.

Each vane $\mathbf{16}^{10}$ has a surface $\mathbf{16}^{10}$S which is identified for clarity of illustration only for the vane $\mathbf{16}^{10}$-6. At least a portion $\mathbf{16}^{10}$C of the surface $\mathbf{16}^{10}$S of each vane is electrically conductive. As will be described the electrically conductive portion $\mathbf{16}^{10}$C of each vane $\mathbf{16}^{10}$ is positioned with respect to the planar susceptor 12 and configured in various ways to prevent overheating and arcing problems.

The conductive portion $\mathbf{16}^{10}$C of each vane $\mathbf{16}^{10}$ has a first end $\mathbf{15}^{10}$D and a second end $\mathbf{15}^{10}$E. Again for clarity the ends are indicated only on vane $\mathbf{16}^{10}$-6. The distance between the first and second ends $\mathbf{15}^{10}$D and $\mathbf{15}^{10}$E defines a predetermined length dimension for the conductive portion $\mathbf{16}^{10}$C. The conductive portion $\mathbf{16}^{10}$C of each vane also exhibits a predetermined width dimension. As previously described (e.g., in conjunction with FIGS. 2 and 3) the length dimension should be in the range from about 0.25 to about two (2) times the wavelength of the standing electromagnetic wave produced generated in the oven. The width dimension should be in the range from about 0.1 to about 0.5 times that wavelength.

The vane $\mathbf{16}^{10}$-1 has a conductive portion $\mathbf{16}^{10}$C-1 that occupies the entire rectangular surface. The conductive portion $\mathbf{16}^{10}$C-1 abuts the planar susceptor 12. The vane $\mathbf{16}^{10}$-1 is typical of a vane structure that would overheat when used in an unloaded oven. A susceptor 12, when used with a field director structure having a vane $\mathbf{16}^{10}$-1, may also overheat resulting in melting or charring of the susceptor substrate 12S. The conductive portion of the vane $\mathbf{16}^{10}$-1 may arc along its edges or at its corners.

The conductive portion $\mathbf{16}^{10}$C-2 of the vane $\mathbf{16}^{10}$-2 is also rectangular in shape. This conductive portion $\mathbf{16}^{10}$C-2 occupies only a portion of the vane surface, leaving part of the substrate $\mathbf{16}^{10}$N exposed to define a border 19L along the bottom edge. The conductive portion $\mathbf{16}^{10}$C-2 abuts the planar susceptor 12. The structure of the vane $\mathbf{16}^{10}$-2 has been shown to limit but not to eliminate overheating of the vane and susceptor when used in an unloaded oven (Examples 36, 39). When used with a field director structure having a vane $\mathbf{16}^{10}$-2 the susceptor 12 may also overheat, resulting in melting or charring of the substrate 12S.

As will be developed the vanes $\mathbf{16}^{10}$-3 through $\mathbf{16}^{10}$-5, $\mathbf{16}^{10}$-7 and $\mathbf{16}^{10}$-8 exemplify various positions and/or configurations of the conductive portions $\mathbf{16}^{10}$C in accordance with the present invention that the problems of overheating of the susceptor, and/or overheating of the field director, and/or arcing are prevented.

Vane $\mathbf{16}^{10}$-3 is an example of a vane in which the substrate $\mathbf{16}^{10}$N abuts the planar susceptor 12. In this instance the conductive portion $\mathbf{16}^{10}$C-3 is positioned on the vane such that a top border 19T of non-conductive substrate material is exposed along the edge of the vane adjacent to the susceptor 12. The border 19T serves to space the conductive portion $\mathbf{16}^{10}$C-3 of the vane $\mathbf{16}^{10}$-3 a predetermined close distance 21D away from the susceptor 12. The dimension 21D, measured in a direction orthogonal to the plane of the susceptor 12, lies in a range from 0.025 to 0.1 times the wavelength of the standing electromagnetic wave produced in the microwave oven in which the susceptor assembly $\mathbf{10}^{10}$ is being used. That is, the dimension 21D should be at least 0.025 times the wavelength. Further, the dimension 21D should be no greater than 0.1 times that wavelength (that is, the dimension 21D≤0.1 times that wavelength). It should noted that the maximum distance 17D referred to earlier and the maximum distance shown by reference character D in FIG. 6 (i.e., 0.25 wavelength) is sized with the express understanding that the microwave oven in which that vane is used would be loaded.

The conductive portion 16$^{10}$C-4 of the vane 16$^{10}$-4 is sized such that part of its substrate 16$^{10}$N is exposed to define radially inner and outer borders 19D and 19E, respectively. In addition an upper border 19T and a lower border 19L of substrate material 16N are exposed.

Vane 16$^{10}$-5 is an example of a vane in which the conductive portion 16$^{10}$C-5 is generally rectangular (similar to the conductive portion 16$^{10}$C-4) but with rounded corners. The corners may be rounded at a radius dimension 15R up to and including one-half of the width dimension of the conductive portion 16$^{10}$C-5 (i.e., 15R≤0.5 width). When the corners are rounded the length of the conductive portion is defined by the radial extent of the conductive portion. The vane 16$^{10}$-5 also has borders 19T, 19L, 19D, 19E (similar to those shown about the vane 16$^{10}$C-4). The dimension of the lower border 19L is indicated by the reference character 21L.

Vane 16$^{10}$-6 also exhibits a conductive portion 16$^{10}$C-6 with rounded corners. However, the conductive portion 16$^{10}$C-6 extends the full width of the vane and abuts the planar susceptor 12. It is not spaced a predetermined close distance away from the planar susceptor 12.

The vane 16$^{10}$-7 is an example of a vane having an electrically conductive portion 16$^{10}$C-7 made of a metallic foil that is folded as indicated at 16$^{10}$C-7F to define at least a double thickness along its perimeter. Borders 19T, 19L, 19D, 19E (similar to those shown about the vane 16$^{10}$C-4) are present along the perimeter of the conductive portion 16$^{10}$C-7.

The vane 16$^{10}$-8 has a conductive portion 16$^{10}$C-8 that occupies its entire rectangular surface. For this vane the requisite spacing 21D of the conductive portion 16$^{10}$C-8 from the susceptor 12 is achieved by using a mounting arrangement in which the vane is physically set apart from the susceptor.

Of course, it should also be appreciated that the requisite spacing 21D may also be achieved by the sum of the set apart distance from the susceptor and the border width of an appropriately sized bordered vane (i.e., vane 16$^{10}$-3, 16$^{10}$-4, 16$^{10}$-5, or 16$^{10}$-7).

Figure 20:
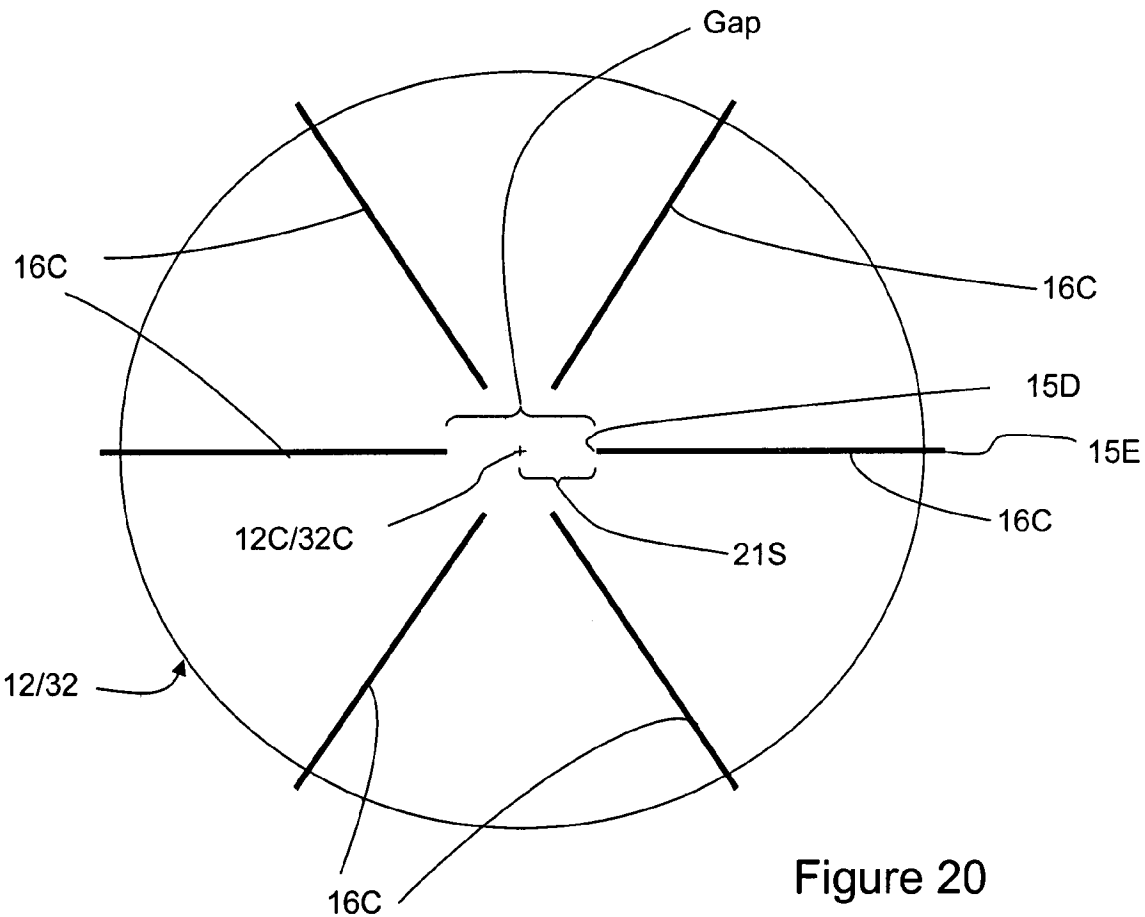
FIG. 20 is a plan view of a susceptor assembly incorporating a six-vane field director structure used in Examples 9 through 23.

As indicated in FIGS. 19 and 20, when a plurality of vanes are used the first end 15$^{10}$D of the conductive portion of each of the vanes is disposed a predetermined separation distance 21S from the geometric center 12C of the planar susceptor 12 or the geometric center 32C planar support member 32, as the case may be. The separation distance 21S, measured in a direction parallel to the plane of the susceptor 12 or the support member 31, should be at least 0.16 times the wavelength of the standing electromagnetic wave produced in the microwave oven in which the susceptor assembly 10$^{10}$ is being used.

It has been found that disposing the first end 15$^{10}$D of the conductive portion 16$^{10}$C of each of the vanes at the predetermined separation distance 21S from the geometric center 12C of the planar susceptor 12 mitigates the occurrence of overheating of the susceptor in the vicinity of the susceptor center (Examples 18, 19, 20-22). Disposing the electrically conductive portion of the vane the predetermined close distance 21D from the electrically lossy layer of the planar susceptor (however that spacing is achieved) has also been found to mitigate the occurrence of overheating of the susceptor (Examples 35, 37). Further mitigation of the occurrence of susceptor overheating may be achieved by the provision of the lower border 19L (Examples 36, 39).

In accordance with the present invention the combination of the disposition of the conductive portions of the vanes at the predetermined separation distance 21S together with the disposition of the conductive portions of the vanes at the predetermined close distance 21D from the planar susceptor prevents the occurrence of overheating of the susceptor when used in an unloaded microwave oven.

Also in accordance with the present invention disposing the electrically conductive portion of the vane at the predetermined close distance 21D from the electrically lossy layer of the planar susceptor and rounding the corners of the conductive portion with the radius 15R prevents the occurrence of arcing when used in an unloaded microwave oven.

Further in accord with the invention the occurrence of arcing in an unloaded microwave oven is prevented by disposing the electrically conductive portion of the vane at the predetermined close distance 21D from the electrically lossy layer of the planar susceptor and covering the conductive portion of any of the vanes 16$^{10}$-3 through 16$^{10}$-5, 16$^{10}$-7, 16$^{10}$-8 with an electrically non-conductive material such as a polyacrylic or a polytetrafluoroethylene spray coating or a polyimide tape.

Still further in accordance with the invention disposing the electrically conductive portion of the vane at the predetermined close distance 21D from the electrically lossy layer of the planar susceptor and increasing the thickness of the perimeter of a thin foil conductive portion (in the manner shown on the vane 16$^{10}$-7) prevents the occurrence of arcing when used in an unloaded oven.

EXAMPLES 9-23

The following examples describe experiments that were conducted to determine parameters that mitigate or eliminate the overheating and/or arcing problems. A General Electric, model JES1456BJ01, 1100 watt microwave oven was used in Examples 9 through 23. The tests were conducted with the oven unloaded, i.e., no food product or other article was present in the oven. These Examples are summarized in Table 2 herein.

Example 9 was a control example with no borders and no rounding of corners of the conductive portion of a single vane.

Examples 10-13 and 14-17 tested the effect of a non-conductive covering on the conductive portion of a single vane. In Examples 10-13 the conductive portion was ¾" (0.75"; 19 mm) wide with rounded corners; in Examples 14-17 the conductive portion was 1" (25.4 mm) wide with rounded corners.

Examples 18-20 tested the effect of varying the center gap between radially opposite conductive portions on arcing and overheating.

Examples 21-22 tested alternate materials for the conductive portions. Example 23 tested the effect of fire retardant treatment of the paperboard on arcing and burning.

EXAMPLE 9

Figure 21:
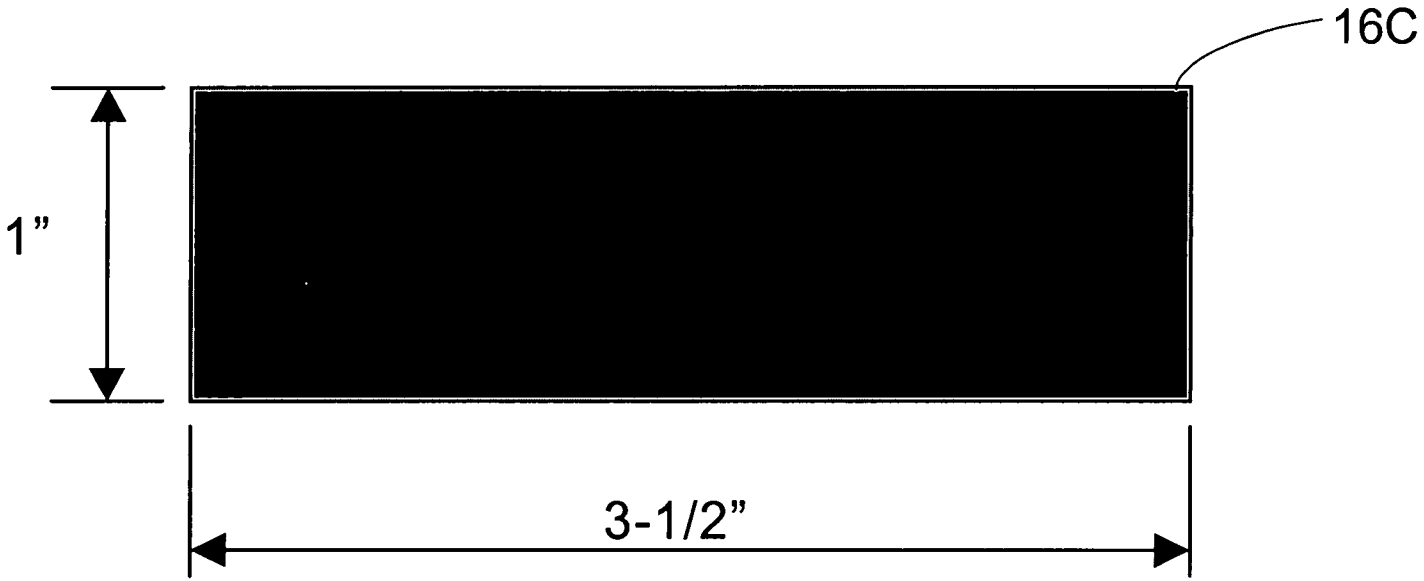
FIG. 21 is an enlarged dimensioned view showing a vane configuration having a rectangular electrically conductive portion that occupies the entire vane area.

In this example a single vane was configured and positioned with respect to the susceptor in accordance with vane 16$^{10}$-1 of FIG. 19. An enlarged dimensioned view of such a vane is shown in FIG. 21. A 3½" (3.5") long by 1" wide (88.9 mm by 25.4 mm) adhesive-backed 0.002" (0.05 mm) thick aluminum foil conductive portion from the Merco Co., Hackensack, N.J., with square corners was applied to a cellulose paperboard of the same size. The paperboard was International Paper (Grade Code 1355, 0.017/180# Fortress Uncoated Cup Stock). The vane was then taped to the underside of a commercial susceptor arrangement supplied with DiGiorno® Microwave Four Cheese Pizza (280 grams) using 0.001" (0.025 mm) thick polyimide tape (Kapton® polyimide tape from E.I. DuPont de Nemours and Company). This configuration resulted in arcing in twenty-eight seconds when exposed unloaded in a microwave oven.

EXAMPLES 10-13

Figure 22:
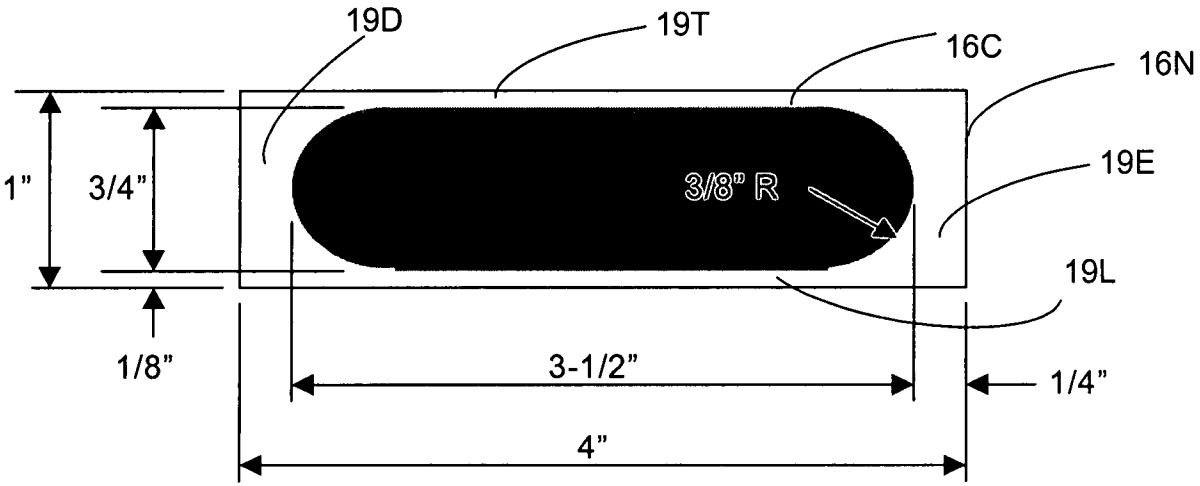
FIG. 22 is an enlarged dimensioned view showing a vane configuration having a generally rectangular electrically conductive portion having rounded corners and a surrounding non-conducting border portion.

In these examples the single vane was configured and positioned with respect to the susceptor in accordance with vane 16$^{10}$-5 of FIG. 19. An enlarged dimensioned view of such a vane is shown in FIG. 22.

Examples 10 through 12 provided a protective covering of an electrically non-conductive material over the aluminum conductive portion in an effort to prevent arcing. An uncovered version, Example 13, was also tested as a control.

Each vane had a conductive portion 3½" (3.5"; 88.9 mm) long and ¾" (0.75"; 19.2 mm) wide cut from the same adhesive backed 0.002" (0.05 mm) thick aluminum foil used in Example 9, applied to a 4"×1" (101.6 by 25.4 mm) rectangle of the same cellulose paperboard as in Example 9. The conductive portion was ¾" (0.75"; 19.2 mm) wide in order to insure the non-conductive covering covered all of the edges of the aluminum conductive portion. A top border of ⅛" (0.125"; 3.2 mm) of paperboard was exposed above the conductive portion. A ⅛" (0.125"; 3.2 mm) border dimension was about 0.025 times the wavelength. The conductive portion had all corners rounded at a radius of ⅜" (0.375"; 9.6 mm).

A lower border of ⅛" (0.125"; 3.2 mm) of paperboard was also exposed below the conductive portion and ¼" (0.25"; 6.4 mm) border of paperboard was exposed on each end.

Different non-conductive materials were used as the coverings, as follows:

Example 10—0.001" (0.025 mm) thick by 1" (25.4 mm) wide polyimide tape (sold under the trademark Kapton® from E.I. DuPont de Nemours and Company)

Example 11—polyacrylic spray from Minwax

Example 12—polytetrafluoroethylene spray (sold under the trademark Teflon® from E.I. DuPont de Nemours and Company)

Example 13—uncoated.

None of the vanes showed any arcing when exposed unloaded in a microwave oven for two minutes.

EXAMPLES 14-17

Figure 23:
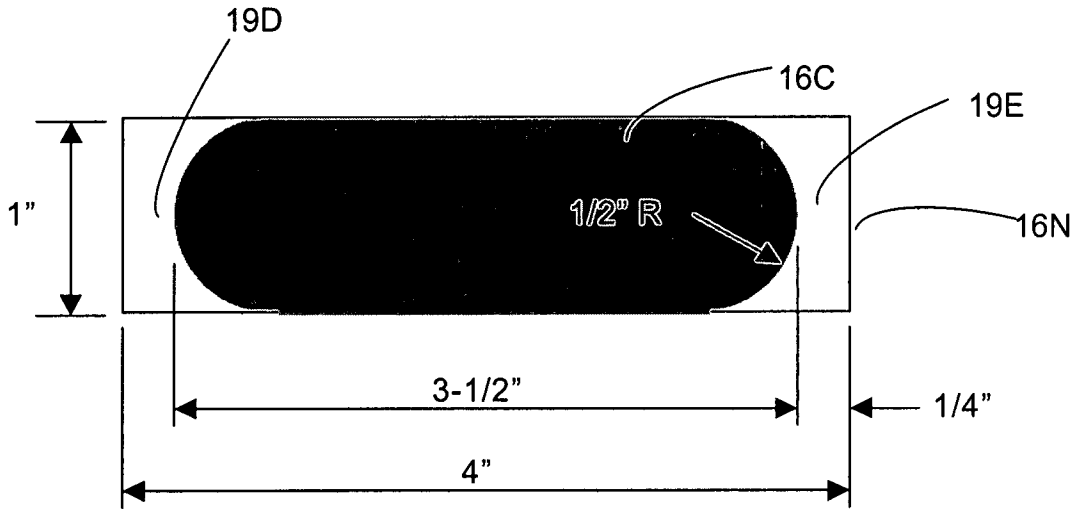
FIG. 23 is an enlarged dimensioned view showing a vane configuration having a generally rectangular electrically conductive portion having rounded corners.

In these examples a single vane was configured and positioned with respect to the susceptor in accordance with vane 16$^{10}$-6 of FIG. 19. An enlarged dimensioned view of such a vane is shown in FIG. 23.

Examples 14 through 16 evaluated the same non-conductive protective coverings disposed over the aluminum conductive portion as in Examples 10 through 12, respectively, but with the aluminum conductive portion being the same 1" (25.4 mm) width as the paperboard. Again, an uncovered version, Example 17, was tested as a control. In each of these examples the conductive portion was 3½" (3.5"; 88.9 mm) long by 1" (25.4 mm) wide adhesive backed 0.002" (0.05 mm) thick aluminum foil applied to a 4" by 1" (101.6 mm by 25.4) rectangle of the cellulose paperboard as was used in Examples 10-13. The conductive portion had all corners rounded at a radius of ½" (0.5"; 12.7 mm) and had a ¼" (0.25"; 6.4 mm) border of exposed paperboard on both of the ends.

Different non-conductive materials were used as the coverings, as follows:

Example 14—0.001" (0.025 mm) thick by 1" (25.4 mm) wide polyimide tape (sold under the trademark Kapton® from E.I. DuPont de Nemours and Company)

Example 15—polyacrylic spray from Minwax

Example 16—polytetrafluoroethylene spray (sold under the trademark Teflon® from E.I. DuPont de Nemours and Company)

Example 17—uncoated.

In Example 14 the surface of the conductive portion was covered by the polyimide tape. The top and bottom edges were not covered by the polyimide tape.

In Examples 15 and 16 the surface of the conductive portion was covered by the polyacrylic or polytetrafluoroethylene spray coating, respectively. The top and bottom edges of the aluminum conductive portion were covered only by incidental over-spray of the polyacrylic or polytetrafluoroethylene coatings.

In Examples 14, 16 and 17 the bottom edge of the conductive portion arced in the center. This arcing occurred very shortly after being exposed unloaded in the microwave oven. In Example 15 no arcing occurred.

More particularly, the results of the experiments were as follows:

Example 14—conductive portion of vane covered with 0.001" (0.025 mm) thick Kapton® tape, arced after 16 seconds of exposure Example 15—conductive portion of vane coated with polyacrylic spray, did not arc in 2 minutes Example 16—conductive portion of vane coated with polytetrafluoroethylene (Teflon®) spray, arced after 12 seconds of exposure Example 17—conductive portion of uncovered vane, arced after 17 seconds of exposure.

FIG. 20 is a plan view of a susceptor assembly incorporating a six-vane field director used in Examples 18 through 23. It may be appreciated from FIG. 20 that the end-to-end gap ("Gap") between conductive portions of diametrically opposed vanes is twice the separation distance 21S.

EXAMPLE 18

In this example each of the six vanes of the field director of FIG. 20 was configured with the conductive portions in accordance with vane 16$^{10}$-5 of FIG. 19.

Figure 24:
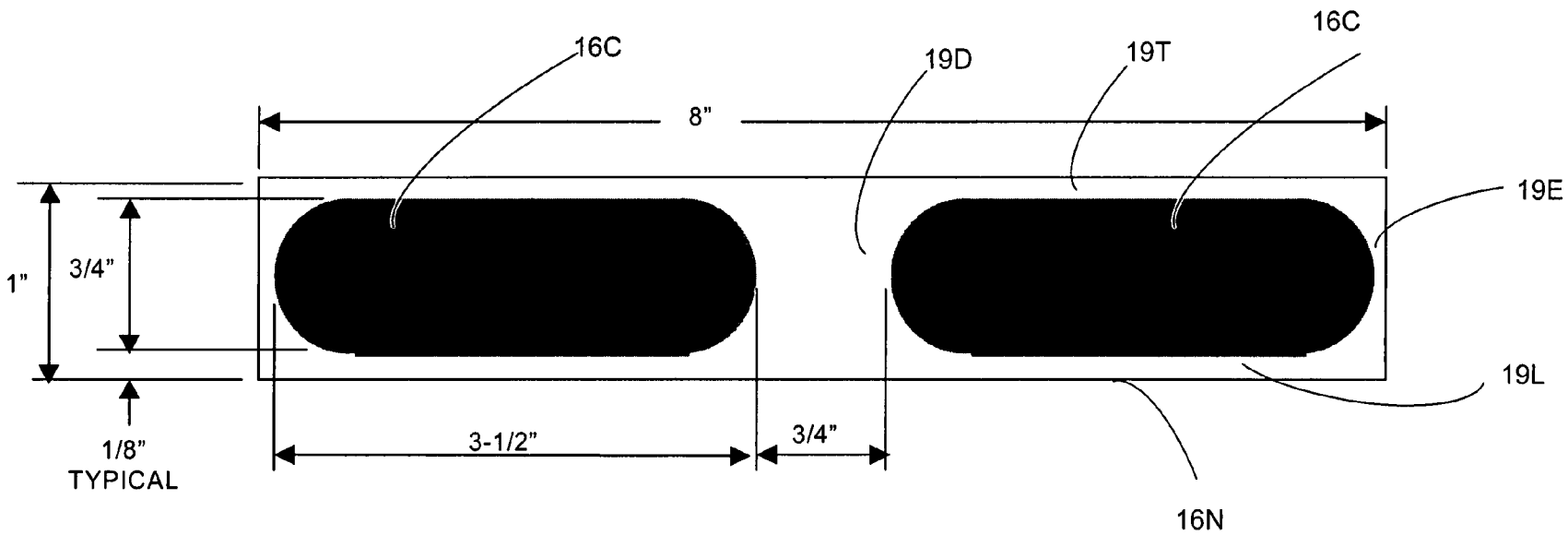
FIGS. 24, 25 and 26 are an enlarged dimensioned views showing vane blanks having two generally rectangular, spaced apart, electrically conductive portions, the conductive portions having rounded corners and having non-conducting borders surrounding each conductive portion.

As shown in FIG. 24 three vane blanks each having conductive portions 3½" (3.5") long by ¾" (0.75") wide (88.9 mm by 19.2 mm) with all corners rounded at a radius of ⅜" (0.375"; 9.6 mm). The conductive portions were cut from the same adhesive backed 0.002" (0.05 mm) thick aluminum foil used for the previous Examples 9-17. Two of these conductive portions were placed on a by 8" by 1" (203.2 by 25.4 mm) rectangle of the cellulose paperboard used in Examples 9-17 so that there was a ⅛" (0.125"; 3.2 mm) border of paperboard exposed above and below the conductive portion and at the outside ends. A end-to-end gap of ¾" (0.75"; 19.2 mm) was left between the inner ends of each conductive portion.

Each of three vane blanks was then bent in the middle to form a V-shape and positioned under a susceptor with the apex of each V at the center of the susceptor, thus defining a separation distance 21S (FIG. 19) of ⅜" (0.375"; 9.6 mm). The V-shaped vane blanks were glued to the underside of the susceptor using a water soluble adhesive such as type BR-3885 from Basic Adhesives, Inc. The blanks were positioned such that the vanes were equally spaced in a radial spoke pattern. The fully assembled susceptor assembly was arranged so that pairs of conductive portions were directly opposed at an end-to-end gap of ¾" (0.75"; 19.2 mm).

There was no discernible arcing when this susceptor assembly was exposed unloaded in the microwave oven, but the assembly did burst into flames when the paperboard substrate in the center overheated in forty-seven seconds.

EXAMPLE 19

In this example each of the six vanes of the field director of FIG. 20 was configured with the conductive portions in accordance with vane 16$^{10}$-5 of FIG. 19.

Figure 25:
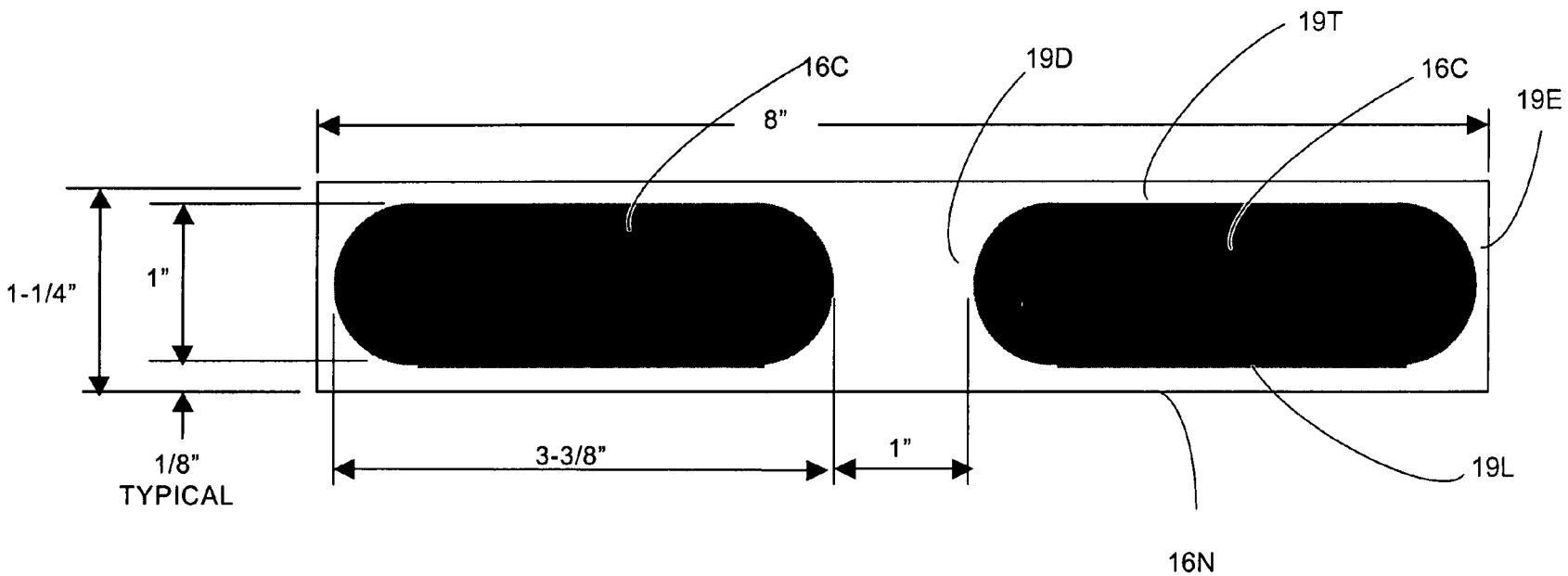

The vanes in this Example were constructed in the same manner as in Example 18 from vane blanks as illustrated in FIG. 25. The vane blanks were 8" by 1¼" (203.2 mm by 31.7 mm) rectangles of the same cellulose paperboard. The conductive portions were 3⅜" (3.375"; 85.7 mm) in length and 1" (25.4 mm) in width with all corners rounded at a radius of ½" (0.5"; 12.7 mm). The conductive portions were attached to the paperboard blanks to leave a ⅛" (0.125"; 3.2 mm) border of paperboard exposed above and below the conductive portion and at the outside ends. A end-to-end gap of 1" (25.4 mm) was left between the inner ends of each conductive portion.

As in Example 18 three of these V-folded vane blanks were glued to the underside of a susceptor defining a separation distance 21S (FIG. 19) of ½" (0.5"; 12.7 mm).

Again, there were no discernible arcs when this susceptor assembly was exposed in the microwave oven unloaded, but the assembly did burst into flames when the paperboard vanes in the center overheated in one minute, eighteen seconds.

EXAMPLE 20

In this example each of the six vanes of the field director of FIG. 20 was configured with conductive portions in accordance with vane 16$^{10}$-5 of FIG. 19.

Figure 26:
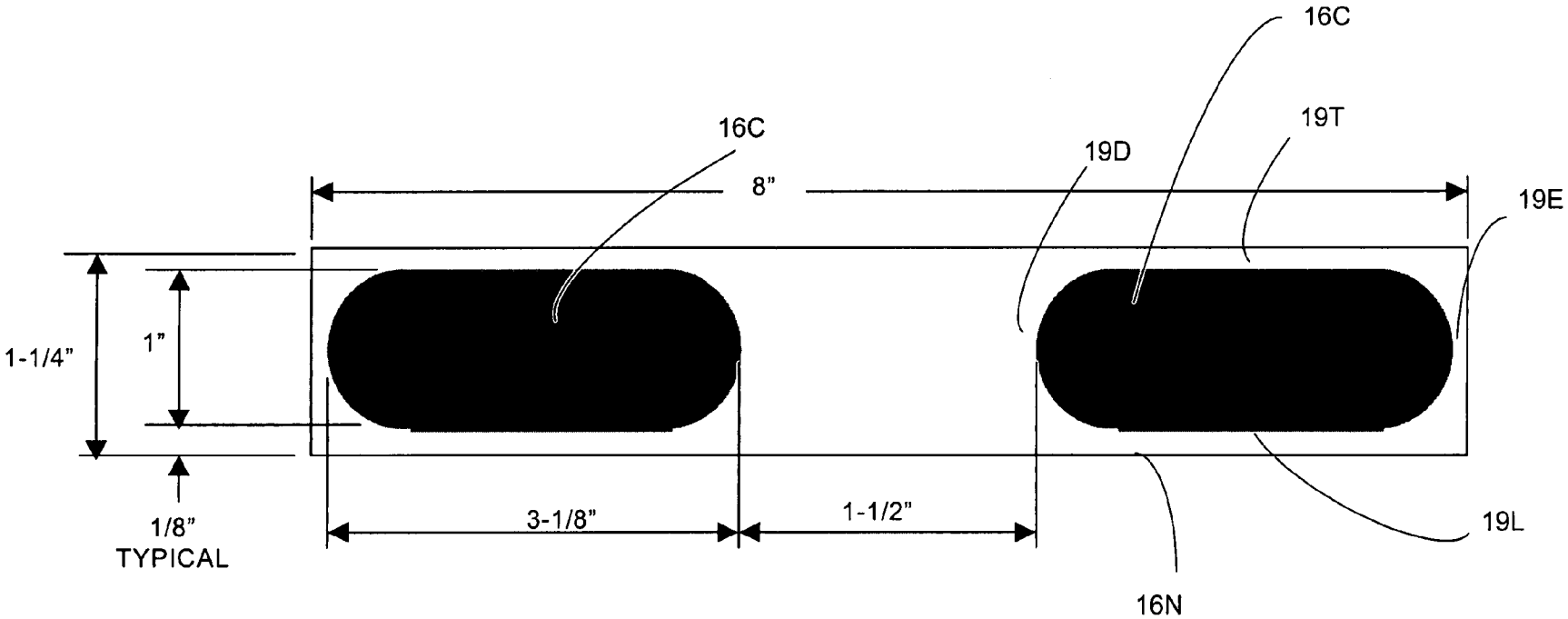

The vanes in this Example were also constructed in the same manner as in Examples 18 and 19 from vane blanks as illustrated in FIG. 26. The vane blanks were 8" by 1¼" (203.2 mm by 31.7 mm) rectangles of the same cellulose paperboard. The conductive portions were 3⅛" (79.4 mm) in length and 1" (25.4 mm) in width with all corners rounded at a radius of ½" (0.5"; 12.7 mm). The conductive portions were attached to the paperboard blanks to leave a ⅛" (0.125"; 3.2 mm) border of paperboard exposed above and below the conductive portion and at the outside ends. An end-to-end gap of 1½" (1.5"; 38.1 mm) was left between the inner ends of each conductive portion.

As in Examples 18 and 19 three of these V-folded vane blanks were glued to the underside of a susceptor defining a separation distance 21S (FIG. 19) of ¾" (0.75"; 19.2 mm).

There was no arcing and no burning when this susceptor assembly was exposed in the microwave oven for five minutes.

EXAMPLE 21

The test of Example 20 was repeated using conductive portions as shown in FIG. 26. The conductive portions for this example were made with Avery-Dennison Fasson® 0817 adhesive backed 0.002" (0.05 mm) thick aluminum foil available from Avery-Dennison Specialty Tape Division, Painesville, Ohio.

There was no arcing and no burning when this susceptor assembly was exposed unloaded in the microwave oven for five minutes.

EXAMPLE 22

The test of Example 20 was repeated using conductive portions as shown in FIG. 26. The conductive portions for this example were made with Shurtape AF973 adhesive backed 0.002" (0.05 mm) thick aluminum foil available from Shurtape, Hickory, N.C.

There was no arcing and no burning when this susceptor assembly was exposed unloaded in the microwave oven for five minutes. The aluminum foil of this tape performed acceptably but the adhesive loosened.

EXAMPLE 23

The application of a fire retardant composition to avoid spontaneous burning of the vanes was tested as Example 23. The fire retardant used was an aqueous based resin known as Paper Seal™ from Flame Seal® Products of Houston, Tex. The susceptor assembly was constructed as in Example 18 with a ¾" (0.75"; 19.2 mm) gap in the center between each pair of conductive portions as shown in FIG. 24 thus defining a separation distance 21S (FIG. 19) of ⅜" (0.375"; 9.6 mm).

The paperboard blanks were dipped into a bath of the fire retardant liquid and allowed to dry for a day before adhering the conductive portions and assembling the susceptor assembly.

There were no arcs when an unloaded susceptor assembly was exposed in the microwave oven for five minutes. Unlike Example 18 the assembly did not burst into flames, suggesting that a fire retardant treatment of the paperboard was sufficient to prevent burning.

The tests of Examples 9 through 23 are summarized in Table 2.

TABLE 2

Assessment of Arcing and Overheating (N/A indicates "Not Applicable")

| Example Number | Vane dimension | Conductive portion dimension | Rounded corner (radius) | Covering | Vane type Border (Top and Bottom) | Separation Distance Gap | Results |
|---|---|---|---|---|---|---|---|
| 9 | 3.5" × 1" | 3.5" × 1.0" | no | none | $16^{10}$ – 1 none | N/A | Arced 28 sec. |
| 10 | 4" × 1" | 3.5" × .75" | Yes .375" | Kapton ® | $16^{10}$ – 5 0.125" | N/A | No arc 2 min. |
| 11 | 4" × 1" | 3.5" × .75" | Yes .375" | Poly-acrylic | $16^{10}$ – 5 0.125" | N/A | No arc 2 min. |
| 12 | 4" × 1" | 3.5" × .75" | Yes .375" | PTFE | $16^{10}$ – 5 0.125" | N/A | No arc 2 min. |
| 13 | 4" × 1" | 3.5" × .75" | Yes .375" | none | $16^{10}$ – 5 0.125" | N/A | No arc 2 min. |
| 14 | 4" × 1" | 3.5" × 1" | Yes .5" | Kapton ® | $16^{10}$ – 6 none | N/A | Arced 16 sec. |

TABLE 2-continued

Assessment of Arcing and Overheating (N/A indicates "Not Applicable")

| Example Number | Vane dimension | Conductive portion dimension | Rounded corner (radius) | Covering | Vane type Border (Top and Bottom) | Separation Distance Gap | Results |
|---|---|---|---|---|---|---|---|
| 15 | 4" × 1" | 3.5" × 1" | Yes .5" | Poly-acrylic | $16^{10}$ – 6 none | N/A | No arc 2 min. |
| 16 | 4" × 1" | 3.5" × 1" | Yes .5" | PTFE | $16^{10}$ – 6 none | N/A | Arced 12 sec. |
| 17 | 4" × 1" | 3.5" × 1" | Yes .5" | none | $16^{10}$ – 6 none | N/A | Arced 17 sec. |
| 18 | 4" × 1" | 3.5" × .75" | Yes .375" | none | $16^{10}$ – 5 0.125" | 0.375" 0.75" | No arc, Burned, 47 sec. Center overheated |
| 19 | 4" × 1.25" | 3.375" × 1" | Yes .5" | none | $16^{10}$ – 5 0.125" | 0.5" 1" | No arc, Burned, 1:18 min, Center overheated |
| 20 | 4" × 1.25" | 3.125" × 1" | Yes .5" | none | $16^{10}$ – 5 0.125" | 0.75 1.5" | No arc No burn 5 min. |
| 21 | 4" × 1.25" | 3.125" × 1" Avery/ Denison tape | Yes .5" | none | $16^{10}$ – 5 0.125" | 0.75 1.5" | No arc No burn 5 min. |
| 22 | 4" × 1.25" | 3.125" × 1" Shurtape tape | Yes .5" | none | $16^{10}$ – 5 0.125" | 0.75 1.5" | No arc, No burn, Adhesive loosened 5 min. |
| 23 | 4" × 1" Fire retardant | 3.5" × .75" | Yes .375" | none | $16^{10}$ – 5 0.125" | 0.375 .75" | No arc No burn 5 min. |

Observations from Examples 9 to 23 were:

1. The combination of rounded corners on the conductive portion and a border of paperboard (i.e., a lower conductivity material) of at least ⅛" (0.125"; 3.2 mm) (about 0.025 wavelengths of the standing wave present in a microwave oven) completely surrounding an uncovered conductive portion of a vane prevented arcing. It should be noted that the border served to space the conductive portion of the vane from the susceptor by a predetermined close distance (Examples 18-23);
2. The combination of a border (predetermined close distance) of at least ⅛" (0.125"; 3.2 mm) and a separation distance of the inner ends of the conductive portions from the geometrical center of the susceptor of ¾" (0.75"; 19.2 mm) (about 0.16 wavelength of the standing wave present in a microwave oven), i.e., a center gap of 1½" (1.5"; 38.1 mm) between opposing conductive portions, prevented overheating and spontaneous combustion of the paperboard of a susceptor assembly when it was exposed in an unloaded microwave oven (Examples 20-22);
3. The combination of a border (predetermined close distance) of at least ⅛" (0.125"; 3.2 mm) and a non-conductive covering of the conductive portion prevented arcing (Examples 10-12). However, as may be seen from Examples 14-16, when the conductive portion was covered with a non-conductive covering and no border was present arcing occurred; and
4. Application of fire retardant to the paperboard prevented spontaneous combustion due to overheating with a separation distance from the geometrical center of the susceptor of ⅜" (0.375"; 9.6 mm) (about 0.08 wavelengths), i.e., a center gap of ¾" (0.75"; 19.2 mm) between opposing conductive portions.

EXAMPLES 24-64

General Comments

In the following Examples 24-64 a susceptor assembly similar to that shown in FIG. 20 was used inside a microwave oven to cook DiGiorno® Microwave Four Cheese Pizza (280 grams). The results of these experiments are set forth in Tables 3, 4A, 4B and 5 below.

The Examples 24-50 and Examples 61-64 were conducted to assess the effect of various vane designs in eliminating overheating susceptor during pizza cooking in various microwave ovens. The remaining examples (viz., Examples 51-60) were conducted to assess the effect of various vane designs on browning of the pizza cooked in various microwave ovens.

As shown in FIG. 20 each susceptor assembly included six identical vanes equally spaced sixty (60) degrees apart mounted onto a susceptor with a ⅜" (0.375"; 9.6 mm) separation distance 21S from each electrically conductive portion of a vane to the geometric center of the susceptor.

The susceptor assemblies tested had substrates formed from various materials. Four different susceptor substrate materials were tested in combination with two different thicknesses of metallization that formed the lossy conductive layer.

The conductive portion of each vane was made using an adhesive backed 0.002" (0.05 mm) thick aluminum foil applied to a cellulose paperboard vane from International Paper as described previously in connections with Examples 9-20. Each conductive portion was 3½" (3.5"; 88.9 mm) in length but of different widths. Tables 3, 4A, 4B and 5 each contain a column of alphabetic designators indicating the "Vane type" tested. Each designator indicates a vane type as depicted in FIG. 19 with the "Width" dimension of the conductive portion and "Border" as follows:

| Designator | Vane type, FIG. 19 | Width | Border |
|---|---|---|---|
| A | Vane $16^{10}$ – 1 | 1.0" (25.4 mm) | None |
| B | Vane $16^{10}$ – 3 | 0.75" (19.2 mm) | 19T 0.25" (6.4 mm) |
| C | Vane $16^{10}$ – 2 | 0.75" (19.2 mm) | 19L 0.25" (6.4 mm) |

-continued

| Designator | Vane type, FIG. 19 | Width | Border |
|---|---|---|---|
| D | Vane $16^{10}$ – 1 | 1.25" (31.7 mm) | None |
| E | Vane $16^{10}$ – 3 | 1.0" (25.4 mm) | 19T 0.25" (6.4 mm) |
| F | Vane $16^{10}$ – 2 | 1.0" (25.4 mm) | 19L 0.25" (6.4 mm) |
| G | Vane $16^{10}$ – 3 | 0.875" (22.2 mm) | 19T 0.125" (3.2 mm) |
| H | Vane $16^{10}$ – 3 | 0.9375" (23.8 mm) | 19T 0.0625" (1.6 mm) |

Tables 3, 4A, 4B and 5 also contain a column of alphanumeric designators indicating the "Oven" used for the test. Each designator corresponds to a particular microwave oven manufacturer and model, as follows:

| Designator | Oven Manufacturer, Model |
|---|---|
| F-950 | Frigidaire, FMV156DBA, 950 Watts, |
| GE-1100 | General Electric, JES1456BJ01, 1100 Watts |
| GS-700 | Goldstar, MAL783W, 700 Watts |
| S-1000 | Sharp, R-1505F, 1000 Watts |
| S-1100 | Sharp, R-630DW, 1100 Watts |

Tables 3, 4A, 4B and 5 contain a column indicating the "Susceptor" (i.e., substrate 12S and layer 12C) used.

The Susceptor in some of the examples contained in Tables 3, 4A and 4B below is identified as "Control". The "Control" susceptor was that provided with the DiGiorno® Microwave Four Cheese Pizza (280 grams) mentioned earlier. The "Control" susceptor included a paperboard substrate.

The "Susceptor" in some of the examples contained in Tables 3 and 5 below is identified by a reference designation comprising hyphenated first and second numeric values. The first numeric value represents the polymeric substrate material of the susceptor, while the second numeric value denotes the thickness of the susceptor lossy layer metallization (vacuum deposited aluminum) based upon its measured optical density.

The first numeric value denotes the polymeric substrate material, as follows:

| First Numeric | Film substrate type |
|---|---|
| 10 | polyethylene terephalate 300 gauge (no heat treatment) (sold under the trademark Melinex ® S from E. I. DuPont de Nemours and Company) |
| 12 | polyethylene terephalate 300 gauge heat stabilized film (sold under the trademark Melinex ® ST-507 from E. I. DuPont de Nemours and Company) |
| 13 | polyethylene napthalene film (PEN) 2 mil sold under the trademark Teonex ® Q51 from DuPont Teijin Films) |

The second numeric value represents the optical density thickness measurement of the metallized coating of vacuum deposited aluminum, as follows:

| Second numeric | Metallization thickness |
|---|---|
| 3 | 0.3 optical density |
| 4 | 0.4 optical density |

Thus, for Example 29 in Table 3, a susceptor designated "12-3" indicates the susceptor had a substrate of 300 gauge polyethylene terephalate heat stabilized film (Melinex® ST-507 film) (as denoted by the first numeric "12") and that the aluminum vacuum deposited metallization had an optical density of 0.3 (as denoted by the second numeric "3").

EXAMPLES 24-34

Figure 27:
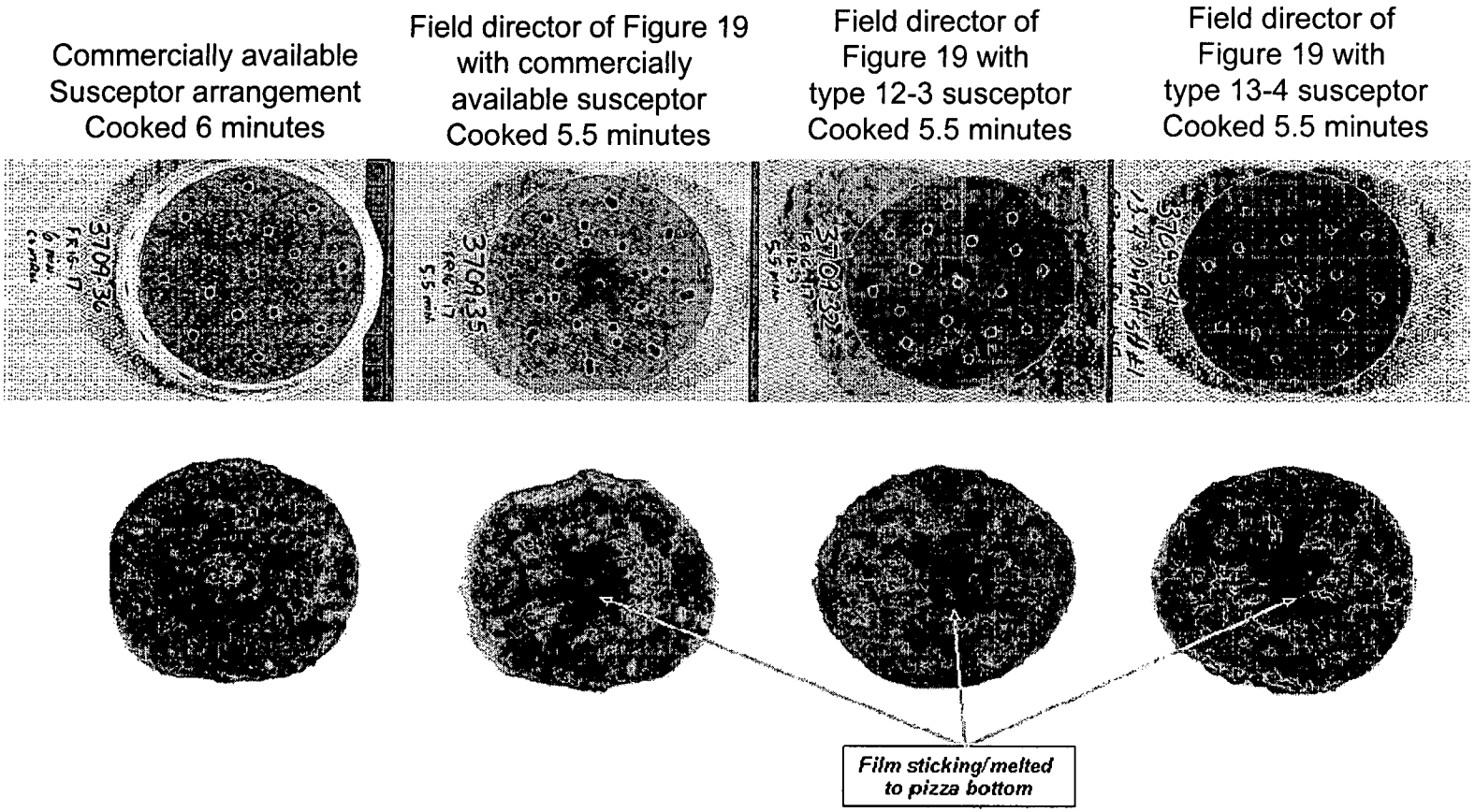
FIG. 27 illustrates typical overheating of the susceptor in Examples 24-34.
Figure 28:
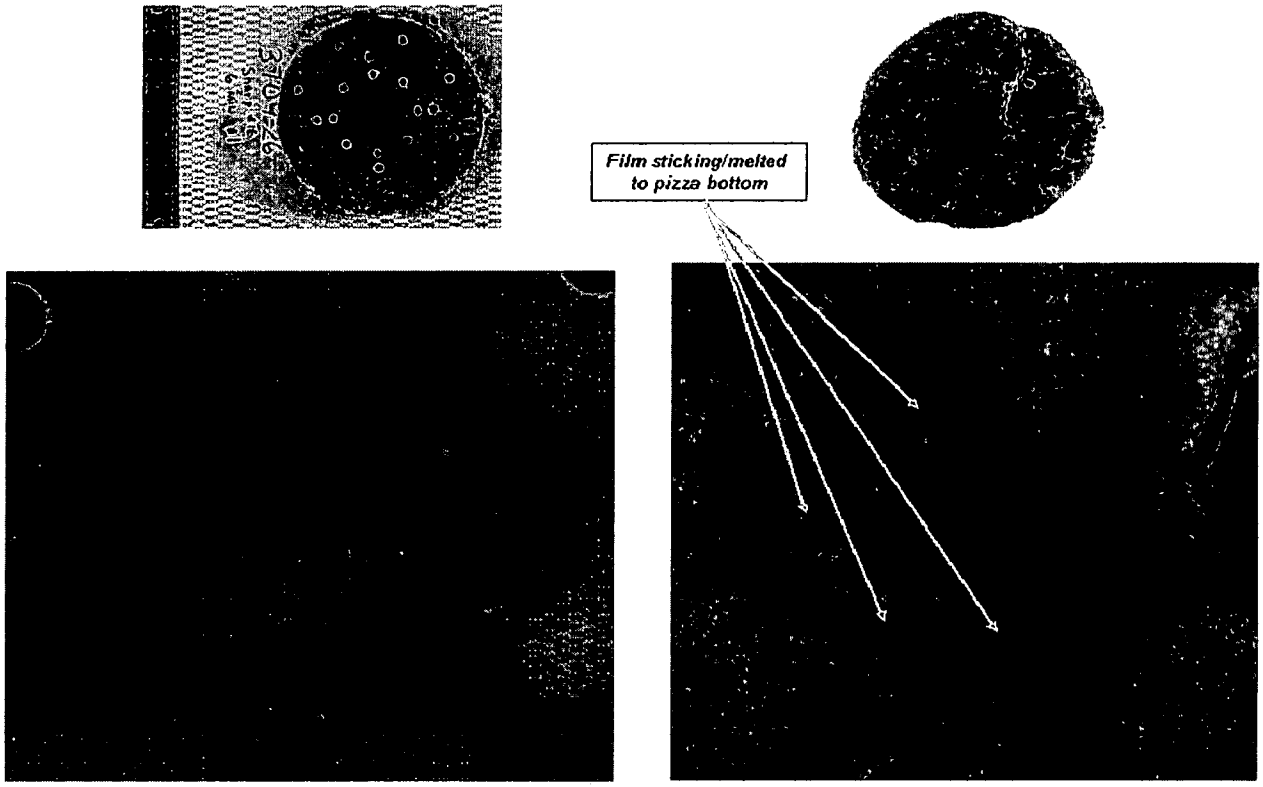
FIG. 28 is an enlarged view showing typical overheating of the susceptor and melting of the protective polymer coating on the susceptor.

A susceptor assembly with Type A vanes (as described above) was used to cook DiGiorno® Microwave Four Cheese Pizza (280 grams) in either the S-1000" or the F-950 oven. As may be seen in Table 3 four types of susceptor substrate materials were used. The cooking time was varied from 5 to 6 minutes. All vaned susceptor assemblies consistently overheated in the center. The severity of the overheating increased with cooking time for each susceptor substrate material used. Examples of the overheating included burned and melted spots on the surface of the susceptor that in some cases resulted in transport of the melted susceptor material to the bottom of the pizza, as may be seen in FIGS. 27 and 28.

EXAMPLES 35-40

In Examples 35 to 40 addition of a ¼" (0.25"; 6.4 mm) border of paperboard on either top or bottom of the conductive portion of the vane was tested to assess its potential to eliminate the overheating in the center of the susceptor. As summarized in Table 3 below, in this series of tests DiGiorno® Microwave Four Cheese Pizza was cooked an S-1000 microwave oven for 6 minutes using susceptors having 12-3 substrates. Field director assemblies exhibit different vane types A, B, C, D, E and F were tested. Example 35 utilized a type B vane; Example 36 utilized a type C vane; Example 37 utilized a type D vane; Example 38 utilized a type E vane; Example 39 utilized a type F vane; and Example 40 utilized a type A vane.

The results are summarized in Table 3.

TABLE 3

Assessment of Overheating of Susceptor

| Example Number | Vane type | Susceptor | Oven | Cook time, min:sec | Result (to Susceptor) |
|---|---|---|---|---|---|
| 24 | none | Control | S-1000 | 6:00 | No overheating |
| 25 | A | Control | S-1000 | 6:00 | Overheating |
| 26 | A | Control | S-1000 | 5:00 | Overheating |
| 27 | A | 10-4 | S-1000 | 6:00 | Overheating |
| 28 | A | 10-4 | S-1000 | 5:00 | Overheating |
| 29 | A | 12-3 | S-1000 | 5:30 | Overheating |
| 30 | A | 13-4 | S-1000 | 5:30 | Overheating |
| 31 | none | Control | F-950 | 6:00 | No overheating |
| 32 | A | Control | F-950 | 5:30 | Overheating |
| 33 | A | 12-3 | F-950 | 5:30 | Overheating |
| 34 | A | 13-4 | F-950 | 5:30 | Overheating |
| 35 | B | 12-3 | S-1000 | 6:00 | No overheating |
| 36 | C | 12-3 | S-1000 | 6:00 | Limited overheating |

TABLE 3-continued

| Assessment of Overheating of Susceptor | | | | | |
|---|---|---|---|---|---|
| Example Number | Vane type | Susceptor | Oven | Cook time, min:sec | Result (to Susceptor) |
| 37 | D | 12-3 | S-1000 | 6:00 | Overheating |
| 38 | E | 12-3 | S-1000 | 6:00 | No overheating |
| 39 | F | 12-3 | S-1000 | 6:00 | Limited overheating |
| 40 | A | 12-3 | S-1000 | 6:00 | Overheating |

Figure 29:
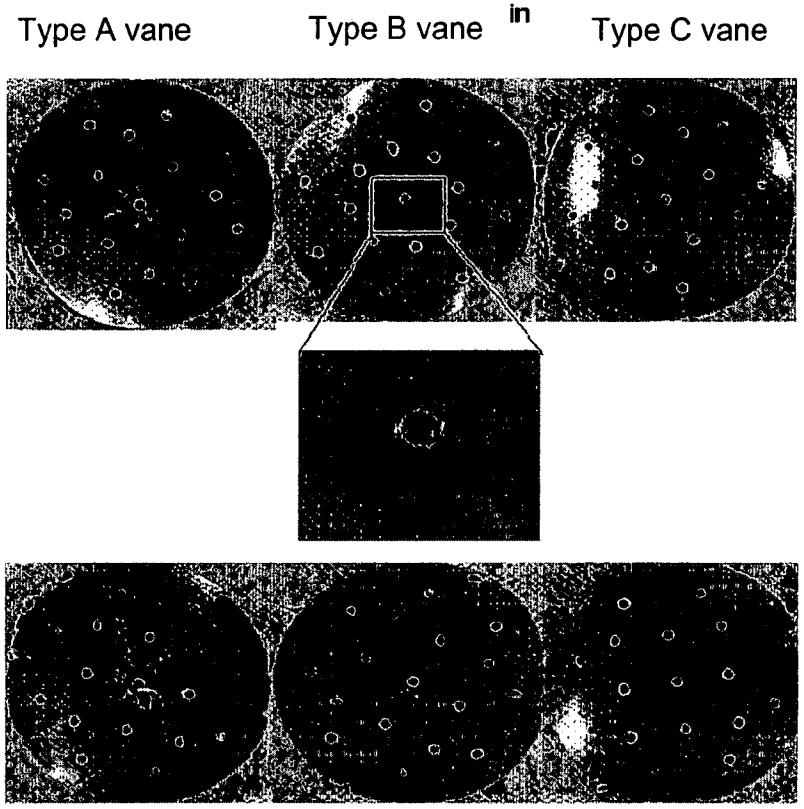
FIG. 29 shows the results of Examples 35-40.

Table 3 illustrates that for vaned susceptors having a separation distance defined between the inner of the conductive portion and the geometric center of the susceptor the addition of a top border between the susceptor and the top edge of the conductive portion of the vane structure (vane Types B and E) consistently prevented overheating of the susceptor. Vaned susceptors without any border (vane Types A and D) consistently led to overheating in the center of the susceptor. Vaned susceptors having a lower border (but no top border) of non-conductive material along the conductive portion of the vane (vane Types C and F) somewhat reduced the severity of the susceptor overheating, but did not eliminate this problem completely. These results of Examples 35-40 are illustrated in FIG. 29.

EXAMPLES 41-60

A series of cooking tests were performed with five microwave ovens identified above. The tests used susceptors with vane types A and B to assess the effect of the addition of a top ¼" (0.25"; 6.4 mm) wide paperboard border along the conductive portion of the vane. Examples 41-50 (summarized in Table 4A) and Examples 51-60 (summarized in Table 4B) respectively used the same test conditions. Examples 41-50 assessed overheating.

Examples 51-60 assessed the overall microwave cooking performance, specifically the ability of this configuration of the susceptor assembly to brown uniformly the bottom of a pizza. Percent browning ("% browning") of a pizza was measured in the same manner as described in connection with Examples 1 through 8. The measured % browning was averaged over three pizza samples.

TABLE 4A

| Assessment of Overheating | | | | | |
|---|---|---|---|---|---|
| Example Number | Vane type | Susceptor | Oven | Cook Time, min:sec | Over-heating |
| 41 | A | Control | S-1100 | 5:00 | Yes |
| 42 | B | Control | S-1100 | 5:00 | No |
| 43 | A | Control | S-1000 | 5:00 | Yes |
| 44 | B | Control | S-1000 | 5:00 | No |
| 45 | A | Control | F-950 | 6:00 | Yes |
| 46 | B | Control | F-950 | 6:00 | No |
| 47 | A | Control | G-1100 | 5:00 | Yes |
| 48 | B | Control | GE-1100 | 5:00 | No |
| 49 | A | Control | GS-700 | 7:00 | Yes |
| 50 | B | Control | GS-700 | 7:00 | No |

TABLE 4B

| Assessment of Cooking Performance | | | | | | |
|---|---|---|---|---|---|---|
| Example Number | Vane type | Suscep-tor | Oven | Cook Time, min:sec | Average % browning | Over-heating |
| 51 | A | Control | S-1100 | 5:00 | 53% | Yes |
| 52 | B | Control | S-1100 | 5:00 | 46% | No |
| 53 | A | Control | S-1000 | 5:00 | 42% | Yes |
| 54 | B | Control | S-1000 | 5:00 | 37% | No |
| 55 | A | Control | F-950 | 6:00 | 69% | Yes |
| 56 | B | Control | F-950 | 6:00 | 63% | No |
| 57 | A | Control | G-1100 | 5:00 | 42% | Yes |
| 58 | B | Control | GE-1100 | 5:00 | 26% | No |
| 59 | A | Control | GS-700 | 7:00 | 19% | Yes |
| 60 | B | Control | GS-700 | 7:00 | 22% | No |

The results shown in Tables 4A and 4B indicated that for vaned susceptors having a separation distance defined between the inner of the conductive portion and the geometric center of the susceptor the addition of a top ¼" (0.25"; 6.4 mm) paperboard border along the conductive portion of the vane (Type B) consistently prevented overheating in the center of the susceptor. However, as seen in Table 4B the overall cooking performance of a susceptor with vane type B decreased (as evidenced by lower average percent browning).

EXAMPLES 61-64

Examples 61-64 evaluated the effect of the width of the top paperboard border between the susceptor and the top edge of the conductive portion of the vane on susceptor overheating. This series of tests was also performed with DiGiorno® Microwave Four Cheese Pizza cooked for 6 minutes in an S-1000 microwave oven. The susceptor assemblies had 12-3 substrate materials and vane types A, B, G and H.

Figure 30:
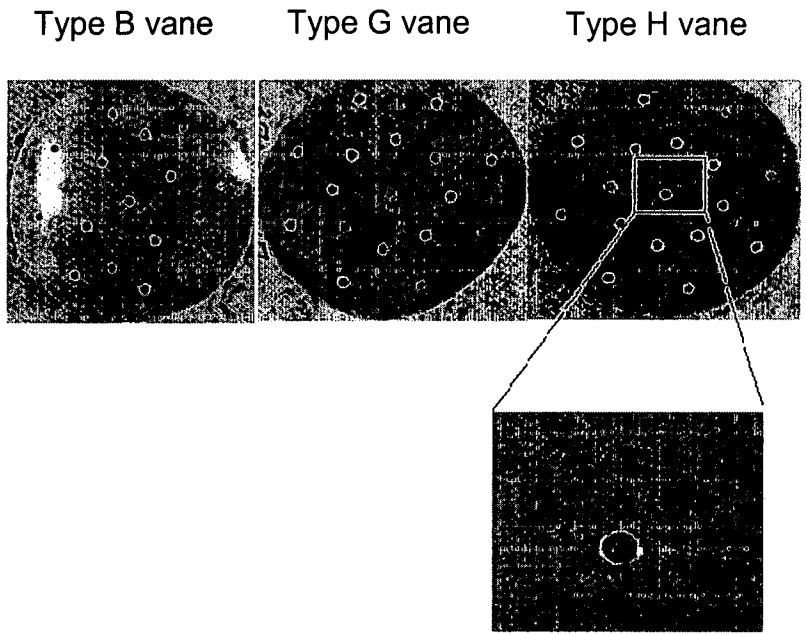
FIG. 30 shows results of Examples 61-64.
Figure 30:
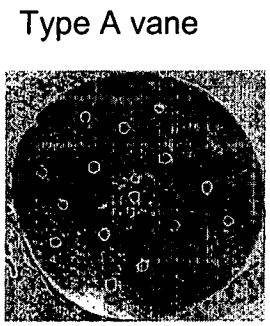

These results of Examples 61-64 are illustrated in FIG. 30 and summarized in Table 5.

TABLE 5

| Assessment of effect of top borders on overheating | | | | | |
|---|---|---|---|---|---|
| Example Number | Vane Type | Susceptor | Oven | Cook Time, min:sec | Susceptor Overheating |
| 61 | A | 12-3 | S-1000 | 6:00 | Yes |
| 62 | B | 12-3 | S-1000 | 6:00 | No |
| 63 | G | 12-3 | S-1000 | 6:00 | No |
| 64 | H | 12-3 | S-1000 | 6:00 | Yes |

These test indicated that for vaned susceptors having a separation distance defined between the inner of the conductive portion and the geometric center of the susceptor a top paperboard border of at least ⅛" (0.125"; 3.2 mm) (i.e., vane types B and G) between susceptor and the top edge of the conductive portion of the vane structure was required to prevent overheating of the susceptor.

Overall, the conclusions drawn from Examples 24 through 64 for vaned susceptors having a separation distance defined between the inner of the conductive portion and the geometric center of the susceptor were:

1. A border of a width of at least ⅛" (0.125"; 3.2 mm) between the susceptor and the top edge of the conductive portion of a vane prevented overheating of the susceptor. It should be noted that the border served to space the conductive portion of the vane from the susceptor by a predetermined close distance;

2. Regardless of substrate used, overheating in the center of the susceptor occurred for susceptor assemblies using vanes with a top border less than ⅛" (0.125"; 3.2 mm). This result was observed for all microwave ovens used.
3. Severity of the overheating (burning and melting) increased with increasing cooking time, higher metallization level of the susceptor substrate, or higher microwave oven power.

Prevention of Arcing

When a field director structure having one or more conductive portions is present in an energized microwave oven (either with or without the presence of a susceptor) the conductive portion(s) cause a disturbance of the standing wave electric field in the oven. The conductive portion(s) concentrate the electric field along their edges, producing local electric field intensities that are much higher than the base electric field within the oven, i.e., the field intensity before the introduction of the conductive portion(s). So long as the oven is loaded these higher field intensities are usually insufficient to cause breakdown of air.

However, when the oven is unloaded (i.e., no food or other article is present) the base electric field increases to a level above that extant when the food or other article is present. In the unloaded case the local intensity of the field along the edge of a conductive portion may be sufficiently high to exceed the breakdown threshold of the air causing an electric discharge in the form of an arc to occur.

It is believed that when a field director structure is used without a susceptor present a conductive portion should be spaced by a border of a lower conductivity material (e.g., a dielectric) at least a predetermined close distance from the planar support member. Preferably the border surrounds the conductive portion. The presence of the border reduces the local electric field intensity at the edges. The magnitude of this reduction is approximated by the following formula:

$$E_l' = E_l/(\in_r'^2 + \in_r''^2)^{1/2}$$

where $E_l$ is the local electric field prior to addition of borders;

$E_l'$ is the local electric field with the border;

$\in_r'$ is the relative dielectric constant of the border material; and $\in_r''$ is the relative dielectric loss of the border material.

In essence, due to the presence of the surrounding border the local fields are attenuated so that the breakdown threshold of air is not exceeded, thus preventing arcing.

When the field director is used with a susceptor the lossy layer of the susceptor also plays a part in preventing arcing. The lossy layer absorbs part of the microwave energy in the oven and converts it to heat. This absorption reduces the electric field intensity in the oven. The heat flows into a food product or other article present.

However when the oven is unloaded there is no food product or other article present in the oven to dissipate the heat generated by the lossy layer. This results in rapid overheating that damages the lossy layer and causes its electrical conductivity to drop significantly. This reduces the ability of the lossy layer to absorb the microwave energy.

Without this absorption by the lossy layer the electric field intensity in the oven increases and the high field intensity condition along the edge of a conductive portion may then exceed the breakdown threshold of the air, causing an electric discharge in the form of an arc to occur.

It is believed that when the conductive portion(s) of the field director structure is spaced from the lossy layer by a border of a dielectric material, the border reduces the local electric field intensity at the edges.

Prevention of Overheating

When a field director structure having two conductive portions is present in an energized microwave oven a concentrated field is created in the space between these conductive portions. When a material having a moderate dielectric loss factor, such as a paperboard planar support member or a susceptor, is placed in or near the region between the conductive portions the concentrated field causes this material to rapidly heat. The concentration of the field is a function of the spacing apart of the conductive portions. If the conductive portions are close enough together this concentrated field may cause the material to overheat sufficiently to burst into flames, as is the case for paperboard. Increasing the spacing between the conductive portions reduces this field concentration and thus prevents overheating.

Those skilled in the art, having the benefit of the teachings of the present invention may impart modifications thereto. Such modifications are to be construed as lying within the scope of the present invention, as defined by the appended claims.

What is claimed is:

1. A susceptor assembly for use in heating an article in a resonant cavity of a microwave oven, the susceptor assembly comprising:

a susceptor having a geometric center, the susceptor having a generally planar presentation surface positioned thereon to accept an article for presentation to the resonant cavity of the microwave oven and a second generally planar opposed surface, the presentation surface of the planar susceptor including an electrically lossy layer; and a field director structure having a plurality of vanes each mechanically connected to the opposed surface of the susceptor, the mechanical connection being implemented by either a fixed or a hinged connection between the vane and the susceptor, at least a first portion of each vane being electrically conductive and at least a second portion of the vane being electrically non-conductive, the electrically non-conductive portion of the vane being disposed between the electrically conductive portion of the vane and the opposed surface of the susceptor such that the electrically conductive portion of the vane is spaced at least a predetermined close distance from the electrically lossy layer of the planar susceptor, the electrically conductive portion of each vane having a first inner end and a second inner end, the first inner end of the conductive portion on each of the vanes being disposed at a distance at least a predetermined separation distance from a reference axis extending through the geometric center of the planar susceptor in a direction substantially perpendicular thereto, so that the occurrence of overheating of the susceptor and the occurrence of overheating of the field director structure is prevented when the susceptor assembly is used in an unloaded microwave oven.

2. The susceptor assembly of claim 1 wherein the microwave oven is operative to generate a standing electromagnetic wave having a predetermined wavelength, and wherein the predetermined separation distance is at least 0.16 times the wavelength.

3. The susceptor assembly of claim 1 wherein the microwave oven is operative to generate a standing electromagnetic wave having a predetermined wavelength, and wherein the predetermined close distance is at least 0.025 times the wavelength.

4. The susceptor assembly of claim 3 wherein the predetermined separation distance is at least 0.16 times the wavelength.

5. The susceptor assembly of claim 1 wherein the microwave oven is operative to generate a standing electromagnetic wave having a predetermined wavelength, and wherein the predetermined close distance is no greater than 0.1 times the wavelength.

6. The susceptor assembly of claim 5 wherein the predetermined separation distance is at least 0.16 times the wavelength.

7. The susceptor assembly of claim 1 wherein the microwave oven is operative to generate a standing electromagnetic wave having a predetermined wavelength, and wherein the predetermined close distance lies in the range from 0.025 times the wavelength to 0.1 times the wavelength.

8. The susceptor assembly of claim 7 wherein the predetermined separation distance is at least 0.16 times the wavelength.

9. The susceptor assembly of claim 1 wherein the electrically conductive portion of each vane is surrounded by a border of a lower conductivity material.

10. The susceptor assembly of claim 9 wherein the electrically conductive portion of the vane has a predetermined width dimension and a corner thereon, the corner of the electrically conductive portion being rounded at a radius up to and including one half of the width dimension.

11. The susceptor assembly of claim 9 wherein the microwave oven is operative to generate a standing electromagnetic wave having a predetermined wavelength, wherein the border has a predetermined width dimension, and wherein the width of the border is at least 0.025 times the wavelength.

12. The susceptor assembly of claim 9 wherein the microwave oven is operative to generate a standing electromagnetic wave having a predetermined wavelength, wherein the border has a predetermined width dimension, and wherein the border has a predetermined width dimension, wherein the width of the border of lower conductivity material is no greater than 0.1 times the wavelength.

13. The susceptor assembly of claim 9 wherein the microwave oven is operative to generate a standing electromagnetic wave having a predetermined wavelength, wherein the border has a predetermined width dimension, and wherein the border has a predetermined width dimension, wherein the width of the border of lower conductivity material lies in the range from 0.025 times the wavelength to 0.1 times the wavelength.

14. The susceptor assembly of claim 1 wherein the electrically conductive portion of each vane is covered with an electrically non-conducting material.

15. The susceptor assembly of claim 14 wherein the electrically non-conducting covering is selected from the group consisting of a polyimide tape, a polyacrylic spray coating and a polytetrafluoroethylene spray coating.

16. The susceptor assembly of claim 1 wherein the electrically conductive portion of each vane comprises a metallic foil less than 0.1 millimeter in thickness and wherein the foil is folded over to at least a double thickness along its perimeter.

17. The susceptor assembly of claim 1 wherein the microwave oven is operative to generate a standing electromagnetic wave having a predetermined wavelength, and wherein the conductive portion of each vane has a width dimension that is about 0.1 to about 0.5 times the wavelength.

18. The susceptor assembly of claim 1 wherein the microwave oven is operative to generate a standing electromagnetic wave having a predetermined wavelength, and wherein the conductive portion of each vane has a length dimension from about 0.25 to about 2 times the wavelength.

19. The susceptor assembly of claim 1 wherein the electrically conductive portion of the vane has a predetermined width dimension and a corner thereon, the corner of the electrically conductive portion being rounded at a radius up to and including one half of the width dimension.

20. A susceptor assembly for use in heating an article in a resonant cavity of a microwave oven, wherein the microwave oven is operative to generate a standing electromagnetic wave having a predetermined wavelength, the susceptor assembly comprising:

a susceptor having a geometric center, the susceptor having a generally planar presentation surface positioned thereon to accept an article for presentation to the resonant cavity of the microwave oven and a second generally planar opposed surface, the presentation surface of the planar susceptor including an electrically lossy layer;

a field director structure at least six vanes each mechanically connected to the opposed surface of the susceptor, each vane being substantially orthogonal with respect to the planar susceptor, the mechanical connection being implemented by either a fixed or a hinged connection between the vane and the susceptor, at least a first portion of each vane being electrically conductive and at least a second portion of the vane being electrically non-conductive, the electrically conductive portion of each vane having a first inner end and a second inner end, the first inner end of the conductive portion on each of the vanes being disposed at a distance at least a predetermined separation distance from a reference axis extending through the geometric center of the planar susceptor in a direction substantially perpendicular thereto, the separation distance being at least 0.16 times the wavelength, the electrically non-conductive portion of the vane being disposed between the electrically conductive portion of the vane and the opposed surface of the susceptor such that the electrically conductive portion of the vane is spaced at least a predetermined close distance from the electrically lossy layer of the planar susceptor, wherein the predetermined close distance is at least 0.025 times the wavelength, so that the occurrence of overheating of the susceptor and the occurrence of overheating of the field director structure is prevented when the same is used in an unloaded microwave oven.

* * * * *